US012263367B2

(12) United States Patent
Whalen et al.

(10) Patent No.: US 12,263,367 B2
(45) Date of Patent: Apr. 1, 2025

(54) DAP SYSTEM ADJUSTMENTS VIA FLEXIBLE RESTRAINTS AND RELATED DEVICES, SYSTEMS AND METHODS

(71) Applicants: Sean Tremaine Whalen, Mountain View, CA (US); Thomas Jack Waldo Allen, Palo Alto, CA (US); Robert Tremaine Whalen, Los Altos, CA (US)

(72) Inventors: Sean Tremaine Whalen, Mountain View, CA (US); Thomas Jack Waldo Allen, Palo Alto, CA (US); Robert Tremaine Whalen, Los Altos, CA (US)

(73) Assignee: Boost Treadmills, LLC, Palo Alto, CA (US)

( * ) Notice: Subject to any disclaimer, the term of this patent is extended or adjusted under 35 U.S.C. 154(b) by 0 days.

(21) Appl. No.: 17/688,890

(22) Filed: Mar. 7, 2022

(65) Prior Publication Data

US 2022/0401782 A1 Dec. 22, 2022

Related U.S. Application Data

(60) Provisional application No. 63/255,001, filed on Oct. 12, 2021, provisional application No. 63/254,969, (Continued)

(51) Int. Cl.

| | |
|---|---|
| ***A63B 21/008*** | (2006.01) |
| ***A63B 21/00*** | (2006.01) |
| ***A63B 22/02*** | (2006.01) |

(52) U.S. Cl.

CPC .... *A63B 21/0088* (2013.01); *A63B 21/00181* (2013.01); *A63B 21/4009* (2015.10); (Continued)

(58) Field of Classification Search

CPC ..... A63B 21/0088; A63B 21/00181; A63B 21/4009; A63B 22/02; A63B 2208/053; (Continued)

(56) References Cited

U.S. PATENT DOCUMENTS

| | | | |
|---|---|---|---|
| 44,198 | A | 9/1864 | Jontes |
| 54,530 | A | 5/1866 | Hadfield |

(Continued)

FOREIGN PATENT DOCUMENTS

| | | | |
|---|---|---|---|
| CA | 2236774 | C | 11/1999 |
| CN | 2034152 | U | 3/1989 |

(Continued)

OTHER PUBLICATIONS

Misa Miura et al., "Acute and Chronic Effects of Lower Body Positive Pressure Exercise on the Very Elderly: A Pilot Study," International Journal of Physical Medicine & Rehabilitation, vol. 1, Issue 9, Oct. 31, 2013.

(Continued)

*Primary Examiner* — Rachel T Sippel
*Assistant Examiner* — Jacqueline M Pinderski
(74) *Attorney, Agent, or Firm* — KandareIP, LLC; Anthony Kandare

(57) ABSTRACT

A height-adjustable DAP exercise system is provided having a support platform, an inflatable enclosure secured to the support platform at a base opening through the enclosure and extending vertically therefrom when inflated, and a top frame attached to the enclosure at an enclosure top opening. The DAP system further includes adjustable lift restraints each having a restraint length between first and second ends and configured for adjustment between a first restraint length and at least one second restraint length, in which each first end of each lift restraint is attached to a middle portion of the enclosure and each second end is attached to the top frame (Continued)

or the base. The enclosure height is adjustable between a first and second enclosure height responsive to adjustments for lift restraint lengths. The system also includes a low height safety harness for the top frame and related methods.

17 Claims, 51 Drawing Sheets

Related U.S. Application Data filed on Oct. 12, 2021, provisional application No. 63/254,972, filed on Oct. 12, 2021, provisional application No. 63/157,697, filed on Mar. 6, 2021.

(52) U.S. Cl.
CPC ..... *A63B 22/02* (2013.01); *A63B 2208/053* (2013.01); *A63B 2225/093* (2013.01)

(58) Field of Classification Search
CPC ..... A63B 2225/093; A63B 2225/62; A63B 22/0046; A63B 2225/50
See application file for complete search history.

(56) References Cited

U.S. PATENT DOCUMENTS 72,634 A 12/1867 Heywood
100,867 A 3/1870 Curran
871,074 A 11/1907 Stockton
1,152,014 A 8/1915 Farkell
1,182,018 A 5/1916 Koenig
1,336,774 A 4/1920 Cooper
1,504,166 A 8/1924 Thomley
2,262,019 A 11/1941 Lincoln
2,785,004 A 3/1957 Leon
3,165,314 A 1/1965 Clearman
3,176,793 A 4/1965 Robert
3,192,014 A 6/1965 Leyshon
3,292,613 A 12/1966 Macleod
3,332,176 A 7/1967 Roy
3,335,529 A 8/1967 Gedney
3,353,309 A 11/1967 Kwake
3,428,015 A 2/1969 Cloud
3,730,587 A 5/1973 Bloxham et al.
3,768,467 A 10/1973 Jennings
3,911,913 A 10/1975 June
4,149,712 A 4/1979 Murphy
4,229,136 A 10/1980 Panissidi
4,257,407 A 3/1981 Macchi
4,343,302 A 8/1982 Dillon
4,411,422 A 10/1983 Solloway
4,509,513 A 4/1985 Lasley
4,536,163 A 8/1985 Schnirch et al.
4,576,376 A 3/1986 Miller
4,614,337 A 9/1986 Schonenberger
4,621,621 A 11/1986 Marsalis
4,648,595 A 3/1987 Selle
4,712,788 A 12/1987 Gaudreau, Jr.
4,731,882 A 3/1988 Ekman
4,776,581 A 10/1988 Shepherdson
4,799,673 A 1/1989 Selle
4,805,601 A 2/1989 Eischen, Sr.
4,887,317 A 12/1989 Phillips, Sr. et al.
4,934,694 A 6/1990 McIntosh
4,959,047 A 9/1990 Tripp, Jr.
4,974,829 A 12/1990 Gamow et al.
5,029,579 A 7/1991 Trammell
5,075,902 A 12/1991 McReynolds et al.
5,109,837 A 5/1992 Gamow
5,112,045 A 5/1992 Mason et al.
5,129,647 A 7/1992 Castellanos
5,133,339 A 7/1992 Whalen et al.
5,176,597 A 1/1993 Bryne
5,221,241 A 6/1993 Bare, II
5,242,339 A 9/1993 Thornton
5,273,502 A 12/1993 Kelsey et al.
5,295,929 A 3/1994 Weisz
5,356,361 A 10/1994 Watenpaugh
5,360,001 A 11/1994 Brill et al.
5,368,532 A 11/1994 Farnet
5,372,561 A 12/1994 Lynch
5,398,678 A 3/1995 Gamow
5,470,293 A 11/1995 Schonenberger
5,527,242 A 6/1996 Gangloff
5,571,062 A 11/1996 Saganovsky
5,577,598 A 11/1996 Schoenenberger
5,577,984 A 11/1996 Bare, II
5,582,561 A 12/1996 Gonzalez
5,623,944 A 4/1997 Nashner
5,626,540 A 5/1997 Hall
5,662,311 A 9/1997 Waedekin et al.
5,662,560 A 9/1997 Svendsen et al.
5,667,461 A 9/1997 Hall
5,678,543 A 10/1997 Bower
5,688,225 A 11/1997 Walker
5,695,432 A 12/1997 Soderlund
5,700,232 A 12/1997 Clausen et al.
5,702,323 A 12/1997 Poulton
5,704,881 A 1/1998 Dudley
5,706,822 A 1/1998 Khavari
5,738,612 A 4/1998 Tsuda
5,799,652 A 9/1998 Kotliar
5,830,162 A 11/1998 Giovannetti
5,860,857 A 1/1999 Wasastjerna et al.
5,919,419 A 7/1999 Majuri
5,921,892 A 7/1999 Easton
5,960,480 A 10/1999 Neustater et al.
6,027,464 A 2/2000 Dahlquist
6,033,344 A 3/2000 Trulaske et al.
6,042,537 A 3/2000 Kaiser
6,146,315 A 11/2000 Schonenberger
6,174,268 B1 1/2001 Novak
6,220,992 B1 4/2001 Shafik
6,273,844 B1 8/2001 Kelsey et al.
6,332,290 B1 12/2001 Delamare
6,332,354 B1 12/2001 Lalor et al.
6,348,025 B1 2/2002 Schonenberger
6,405,685 B1 6/2002 Cox
6,482,128 B1 11/2002 Michalow
6,527,678 B1 3/2003 Wang et al.
6,539,946 B2 4/2003 Weyergans
6,554,747 B1 4/2003 Rempe
6,565,624 B2 5/2003 Kutt et al.
6,609,054 B2 8/2003 Wallace
6,645,126 B1 11/2003 Martin et al.
6,656,091 B1 12/2003 Abelbeck et al.
6,666,831 B1 12/2003 Edgerton et al.
6,689,075 B2 2/2004 West
D495,384 S 8/2004 Rolfes
6,783,482 B2 8/2004 Oglesby et al.
D497,961 S 11/2004 Rolfes
6,821,233 B1 11/2004 Colombo et al.
6,905,459 B2 6/2005 Humphries, Jr.
6,918,858 B2 7/2005 Watterson et al.
7,063,678 B1 6/2006 Cook
7,141,007 B2 11/2006 Egger
7,166,064 B2 1/2007 Watterson et al.
7,494,450 B2 2/2009 Solomon
7,544,172 B2 6/2009 Sanlos-Munne et al.
7,556,040 B2 7/2009 Meyer et al.
7,591,795 B2 9/2009 Whalen
7,594,281 B1 9/2009 Stinson et al.
7,780,573 B1 8/2010 Carmein
7,780,587 B2 8/2010 Thornton et al.
7,785,242 B2 8/2010 Solomon
7,762,930 B2 10/2010 Egger
7,837,597 B2 11/2010 Reves et al.
7,850,629 B2 12/2010 Ravikumar
7,857,731 B2 12/2010 Hickman et al.
7,862,478 B2 1/2011 Watterson et al.
7,883,450 B2 2/2011 Hidler
7,914,420 B2 3/2011 Daly et al.
8,235,724 B2 8/2012 Gilley

(56) References Cited

U.S. PATENT DOCUMENTS 8,308,618 B2 11/2012 Bayerlein et al.
8,447,401 B2 5/2013 Miesel et al.
8,464,716 B2 6/2013 Kuehne et al.
8,480,602 B1 7/2013 Cook
D695,856 S 12/2013 Jacobs et al.
8,639,455 B2 1/2014 Horst et al.
8,679,040 B2 3/2014 Horst
8,762,167 B2 6/2014 Blander et al.
8,790,222 B2 7/2014 Burger
8,840,572 B2 9/2014 Whalen et al.
8,900,074 B1 12/2014 Johnson et al.
8,900,098 B2 12/2014 Egan
8,968,163 B1 3/2015 Vidmar
9,087,454 B2 7/2015 Crivello et al.
9,272,175 B2 3/2016 Egan
9,554,964 B1 1/2017 Johnson et al.
9,561,149 B2 2/2017 Johnson et al.
9,642,764 B2 5/2017 Kuehne et al.
9,672,754 B2 6/2017 Yuen
9,914,003 B2 3/2018 Kuehne et al.
10,004,656 B2 6/2018 Whalen et al.
10,130,554 B2 11/2018 Aronson
10,132,011 B2 11/2018 Malina et al.
10,179,078 B2 1/2019 Bhugra et al.
10,219,734 B2 3/2019 Williams
10,265,565 B2 4/2019 Jue et al.
10,265,566 B2 4/2019 Bayerlein et al.
10,307,653 B2 6/2019 Ebsen
10,342,461 B2 7/2019 Basta et al.
10,345,791 B2 7/2019 Basta et al.
10,398,619 B2 9/2019 Crombie et al.
10,427,293 B2 10/2019 Asbeck et al.
10,493,309 B2 12/2019 Jue et al.
10,533,913 B2 1/2020 Lee et al.
10,596,365 B2 3/2020 Hyde et al.
10,709,926 B2 7/2020 Baverlein et al.
10,773,121 B2 9/2020 Del Monaco et al.
10,816,177 B1 10/2020 Baverlein et al.
10,843,036 B2 11/2020 Baverlein et al.
10,905,914 B2 2/2021 Baverlein et al.
10,918,926 B2 2/2021 Pennington
11,097,175 B2 8/2021 Rodriguez
11,517,781 B1 12/2022 Whalen
D976,341 S 1/2023 Whalen
D976,342 S 1/2023 Whalen
D976,344 S 1/2023 Whalen
11,752,858 B2 9/2023 Sasaki et al.
D976,340 S 10/2023 Whalen
11,794,051 B1 10/2023 Whalen
11,806,564 B2 11/2023 Basta et al.
11,883,713 B2 1/2024 Whalen
2001/0018564 A1 8/2001 Manor et al.
2002/0010056 A1 1/2002 Borsheim
2002/0022554 A1 2/2002 Borsheim
2002/0025889 A1 2/2002 Egger
2002/0032103 A1 3/2002 Cook
2002/0065173 A1 5/2002 Cook
2003/0032904 A1 2/2003 Egger
2003/0046113 A1 3/2003 Johnson et al.
2003/0153438 A1 8/2003 Gordon
2003/0204148 A1 10/2003 Lange et al.
2004/0016043 A1 1/2004 Uno et al.
2004/0019304 A1 1/2004 West
2004/0171465 A1 9/2004 Hald et al.
2004/0238285 A1 12/2004 Stokes
2004/0249675 A1 12/2004 Stark et al.
2004/0259689 A1 12/2004 Wilkins
2005/0075680 A1 4/2005 Lowry et al.
2005/0164839 A1 7/2005 Watterson et al.
2005/0239613 A1 10/2005 Colombo
2006/0009333 A1 1/2006 Wang
2006/0052728 A1 3/2006 Kerrigan
2006/0185065 A1 8/2006 Allen
2006/0190051 A1 8/2006 Gerber et al.
2006/0199712 A1 9/2006 Barnard et al.
2006/0240947 A1 10/2006 Qu
2007/0016116 A1 1/2007 Reinkensmeyer et al.
2007/0054783 A1 3/2007 Egger
2007/0219059 A1 9/2007 Schwartz et al.
2007/0272484 A1 11/2007 Helms
2008/0070757 A1 3/2008 Albert
2008/0246581 A1 10/2008 Irie et al.
2008/0281633 A1 11/2008 Burdea et al.
2008/0306412 A1 12/2008 Nieminen et al.
2009/0014004 A1 1/2009 Whalen et al.
2009/0036272 A1 2/2009 Yoo
2009/0047644 A1 2/2009 Mensah et al.
2009/0082700 A1 3/2009 Whalen et al.
2009/0221404 A1 9/2009 Dorogusker et al.
2009/0236176 A1 9/2009 Sheu
2009/0255531 A1 10/2009 Johnson et al.
2009/0269728 A1 10/2009 Verstegen et al.
2010/0000547 A1 1/2010 Johnson et al.
2010/0006737 A1 1/2010 Colombo et al.
2010/0170546 A1 7/2010 Popovic et al.
2011/0098157 A1 4/2011 Whalen et al.
2011/0098615 A1 4/2011 Whalen et al.
2011/0120567 A1* 5/2011 Kuehne ..... A63B 21/00181 601/1
2011/0312473 A1 12/2011 Chu
2012/0029666 A1 2/2012 Crowley et al.
2012/0238921 A1 9/2012 Kuehne et al.
2012/0277643 A1 11/2012 Whalen et al.
2012/0302301 A1 11/2012 Homsi
2013/0095459 A1 4/2013 Tran
2013/0117908 A1 5/2013 Dyson
2013/0325491 A1 12/2013 Ferrari
2014/0026893 A1 1/2014 Johnson et al.
2014/0058312 A1 2/2014 Ziehler et al.
2014/0113775 A1* 4/2014 Egan ..... A63B 21/00181 482/54
2014/0194252 A1* 7/2014 Arimoto ..... A63B 23/04 482/51
2014/0296037 A1 10/2014 Razzaq
2015/0011917 A1 1/2015 Whalen et al.
2015/0379239 A1 12/2015 Basta et al.
2016/0000155 A1 1/2016 Marecek et al.
2016/0001118 A1 1/2016 Kuehne et al.
2016/0001119 A1 1/2016 Jue et al.
2016/0007885 A1 1/2016 Basta et al.
2016/0008650 A1 1/2016 Jue et al.
2016/0073704 A1 3/2016 Basta et al.
2016/0242993 A1 8/2016 Whalen et al.
2017/0014295 A1 1/2017 Whalen et al.
2017/0128769 A1* 5/2017 Long ..... H04L 67/10
2017/0367916 A1 12/2017 Kuehne
2019/0046828 A1 2/2019 Kuehne et al.
2019/0099315 A1 4/2019 Kuehne
2019/0099320 A1 4/2019 Whalen et al.
2019/0150530 A1 5/2019 Basta et al.
2019/0392939 A1 12/2019 Basta et al.
2020/0016025 A1 1/2020 Devanaboyina
2020/0108291 A1 4/2020 Piazza et al.
2020/0221975 A1 7/2020 Basta et al.
2020/0384309 A1 12/2020 Long et al.
2021/0187348 A1 6/2021 Phillips et al.
2021/0196552 A1 7/2021 Whalen et al.
2021/0205165 A1 7/2021 Kuehne
2021/0251841 A1 8/2021 Whalen et al.
2021/0267833 A1 9/2021 Kuehne
2022/0054893 A1 2/2022 Basta
2022/0059198 A1 2/2022 Basta
2022/0401782 A1 12/2022 Whalen
2023/0058141 A1 2/2023 Long et al.
2023/0109901 A1 4/2023 Whalen
2023/0263695 A1 8/2023 Whalen et al.

FOREIGN PATENT DOCUMENTS

CN 2208414 Y 9/1995
CN 2920312 Y 7/2007
CN 103638633 B 3/2014
CN 203647961 U 6/2014
CN 203663349 U 6/2014

(56) References Cited

FOREIGN PATENT DOCUMENTS

| | | | |
|---|---|---|---|
| CN | 203915904 | U | 11/2014 |
| CN | 104759060 | B | 7/2015 |
| CN | 104800047 | A | 7/2015 |
| CN | 105380657 | B | 3/2016 |
| CN | 105380658 | B | 3/2016 |
| CN | 105579014 | B | 5/2016 |
| CN | 107158648 | A | 9/2017 |
| CN | 207838129 | U | 9/2018 |
| CN | 208115027 | U | 11/2018 |
| CN | 208541744 | U | 2/2019 |
| CN | 208893547 | U | 5/2019 |
| CN | 209845965 | U | 12/2019 |
| CN | 111135537 | A | 5/2020 |
| DE | 20305670 | U1 | 8/2003 |
| DE | 10362043 | A1 | 5/2005 |
| DE | 102006010887 | A1 | 9/2007 |
| GB | 2128488 | A | 5/1984 |
| JP | S592993 | A | 1/1984 |
| JP | S63109878 | A | 5/1988 |
| JP | H05500760 | A | 2/1993 |
| JP | H0549596 | A | 3/1993 |
| JP | H1022334 | A | 1/1998 |
| JP | H11113988 | A | 4/1999 |
| JP | 2000342713 | A | 12/2000 |
| JP | 2001112886 | A | 4/2001 |
| JP | 2001517187 | A | 10/2001 |
| JP | 2002028202 | A | 1/2002 |
| JP | 2002360644 | A | 12/2002 |
| JP | 2004073445 | A | 3/2004 |
| JP | 2005102798 | A | 4/2005 |
| JP | 2007151676 | A | 6/2007 |
| JP | 2008538511 | S | 10/2008 |
| JP | 1395000 | S | 8/2010 |
| JP | D1395000 | | 8/2010 |
| JP | 1421980 | S | 8/2011 |
| JP | 2012214936 | A | 11/2012 |
| TW | 1235427 | B | 7/2005 |
| TW | 4255928 | | 7/2005 |
| WO | 2004103176 | A1 | 12/2004 |
| WO | 2006050787 | A1 | 5/2006 |
| WO | 2006061834 | A2 | 6/2006 |
| WO | 2007038888 | A1 | 4/2007 |
| WO | 2007115565 | A2 | 10/2007 |
| WO | 2008058567 | A1 | 5/2008 |
| WO | WO2009/051765 | | 4/2009 |
| WO | WO20101132550 | | 11/2010 |
| WO | WO2012/129125 | | 9/2012 |
| WO | WO2013/019956 | | 2/2013 |
| WO | WO2013/021709 | | 2/2013 |
| WO | 2014138228 | A1 | 9/2014 |
| WO | WO2019/079655 | | 4/2019 |
| WO | 2019089850 | A1 | 5/2019 |

OTHER PUBLICATIONS

Showa Denki Taiwan, "てらすウォーカー, 取扱説明書・注意書 "("Terasu Walker, Instruction Manual"), May 14, 2015, Taiwan.

Showa Denki Taiwan, "Showa For Medical", Oct. 16, 2014, Taiwan.

Showa Denki Taiwan, "Showa For Medical With Comfortable Rehabilitation" (Terasu Walker), Oct. 16, 2014, Taiwan (see pp. 19-23 of ENG translation).

* cited by examiner

PRIOR ART

PRIOR ART

DAP SYSTEM ADJUSTMENTS VIA FLEXIBLE RESTRAINTS AND RELATED DEVICES, SYSTEMS AND METHODS

CROSS-REFERENCES TO RELATED APPLICATIONS

This application claims priority to the following provisional patent applications: U.S. provisional patent application No. 63/157,697 filed on Mar. 6, 2021 Entitled "DAP System Adjustments Via Flexible Restraints and Related Devices, Systems and Methods; U.S. provisional patent applications filed on Oct. 12, 2021 entitled "DAP System, Platform, Integrated Lifts and Related Devices and Methods" (app. No. 63/254,969); "DAP System, Enclosure. Controls and Related Devices and Methods" (app. No. 63/255,001); and "DAP System, Enclosure, Seal Frame and Related Devices and Methods" (app. No. 63/254,972). Each of the above applications is hereby specifically incorporated by reference in its entirety.

BACKGROUND

Aspects, features, and concepts described herein relate to supplemental equipment for exercise and rehabilitation devices, and particularly to equipment known as unweighting, antigravity, or differential air pressure (DAP) enclosures, systems and related methods for exercise or rehabilitation devices. More particularly, the subject matter described herein relates to vertical safety restraints, lift mechanisms, height adjustment and related devices, systems and methods that can be integrated with, or integrated as components of, a differential air pressure (DAP) system.

Systems for unweighting individuals for rehabilitation and fitness training have been a popular modality. Traditional methods have included aquatic training and using a hoist to lift a person or animal off a walking surface. Harness and hoist systems provide benefits related to their historical use in that they are well-known and can also allow for precise and granular unweighting, but become significantly uncomfortable at off-loading greater than about 25% of normal body weight. Further, aquatic systems can be difficult to control in terms of degree of off-loading, and are cumbersome to use along with having large space and resource requirements.

Systems that create a pressure differential can vary pressure differentials more precisely and are easier to use allowing for a wide range of unloading in small steps. One benefit of this is in the case of rehabilitation, for which it has been shown that increments as small as 1% of normal body weight can effectively determine and bypass a pain threshold below which a user can exercise pain free. More recently, systems creating a pressure differential across a portion of a user have been developed and are generally in commercial use in the rehabilitation and training centers around the world. These systems apply a pressure difference at a portion of the user's body with a net force at the center of pressure. If the net pressure differential is oriented parallel with the force of gravity and located near the user's waist, this off-loading force acts approximately directly counter to the force of gravity and therefore minimally alters the users natural gait patterns.

DAP systems have been commercialized by companies like Showa Denki in Japan, Sasta Fitness of the UK, Vacuwell of Poland, and AlterG Inc. in the US. While these systems offer benefits, they are expensive, large, non-adjustable, require specialized power sources, or are generally limited in access to the market because of the high cost and space burden, or general discomfort in design for users of different body types or heights.

Conventional DAP systems rely on the use of a shell placed around an existing treadmill or similar exercise device. A completely separate chamber is formed that encompasses a base portion of the exercise equipment including the running belt/rollers/deck of a treadmill or the seat and pedals of a stationary bicycle placed inside. These structures duplicate the framing of the combined system and therefore increase the cost, size, shipping bulk, part count, and overall complexity of the system. Further, such conventional DAP systems limit user adjustment of the corresponding exercise device including modifying incline or tilt settings, which impact the pressure differential of conventional DAP systems.

In addition, conventional DAP systems develop substantial vertical and lateral forces in the thousands of pounds in the DAP chamber during use due to conventional unweighting designs exposing large surface areas to unweighting pressures. These systems include supplemental reinforcements and structural additions for the corresponding exercise equipment, which typically is not designed to accommodate such extreme external loading. The elevated forces developed by such conventional systems include outboard expansion forces exerting lateral forces and upward/downward expansion forces applying vertical loads against nearby components of the exercise equipment or applying torque to the framing that may impact lifetime and function of the exercise equipment. Further, even though safety mechanisms and system can reduce and mitigate risks of failure and user injury in conventional DAP systems within low probability ranges, the extreme forces involved, and potential harms inflicted in the event of failure nonetheless amount to significant design risk.

Height adjustment and modification mechanisms for conventional DAP systems operate in direct opposition to the heightened upward and outward forces exerted by the enclosure, such as by applying downward and/or inwardly compressive forces against the enclosure forces for adjusting height downward. Performing adjustments involving compressing while the enclosure is pressurized can further concentrate the high forces of conventional systems and/or direct the forces toward weakened locations, which can pose increased risks for the user. In view of the high forces involved, many conventional DAP systems are unable to modify or fine-tune height settings while in the pressurized state during use. As such, users can be required to engage in multiple height adjustment-inflation cycles for iteratively determining optimal height settings, which is cumbersome, can encourage impatient users to use the system at improper settings, and increase the chances of injury through improper use of DAP systems while exercising. In addition, competing interests for providing upward unweighting, adjusting height, and withstand operating forces can unduly restrict natural gait movements for the user.

Thus, a need exists for overcoming drawbacks and limitations of conventional DAP systems, reducing usage risks, and simplifying user-adjustments and customizations of DAP systems along with enabling safety restraints.

SUMMARY

This summary introduces certain aspects of the embodiments described herein to provide a basic understanding. This summary is not an extensive overview of the inventive subject matter, and it is not intended to identify key or critical elements or to delineate the scope of the inventive subject matter.

According to aspects and features of inventive subject matter described herein, a height-adjustable differential air pressure exercise system includes a support platform having an enclosure support surface, and an inflatable enclosure secured to the enclosure support surface at a base opening defined through the enclosure and extending vertically from the base opening in an inflated condition. The enclosure defines a top opening through a top portion of the enclosure at an enclosure height extending from the base opening to the top opening. The DAP system further includes a top frame attached to the inflatable enclosure at the top opening, and a plurality of adjustable lift restraints each having a first end, a second end, and a restraint length between the first end and the second end. Each adjustable lift restraint is configured to adjust between a first restraint length and at least one second restraint length different from the first restraint length, and each first end is attached to a middle portion of the enclosure between the top opening and the enclosure base. Each second end is attached to the top frame or the base, such that the enclosure height is adjustable between a first enclosure height and at least one second enclosure height different from the first enclosure height in response to at least one of the adjustable length restraints adjusting from the first restraint length to the at least one second restraint length.

In some arrangements, the height-adjustable DAP system can further include a first support proximate a first side of the enclosure that extends upward from the base, and a second support proximate a second side of the enclosure that also extends upward from the base. DAP system can further include a safety restraint having a first end attached to an upper portion of the first support, and a second safety restraint having a first end attached to an upper portion of the second support. The second ends of the first and second safety restraints can be attached to the seal frame and, along with the seal frame, form a flexible low height safety harness for restraining the seal frame at a low height below the lowest enclosure height.

According to other aspects and features of inventive concepts discussed herein, for adjusting an enclosure height of a DAP system can include providing an inflatable enclosure that defines an inner space, a base opening to the inner space, and a top opening to the inner space at an opposite end portion from the base opening, in which the base opening is configured to secure to a base and form an airtight seal with an opening defined through the base, and the enclosure is configured to extend vertically an enclosure height from the base opening to the top opening when in the inflated condition. The method can further include providing a seal frame configured to attach to the enclosure at the top opening, and providing a plurality of adjustable lift restraints each having a first end attached to a middle portion of the enclosure between the base opening and the top opening, in which each of the adjustable lift restraints has a second end opposite the first end and defines a restraint length from the first end to the second end. The second end of each adjustable lift restraint can be configured to attach to one of the base and the seal frame for use with the DAP system in the inflated condition, and each adjustable length restraint can be configured to adjust between a first restraint length and at least one second restraint length different from the first restraint length. As such, the enclosure height can be configured to adjust between a first enclosure height and at least one second enclosure height in response to adjustment of at least one of the adjustable lift restraints from the first restraint length to the at least one second restraint length.

In some arrangements, the method can further include providing a first support proximate the base that extends upward, and also providing a second support proximate the base that extends upward. In addition, the method can include providing a first safety restraint having a first end configured to attach to an upper portion of the first support and a second end configured to attach to the seal frame, in which the first end is separated from the second end by a restraint safety distance. The method can further include providing a second safety restraint having a first end configured to attach to an upper portion of the second support and a second end configured to attach to the seal frame, in which the first end is separated from the second end by a restraint safety distance. As such, the first safety restraint and the second safety restraint can be configured to form a flexible low height safety harness with the seal frame when the first end of each of the first and second safety restraints are attached to a corresponding one of the first and second supports, and the second end of each of the first and second safety restraints are attached to the seal frame. The restraint safety distance of the first safety restraint and the second safety restraint can be configured to support the low height harness at a low height setting below the lowest enclosure height.

According to further aspects and features of inventive concepts discussed herein, an adjustable height frameless DAP enclosure can include a pair of matching opposed substantially inelastic flexible sheets attached to each other along a corresponding perimeter portion of each sheet, in which the pair of attached sheets form an inflatable enclosure. The inflatable can define an inner space between the sheets, a base opening into the inner space at one end of the enclosure, and a top opening into the inner space at an opposite end. The frameless DAP enclosure can further include a top frame attached to the inflatable enclosure at the top opening, and a plurality of adjustable lift restraints that each have a first end, a second end, and a restraint length between the first end and the second end, in which each adjustable lift restraint is configured to adjust between a first restraint length and at least one second restraint length different from the first restraint length, and each first end is attached to a middle portion of the enclosure between the top opening and the enclosure base and each second end attached to the top frame. As such, in an inflated condition the enclosure can be configured to securely attach at the base opening to a base support and extend without requiring external frame support in a vertical direction an enclosure height from the base opening to the top opening. However, it is understood that an auxiliary structure can be located proximate the enclosure, such as control panel support bracket or the like, and that the enclosure can contact such a structure during use in the inflated configuration without significant contact forces or imparting structural support to the enclosure. Further, the enclosure height can be adjustable between a first enclosure height and at least one second enclosure height different from the first enclosure height in response to at least one of the adjustable length restraints adjusting from the first restraint length to the at least one second restraint length. In addition, the plurality of adjustable lift restraints can be configured to form a lift restraint support framework between the top frame and portions of the enclosure, and the lift restraint support framework can be configured to transmit lift restraint tensile forces to portions of the enclosure for independently supporting the adjusted height configuration.

Other exercise-related support devices, related systems, and components, and/or methods according to embodiments will be or become apparent to one with skill in the art upon review of the following drawings and detailed description. It is intended that all such additional devices, related components, systems, and/or methods included within this description be within the scope of this disclosure.

BRIEF DESCRIPTION OF THE DRAWINGS

FIG. 2L is a perspective view of an additional to seal frame configuration according to aspects and features of example enclosures described herein.

FIG. 9A shows a schematic side view representation of an example arrangement of an inflatable enclosure having a combined height adjustment and reinforcement system including four (4) adjustable lift restraints along with safety restraints according to inventive concepts discussed herein, which illustrates a configuration prior to adjustment, whereas

FIG. 14 shows a Detail View A of a belt connection as indicated in FIG. 13B.

DETAILED DESCRIPTION

Figure 1A:
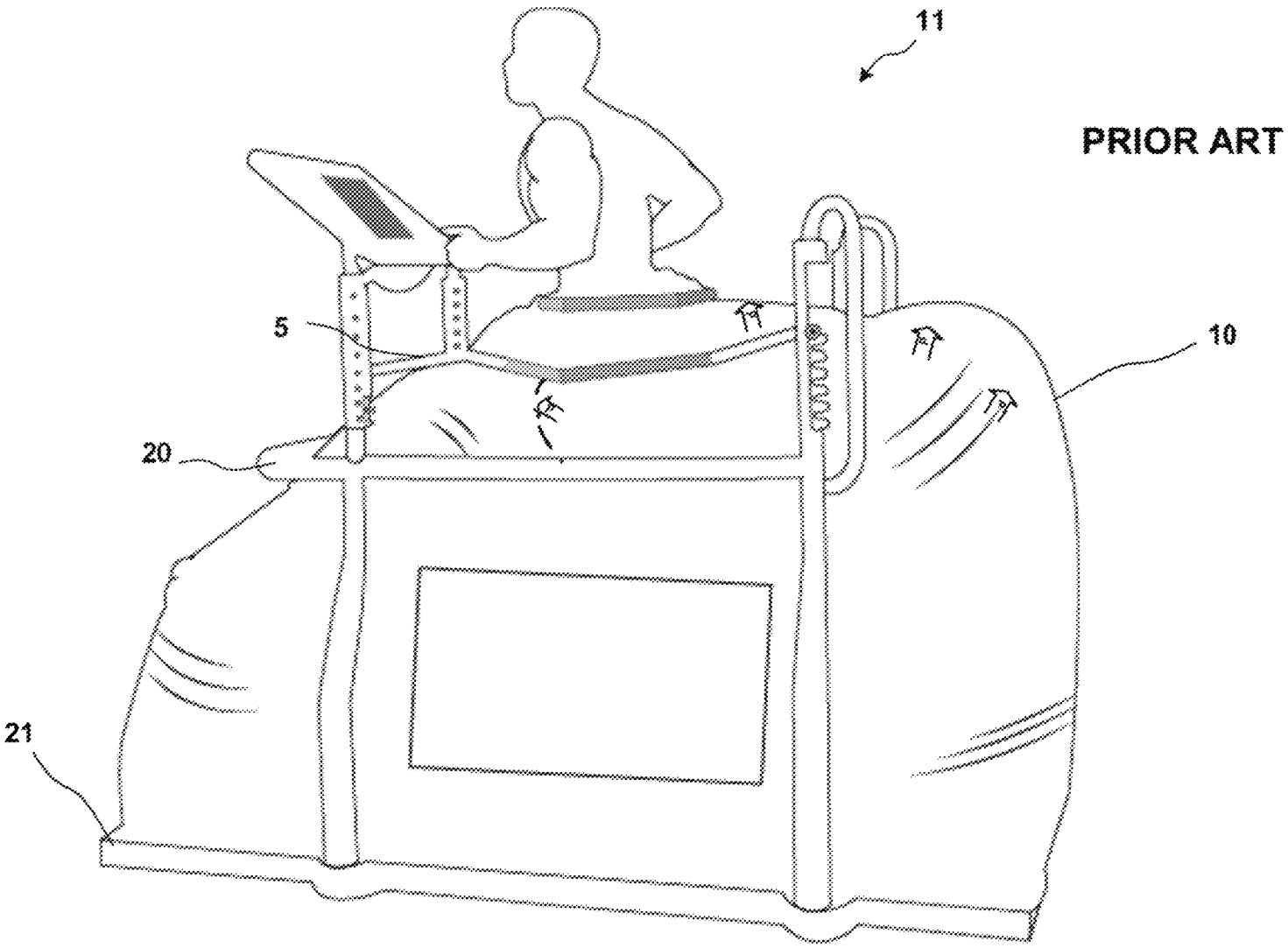
FIG. 1A is a perspective view of a conventional PRIOR ART DAP exercise system for use with a treadmill, which includes a conventional unweighting enclosure having a rigid height adjustment bar separate from the user-interface support.

For the purposes of promoting an understanding of the aspects, features and principles pertaining to the invention and configurations discussed herein, reference will now be made to the example configurations and arrangements illustrated in the drawings along with language describing the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly, or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

As used herein, the term "about" when used in connection with a referenced numeric indication means the referenced numeric indication plus or minus up to 10 percent of that referenced numeric indication. For example, the language "about 50" covers the range of 45 to 55. Similarly, the language "about 5" covers the range of 4.5 to 5.5.

As used in this specification and the appended claims, the words "top," "above," and "upward" refer to elevation directions away from the ground level of an exercise device in its typical or intended usage orientation at or towards a higher elevation, and the words "bottom," "below," "base" and "downward" refer to elevation directions at or towards the ground level of an exercise device at a lower elevation in its typical usage orientation. Thus, for example, the top of a structure for an exercise device that is farthest from the ground level of the exercise device would be the vertical distal end of the structure, and the end opposite the vertical distal end (i.e., the end interfacing with the exercise device closest to ground level) would be the vertical base or bottom end of the structure.

Further, specific words chosen to describe one or more embodiments and optional elements, or features are not intended to limit the invention. For example, spatially relative terms—such as "beneath," "below," "lower," "above," "upper," "proximal," "distal," and the like—may be used to describe the relationship of one element or feature to another element or feature as illustrated in the figures. These spatially relative terms are intended to encompass different positions (i.e., translational placements) and orientations (i.e., rotational placements) of a device in use or operation in addition to the position and orientation shown in the figures. For example, if a device in the figures were turned over, elements described as "below", or "beneath" other elements or features would then be "above" or "over" the other elements or features. Thus, the term "below" can encompass both positions and orientations of above and below. A device may be otherwise oriented (e.g., rotated 90 degrees or at other orientations) and the spatially relative descriptors used herein interpreted accordingly. Likewise, descriptions of movement along (translation) and around (rotation) various axes include various spatial device positions and orientations.

Similarly, geometric terms, such as "parallel," "perpendicular," "round," "curvilinear," "articulated" or "square," are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

In addition, the singular forms "a," "an," and "the" are intended to include the plural forms as well, unless the context indicates otherwise. The terms "comprises," "includes," "has," and the like specify the presence of stated features, steps, operations, elements, components, etc., but do not preclude the presence or addition of one or more other features, steps, operations, elements, components, or groups.

Unless indicated otherwise, the terms exercise apparatus, device, equipment, systems, and variants thereof, can be interchangeably used.

In this specification, the applicant may refer to an exercise machine and an existing exercise machine. The reader shall note that the distinction is that an existing exercise machine may be already designed prior to consideration for use as a DAP system and an existing exercise machine may be further already installed in the field, for example in a gym, training facility, etc. The reader shall interpret minor modifications of the exercise machine or existing exercise machine for use with a DAP system as still part of the exercise machine and still within the spirit of the scope of the subject matter disclosed.

As used herein, an "independently-supportable" inflatable enclosure refers to an inflatable enclosure formed from a substantially inelastic material defining a base opening configured to be secured to a base support, configured to form an airtight connection with an air supply, and defining a top port configured to form an airtight connection with a user interface such that, when inflated, secured to the air supply, and forming an airtight connection with a user, the inflatable enclosure is capable of independently extending in an upward direction from the base support and providing unweighting forces on the user without requiring a support framework or other attachments or connections to support members regardless of whether the inflatable enclosure makes contact with a supplemental support member. As such, an independently-supportable inflatable enclosure forms a hollow, thin-shelled inflatable support enclosure extending from the secure attachment with the base support upward to the top port and user interface.

In accordance with a general aspect of concepts discussed herein, an inflatable unweighting enclosure for an exercise device is provided having a top port or opening formed therein, a corresponding hoop-shaped retention bracket or top frame outlining the opening, and an arrangement of generally ascending or vertically oriented tensile restraints while in the inflated state disposed about a horizontal perimeter portion of the enclosure. The top frame is configured to interface with a user's harness or other user interface and form a support connection therewith during use of the unweighting enclosure, in which the user extends into and through the top port and seal frame. An arrangement of tensile restraints includes a plurality of integrated enclosure-to-enclosure, enclosure-to-seal frame, and/or external support-to-bracket tensile restraints each having a generally vertical, ascending orientation when the enclosure is in the inflated state. The arrangement can be configured as a balanced arrangement of ascending restraints spaced apart and around a horizontal perimeter region of the enclosure, such as a matching number and arrangement of ascending restraints disposed on each lateral side (Left side and Right side) of the enclosure in the inflated condition, and/or having a matching or corresponding number and arrangement of ascending restraints on each forward/rearward end of the enclosure.

Although having generally matching or corresponding arrangements, it is understood that purposefully unbalanced arrangements can be included that are fully or partially modifiable as desired and for enabling customized arrangements. Such flexibility can be used for encouraging particular configurations, such as a desired pitch that encourages a fore-aft tilt preferred by most users, and/or for counteracting roll or yaw motions temporarily imparted to the enclosure by settings of users or user-characteristics, such as a user having an unbalanced gait. In some configurations, an arrangement of four (4) ascending restraints can be provided including two (2) ascending restraints on each lateral, L/R, side of the enclosure, one (1) restraint per side disposed at a forward portion of the seal frame, and one (1) restraint per side disposed at a rearward portion of the seal frame. In some arrangements, one (1) ascending restraint per side can be provided and (2) two overall. In other arrangements, a plurality of ascending restraints per side can be provided including six (6), seven (7), eight (8) or more per lateral side, and one (1), two (2) or more ascending restraints can be provided proximate or along fore and aft regions of the inflatable enclosure. A few, some, most or even all restraints can be configured for adjustment or have adjustable lengths and/or tensile strengths, and in some arrangements, some of the restraints can have generally fixed locations and orientations.

Each of the ascending restraints can be configured to have a generally vertical oriented arrangement when the inflatable enclosure is pressurized during use. Further, each of the ascending restraints can be configured for passive engagement that has little or no impact on the inflatable enclosure until each restraint is placed in tension as the enclosure reaches or begins to reach a particular height, size, or inflation for the configuration of the particular restraint, its orientation, extent of adjustment, and/or other factors. In some configurations, the restraints can be adjusted and configured by an individual user according to user characteristics and preferences, and/or by a control system for the DAP system according to pre-established settings or as determined by the system, such as based on a user parameter like height. In some configurations, some or all of the ascending restraints can be modifiable or adjustable when the enclosure is inflated and/or during use. In other configurations, some or all of the ascending restraints can be modified while the enclosure is in the uninflated state or mildly inflated state, such as less than 10 mmHg or 5 mmHg or between 0-10 mmHg. Some or all can be modified in a partially inflated state or during inflation, and some or all can be modified when fully inflated during usage. Further, some or all of the restraints can include pre-set adjustment choices, and/or some or all of the restraints can include user-selectable adjustment options within a range of adjustments, such as within a height adjustment range. In addition, some can be manually adjustable while others can be adjustable via motorized control device. Further, the say can be configured to automatically detect or know a user's parameters including height and/or preferences, and can adjust the height to a predetermined height setting and/or adjust other user-related preferences or settings.

In accordance with various aspect and features of inventive concepts discussed herein, the inflatable enclosure can be configured to be self-supporting beyond its attachment at its base, such that configurations of the inflatable enclosure can inflate and operate without including adjacent or skeletal frame members arranged to restrain, modify and/or significantly shape the enclosure. Such a beneficial arrangement can allow operation of the DAP at lower pressures and/or applications of forces than conventional DAP systems, and thereby significantly reduce risks associated with usage. Inventive concepts pertaining to frameless enclosure are described along with various examples in the related provisional application filed on Dec. 1, 2020 identified above. The addition of integrated restraints with these and other DAP enclosures can enhance safety and flexibility of such enclosures with minimal performance impacts, and can further provide better folding to allow improved ingress/egress including ensuring metal framing does not get hung up on bag folds that can cause a trip hazard while the user gets in and out of the enclosure.

Integrated restraints discussed herein can provide such functional, safety and performance enhancements for frameless enclosures, and thereby enable compact, lightweight, and low-force implementations of DAP systems having high-performance features matching or exceeding that of conventional DAP systems. For example, in some configurations, non-adjustable, permanently attached restraints straps or reinforcement strips can be sewn into or otherwise affixed to the enclosure wall or fabric in the direction of high stresses and most likely failure locations. Further, in some arrangements, integrated restraints can be provided for height adjustment purposes and for safety/restraint functionality. For example, one or more adjustable restraints can be provided as restraints integrated with the enclosure, which can be disposed on an external side of the enclosure, internally, or in combinations of internal and external restraints. Further, in some arrangements, some restraints can be partially internally or externally integrated with the enclosure and configured to interact with another device, such as a mechanical lift mechanism, an adjustable support, or a drive mechanism for height adjustment. Further, some integrated restraints can be set for a maximum safe enclosure height setting as the greatest extent of the restraint, have adjustable lengths, and have restraints ends designed to remain attached at all times for all extent settings. As such, upon inflation of the enclosure to its highest height setting, if the enclosure tore or encountered a similar failure mode, the integrated restraints would automatically restrain the enclosure from expanding to an unsafe height for the user or enclosure and thereby significantly reduce potential damage or injury.

According to some aspects and features described herein, the inflatable enclosure can be configured as a low-profile, dome-shaped top, low-hoop stress inflatable enclosure, which can provide unweighting benefits to users as part of a DAP system at relatively low pressure, small volumes, and low operational forces. These compact enclosures can carry enclosure stresses within the enclosure sheet material, which in some arrangements are oriented along meridional lines extending from a center point region on one side of the enclosure, radially outward toward and around the edge or hoop portion of the enclosure, and to the center point on the opposite side of the enclosure. In some configurations employing compact inflatable enclosures, the arrangements of safety restraints can generally be aligned to coincide with meridional stress lines to the extent possible. Further, adjustable length safety restrains can be employed to move and impart height-adjusting restraints and enclosure limitations along orientations aligned with enclosure stress lines, which can maintain benefits provided from the compact designs and permit height adjustments with low force applications.

According to aspects and features of innovative concepts described herein, the safety restraints can operate as generally one-way, flexible tensile members, which only engage and apply significant restraints and force applications in the tensile direction in accordance with the particular arrangement of each. Such an arrangement can provide benefits both for enabling safe compact enclosure operations and enhancing enclosure functionality as height adjustment members. Although described as having a generally vertical orientation in the inflated condition and, to the extent possible for compact enclosures, have orientations coincident with meridional stress lines, it is understood that many different beneficial orientations and arrangements of safety restraints and/or dual function height adjusters can be employed. For example, in some arrangements, it can be beneficial and preferable to place the safety restraints operable as height adjusters proximate the user when positioned through the top port during use. Such arrangements can simplify self-adjustment of preferred height and/or preferred orientation of the seal frame, which can be modified prior to inflation and/or during use. Further, such arrangements can be arranged as front and back restraints that can shrink the overall circumference of the enclosure, such as by flattening a curved diameter of a top portion of the enclosure.

In some arrangements, one or more lift mechanisms can be employed, such as mechanized roller lifts, to raise the seal frame around the user and hold it in place until the user is prepared to inflate the enclosure. Such arrangements take advantage of multiple beneficial features in a complementary fashion using combinations of restraints. The lift provides upward mobility assistance to greatly simplify pre-use arrangements of the user, and does so in a one-way, upward movement direction via safety restraints. Further, during use the safety restraints can operate to provide safety 'catch' functions for the user, such as for sudden losses of power or if the user were to lose balance or otherwise fall. Safety restraints can be set to engage at a low height limit for maintaining a safe seal frame height, and thereby catch the user before completing the fall. In some arrangements, the lift mechanism can be configured to operate with safety restraints and slowly lower the seal frame to the ground for providing a controlled lowering of the seal frame. Such operations can help avoid user injury and assist with exiting the exercise equipment and DAP system. In a like manner in the opposite direction, as described above, lift safety restraints can limit and catch upward movements of the enclosure beyond safe limits. Thus, the combination of safety restraints and lift restraints can cooperate to provide enhanced bi-directional safe operations during use of the DAP system.

In some configurations, in addition to having height adjustment and/or safety restraints provided proximate the user, height adjustment and/or safety restraints can be configured for simplified use via minimal exertions of force. In one arrangement, adjustable lift restraints can extend between the seal frame and another connection on the enclosure, such as around its midpoint or middle third of the enclosure. The adjust lift restraints can be arranged to adjust via cinch straps or cam lock straps, which include strap buckles configured for automatic locking engagement in an expansion direction of the strap while allowing adjustable movements in the contraction direction of the strap. Further, cinch strap adjustable lift restraint arrangements can be configured such that the user need only apply downward or primarily downward force on the adjuster for height reductions, which allows the user to apply their body weight as part of the adjustment force and can simplify adjustments. In addition, an arrangement of four such adjustable lift restraints can be provided that are attached to four basic corner portions of the seal frame. This can permit the user to adjust each of the forward corners and each of the rearward corners of the bracket for setting both desired height and orientation of the bracket for usage.

In some arrangements, one end of each adjustment/safety restraint can be attached to the seal frame for simplified adjustments by the user. The other end can be attached to a portion of the enclosure, which can maintain all stresses as being carried within the enclosure—especially for arrangements taking advantage of compact enclosure designs. As such, the high forces exerted with conventional systems can be avoided both for a base arrangement of the enclosure, and for height-adjusted arrangements that maintain stresses as being carried within the enclosure skin. This can avoid the need for skeletal frameworks and other reinforcement structures that can ultimately increase costs and complexity along with introducing unnecessary safety risks. Similarly, adjustable lift restraints can each be attached along other portions of the enclosure other than to the seal frame, such as along lower portions of the enclosure. In some configurations, manual and/or automatic height adjustments can be performed using adjustable lift restraints at these other locations. In some arrangements, the adjustments can be made prior to inflation, such as by the user according to pre-established settings.

In addition, in some configurations according to aspects and features described herein, supplemental restraints can extend between the seal frame and one or more sets of external, vertically adjustable supports. The supports can greatly simplify adjustments for the user by providing a powered adjustment mechanism that allows the user to make adjustments as needed during use of the DAP system including height adjustments, adjustments for the orientation and comfort of the seal frame, as well as adjustments for the user's gait. In particular, the use of flexible tensile members, such as straps, for connecting with the movable supports and pulling up or down on the seal frame in accordance with power adjustment settings from the user can provide benefits pertaining to natural gait movements of the user while running or walking. This is because the flexible tensile member supplemental restraints can be controlled by the corresponding vertical supports to support seal frame positioning in a "float" arrangement, in which upward, unweighting support imparted to the seal frame by the pressurized enclosure is balanced with height adjustment restraints applied by the supplemental restraints. The vertical supports can drive continual customized lift restraining force on the seal frame via the supplemental restraints to support natural gait movements for the user's height. In contrast, some conventional systems provide combined unweighting and support connections to a user-interface support via 'bungee' type connections, which can be highly variable and imprecise. Other conventional systems having DAP mechanisms apply unweighting support in an upward direction to a user-interface support along with applying opposite height adjustment forces to the user-interface support in a downward direction, which can rigidly restrain the support between the competing forcing and significantly reduce freedom of motion for gait movements. As such, the user can experience variable unweighting support with significant freedom for gait movements for a height setting, or experience relatively constant unweighting support at a height setting with limit freedom for gait movements.

In some configurations according to concepts described herein, multiple sets of restraints can be employed to provide safety restraint functionality and lift restraints for height adjustments, as well as optional supplemental restraints for providing height adjustments along with supporting natural gait movements. For instance, a set of four adjustable lift restraints can be attached at one end to the seal frame and at the other end to portions of the enclosure for supporting user-adjustable height settings along with a pair of safety restraints for supporting a low height safety "catch" mechanism. In another example, a set of four supplement restraints can be attached at one end to the seal frame and at the other end to vertical supports for supporting adjustable height settings along with enhanced support for natural gait movements, which can also be configured to act as safety restraints. Optionally, one or more pairs of safety restraints could also be attached to the seal frame for supporting a low height safety "catch" mechanism.

Although described in examples herein primarily as 'straps', it understood that other tensile members can be used and function as safety restraints, lift restraints, and/or supplemental restraints. Straps can be beneficial for use as integrated restraints with enclosures based on having a flat shape and providing beneficial properties, such as being able to apply high tensile forces in lightweight arrangements. Other high tensile strength arrangements and materials can also be used including various natural fiber, synthetic, metallic, polymeric, fiber-reinforced materials including glass or ceramic fiber reinforced materials, and hybrid combination materials and the like. Further, in some arrangements, these safety restraints can be configured as partially elastic tensile members, which can impart beneficial levels of flexibility and/or biased restraint forces to the seal frame.

Figure 11:
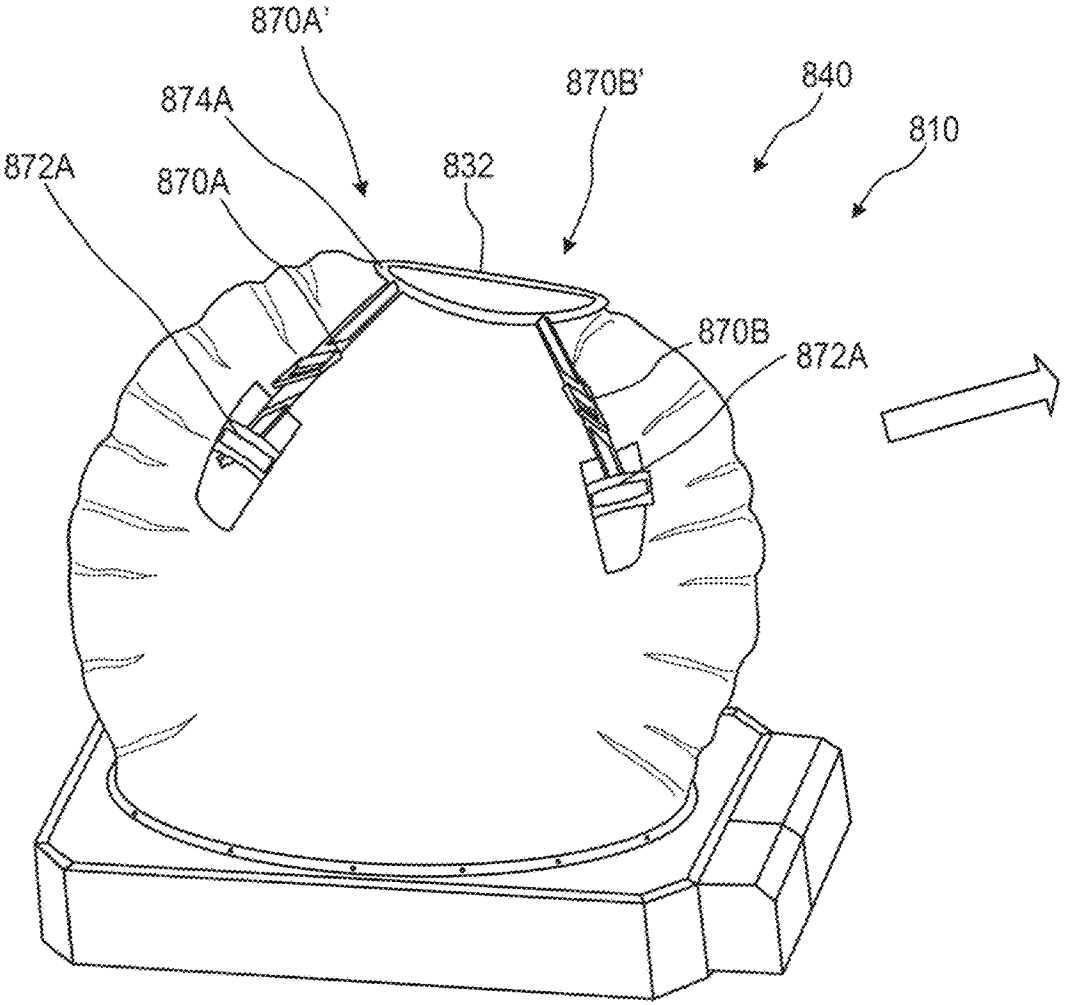
FIG. 11 shows a side perspective schematic representation of an inflatable enclosure having a combined height adjustment and reinforcement system including an additional example arrangement of four (4) adjustable lift restraints without showing safety restraints according to inventive concepts discussed herein, which includes a cinch strap adjuster configuration as a representation of variable, non-preset position adjustable lift restraints.

Referring now to FIG. 1A, a conventional differential air pressure system 11 is shown in FIG. 1A, which corresponds with FIG. 11 of U.S. Pat. No. 10,046,656 to Whalen et al. (DAP '656). The DAP '656 system 11 includes an inflatable enclosure arranged as pressure chamber 10, an exercise device (not shown) located within the chamber, and a frame 20 having a plurality of connecting bars or rails including a base 21 arranged as a system platform. Inner lower edges (not shown) of the pressure chamber 10 are attached to platform or base 21 via a sealed connection. In addition, the pressure chamber 10 is attached to bars, rails, and other frame components around the perimeter of the chamber at varying heights above the attachment to the platform or base attachment via mounts, connectors and/or interference/contact connections. The conventional system 11 can apply upweighting forces to the user as shown in FIG. 1A along with exerting considerable forces against the frame 20, which applies constant counteracting forces during use to restrain the upweighting forces and forces applied in other directions including laterally, forward, and rearward based on internal pressures acting against the significant surface areas of the enclosure. The conventional system 11 includes a rigid horizontal bar 5 that is restrained by slots in upper members of the frame 20 for preventing upward encroachment of the inflated enclosure against the user, and for applying increasing downward force against upper portions of the enclosure for lower height settings. As can be seen in FIG. 1A, significant outward bulging of the enclosure in almost all directions including bulging around the bar where it interfaces with the inflated enclosure.

Figure 1B:
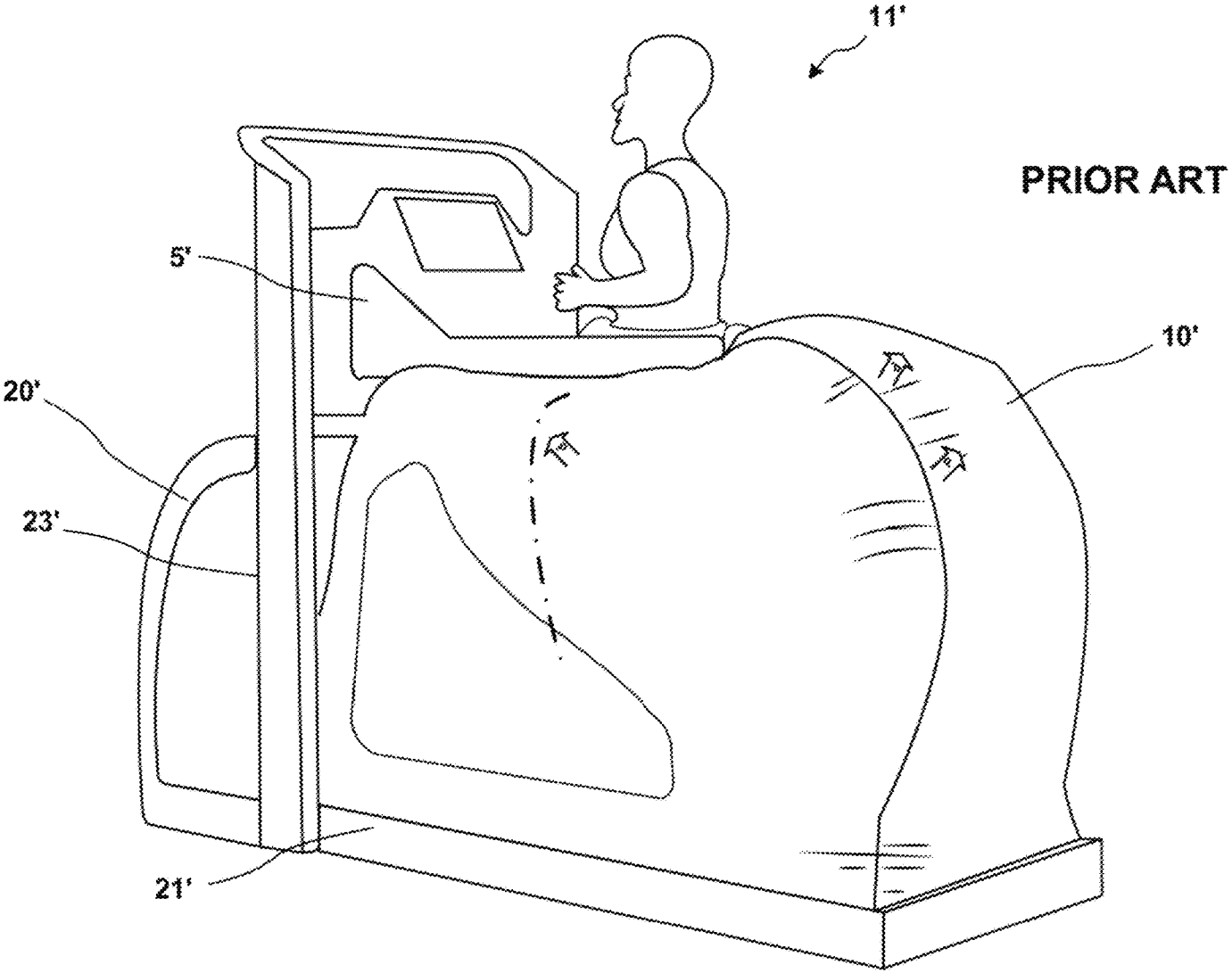
FIG. 1B is a perspective view of another conventional PRIOR ART DAP exercise system for use with a treadmill, which includes a conventional unweighting enclosure having a movable rigid height adjustment frame attached to a user-interface support.
Figure 1C:
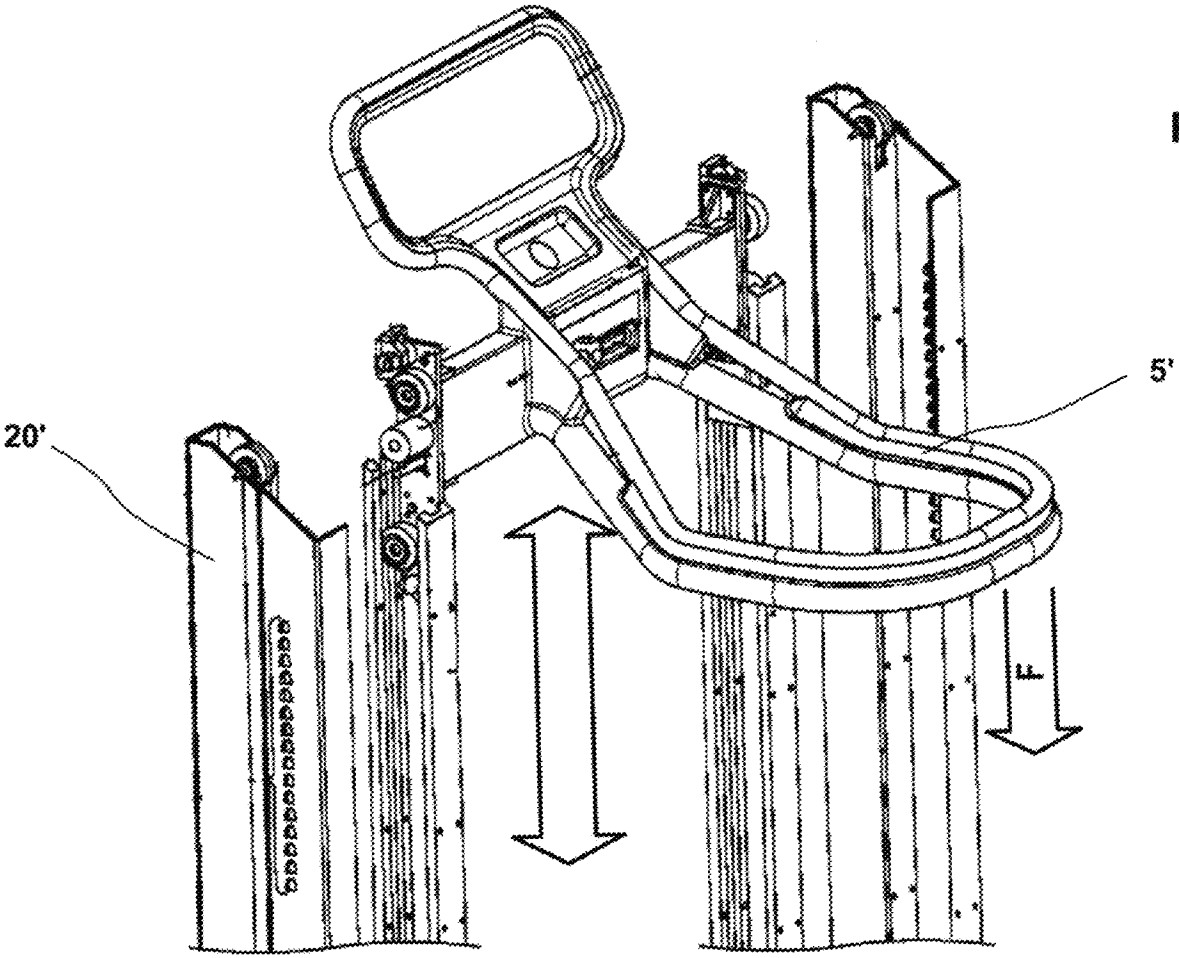
FIG. 1C is a perspective of movable height adjustment frame and frame of the user-interface support for the PRIOR ART DAP exercise system of FIG. 1B.
Figure 8:
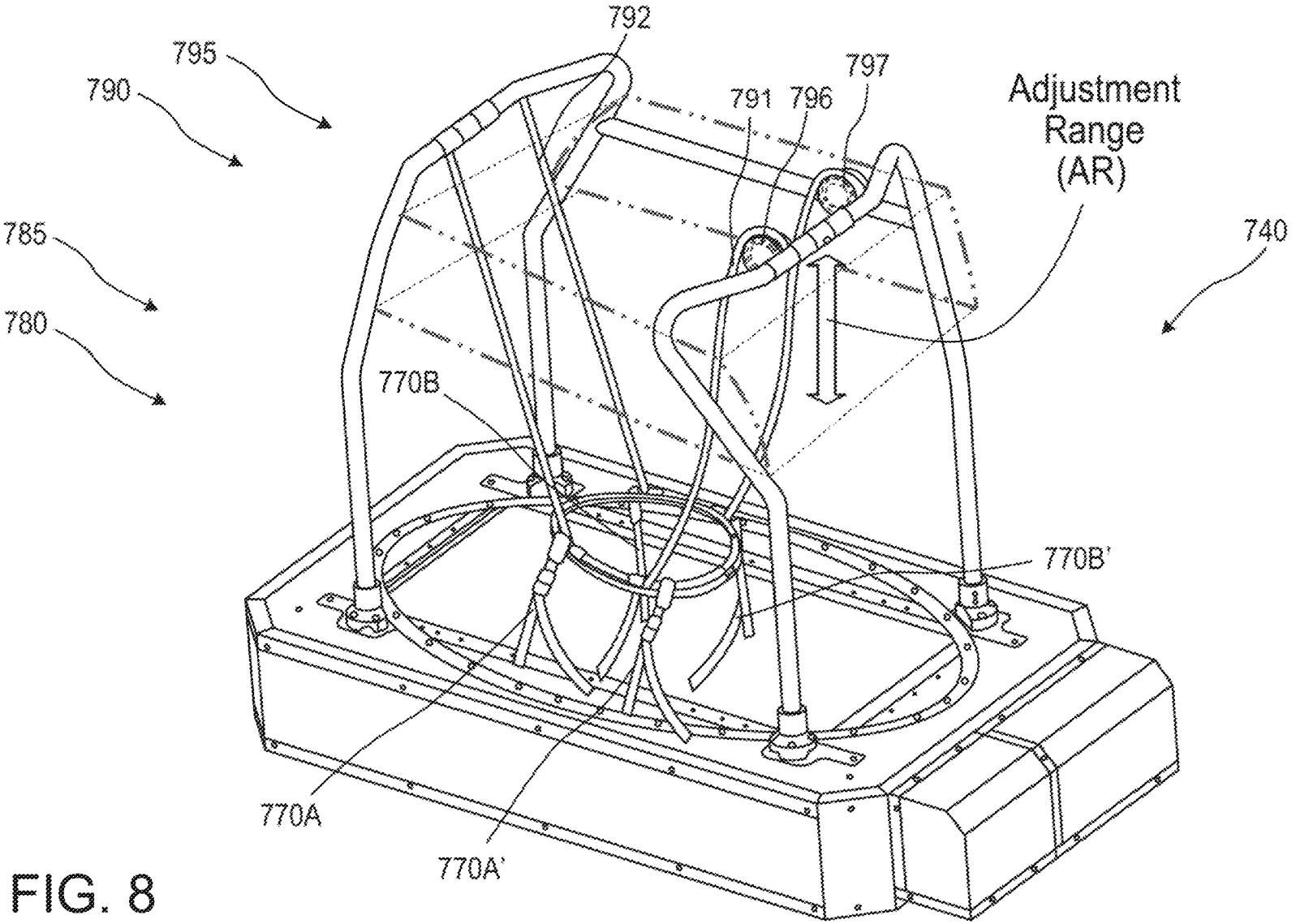
FIG. 8 is a front perspective view of an example DAP System corresponding with FIGS. 7A to 7C and illustrating use of lifts for initial set up and height adjustment.

Referring now to FIGS. 1B and 1C, a conventional differential air pressure (DAP) system 11 is shown in FIG. 1B, which corresponds with FIG. 8 of U.S. Patent Publication No. 2020/0221975 to Basta et al. (DAP '975). The DAP '975 system 11' includes a pressure chamber 10', an exercise device (not shown) located within the chamber, and a frame 20' having a plurality of connecting bars or rails including a base 21' arranged as a system platform and a rigid front cover 23'. Inner lower edges (not shown) of the pressure chamber 10' are attached to platform or base 21' via a sealed connection. In addition, the pressure chamber 10 is attached to bars, rails, and other frame components around the perimeter of the chamber at varying heights above the attachment to the platform or base attachment via mounts, connectors and/or interference/contact connections. The conventional DAP system 11 can apply upweighting forces to the user as shown in FIGS. 1B & 1C along with exerting considerable forces against the frame 20' and rigid front cover 23', which applies constant counteracting forces during use to restrain the upweighting forces and forces applied in other directions including laterally, forward, and rearward based on internal pressures acting against the significant surface areas of the enclosure. The DAP system 11' includes a rigid horizontal height bar and user interface 5' that is movably adjustable up and down within a vertical support structure portion of the frame 20' for preventing upward encroachment of the inflated enclosure against the user, and for applying increasing downward force against upper portions of the enclosure at lower height settings. As can be seen in FIG. 1B, significant outward bulging of the enclosure occurs in almost all directions including bulging around the combination bar and user interface 5' where it interfaces with the inflated enclosure.

Figure 1D:
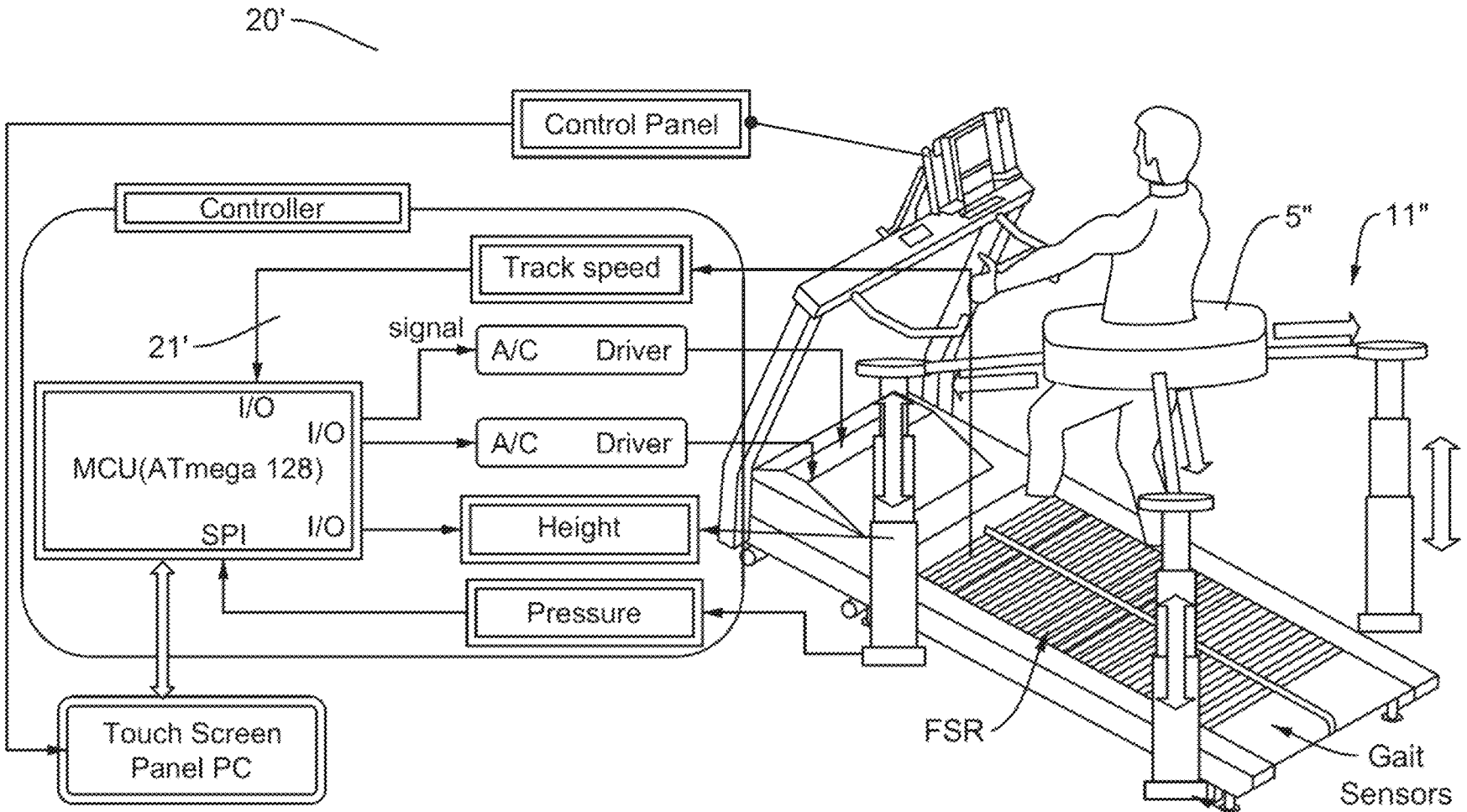
FIG. 1D shows a schematic perspective view of another PRIOR ART unweighting exercise device, which provides unweighting via pneumatic lift mechanisms and elastic connectors along with gait analysis and related support.

Referring now to FIG. 1D, a conventional exercise lift system 11" is shown in FIG. 1D, which corresponds with FIG. 4 of South Korean Patent Publication No. KR101283250B1 to Jung Ho Chun et al. (Chun). The Chun system 11" includes an exercise device 6" in the form of a treadmill like other conventional DAP system but lacks an inflatable enclosure or pressure chamber. Instead, the Chun system 11'" includes a set of four height sliders 12 spaced apart horizontally around a pelvic air tube 14 configured to be disposed about a user located on the treadmill 6'" with two height sliders on each side of the treadmill. The height sliders 12'" have three height settings that are controlled by a control system 16'", which the user can access via a control panel 18'". An elastic band 20'" at a front portion of the pelvic air tube 14'" connects with the control system 16'", which is configured to detect information regarding the user's gait while walking or running. Various additional sensors are located throughout the system including load cells, speed sensors and pressure sensors. The control system controls the height sliders to raise and lower between the three settings to provide upward unweighting support for the user. The control system targets providing unweighting support around 50% of the user's weight by modifying pressure applied to the height sliders 12'" for raising or lowering the height sliders between the three settings.

Example Inflatable Enclosure/DAP System Having Low Hoop Stress; Customizable/Enhanceable via Restraints Referring now to FIGS. 2A & 2B, a schematic example inflatable lifting enclosure 110 for use with a DAP System 140 is generally shown pertaining to aspects and features for example enclosure arrangements of a DAP system as described with the December 2020 Prov. Appln. As discussed in greater detail in the December 2020 Prov. Appln., aspects and features pertaining to example inflatable enclosures described therein can provide highly effective, low-profile unweighting arrangements for a DAP System 140 and exercise device 160, which when in the inflated condition can offset portions of the user's weight while using the exercise device via access through the enclosure to access region 162 for the exercise device. As discussed in greater detail below, aspects and features of DAP System 140 and Enclosure 110 can be customized and enhanced through the use of restraints as described herein.

Aspects and features pertaining to such inflatable enclosures can be integrated with example DAP system 140 as described in greater detail in the December 2020 Prov. Appln., such that a base 152 of the inflatable enclosure 110 can be readily secured to a base support 146 of the DAP system located above an access region 162 of the exercise device 160. In addition, inflatable enclosure 110 can provide unweighting support and related benefits to the user while overcoming drawbacks, disadvantages, and challenges of conventional DAP systems, as well as provide effective unweighting functionality to users through low-profile configurations, which can greatly enhance overall advantages and benefits for using inflatable enclosure 110 as part of DAP systems beyond avoiding drawbacks and disadvantages of conventional systems. For instance, an inflatable enclosure described herein can be arranged to include a comparatively small, low cross-sectional area, intake port 158 through the base opening 154 for the enclosure, which can further limit or reduce reaction forces applied at the enclosure base 152 that attaches to a base support 146. Further, the availability of a low cross-sectional area intake at the base of the enclosure enhances design flexibility options for the enclosure that can permit the use of custom-designed shapes, sizes, or arrangements of the enclosure for various benefits, such as providing enhanced toe or heel kick space.

Thus, reactionary forces applied to the platform connection via the enclosure base and forces exerted on the enclosure when pressurized based on its volume and related surface area against which pressure is applied can be kept low along with providing other significant benefits, such as low-profile enclosure designs, enhanced safety, and increased design flexibility and customization options. Low profile arrangements can provide for small profile DAP system implementations that allow for greater utilization within facilities, and naturally enhance user freedom of movement, such as related to arm swing and leg kick.

In other words, not only are drawbacks and challenges of conventional DAP systems avoided with respect to reinforcement structures and protective components, but size and overall efficiency of unweighting functionality are enhanced along with various additional benefits as discussed in the December 2020 Prov. Appln. These enhancements and improvements can permit further optimizations and customizations in the absence of significant force-mitigation concerns and limitations, such as a low-profile enclosure having a small attachment size, shape and area at its base permitting the inflatable enclosure 110 to fit within the profile of the corresponding exercise device 160 while inflated and provide intended exercise operations.

Figure 2A:
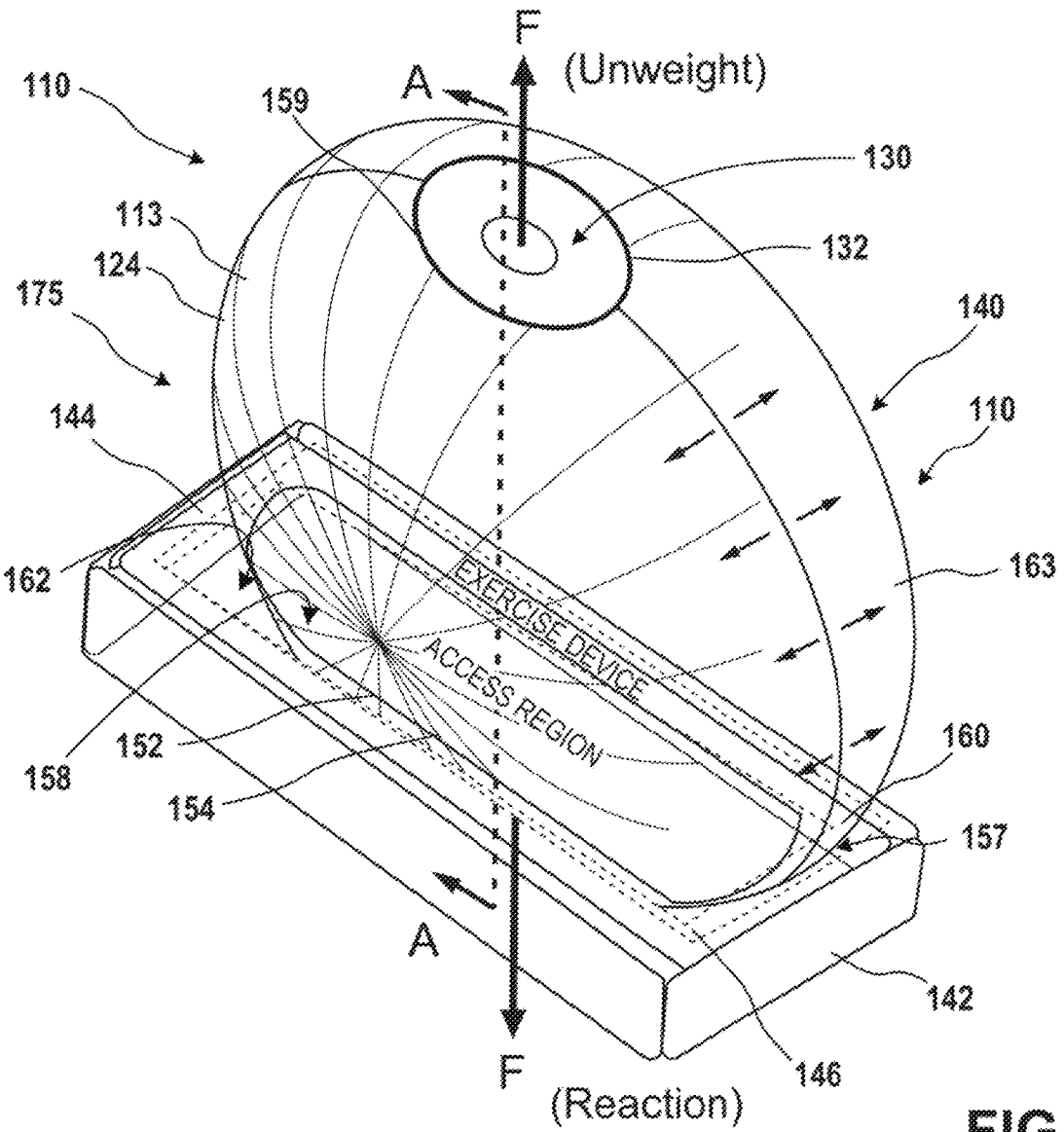
FIG. 2A is a top perspective view of a schematic representation of an independently-supportable inflatable enclosure as part of an example DAP System.
Figure 2C:
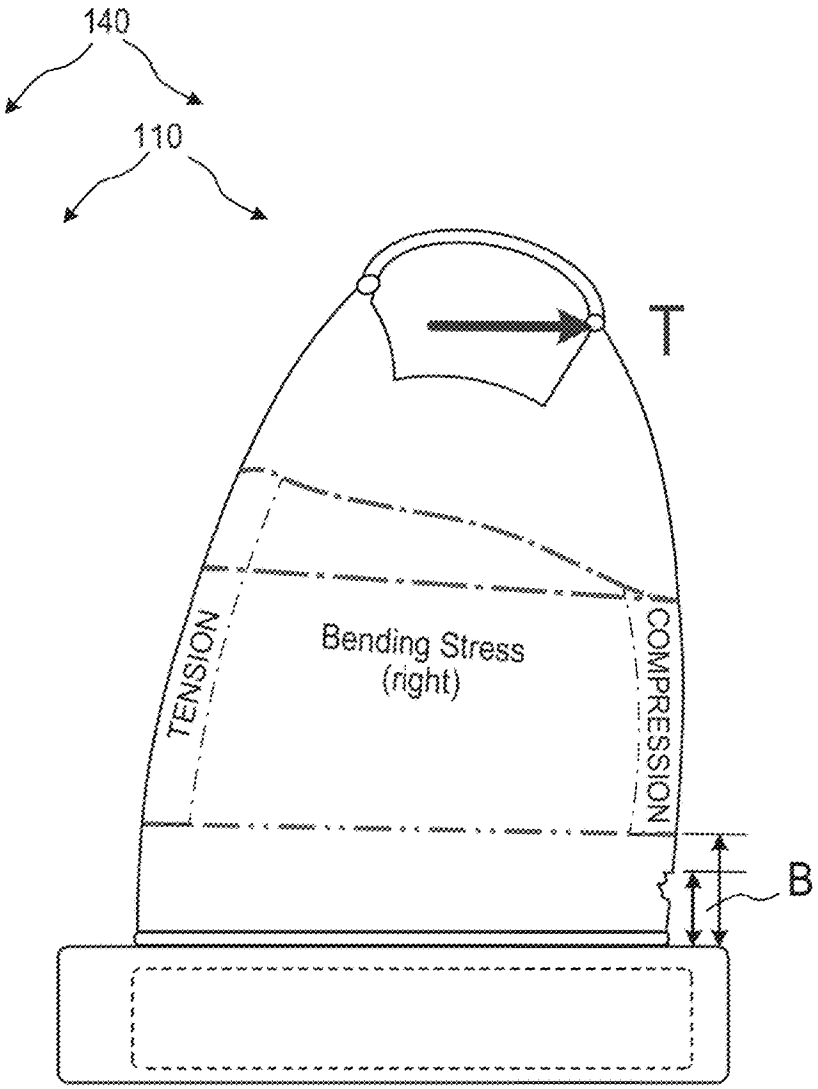
FIG. 2C is a schematic representation of an example buckling failure mode based on modeling data for an inflatable column (right bend direction).
Figure 2B:
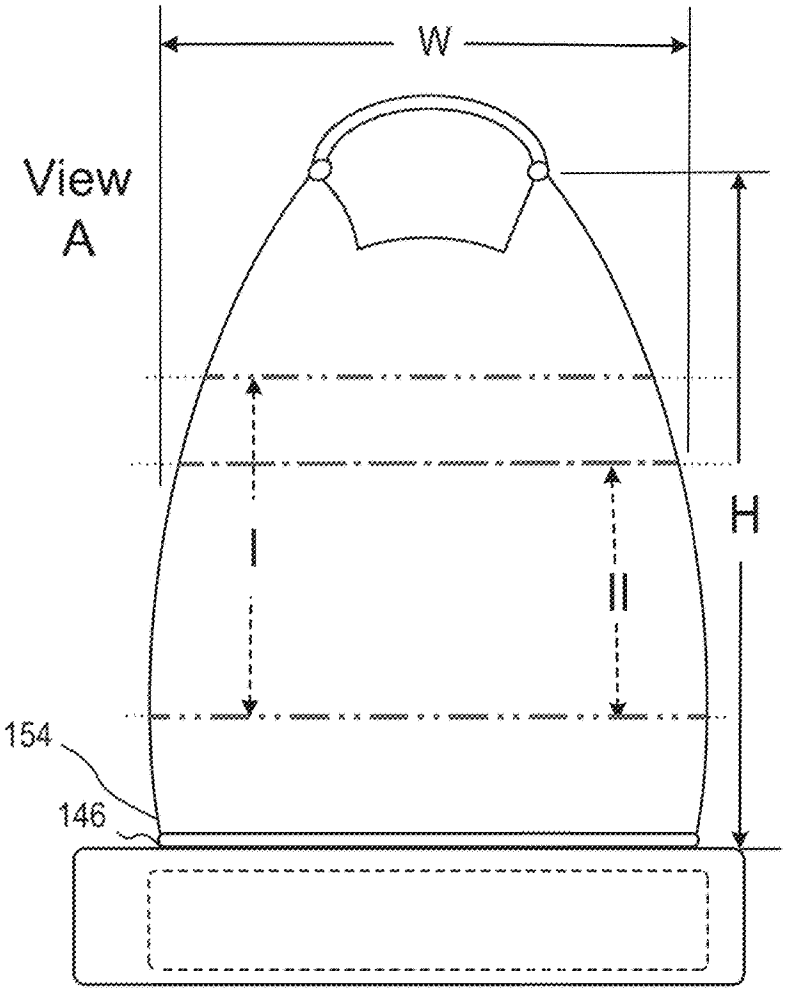
FIG. 2B is a cross-sectional view of the inflatable enclosure and DAP System of FIG. 2A taken along line A-A shown in FIG. 2A.
Figure 2E:
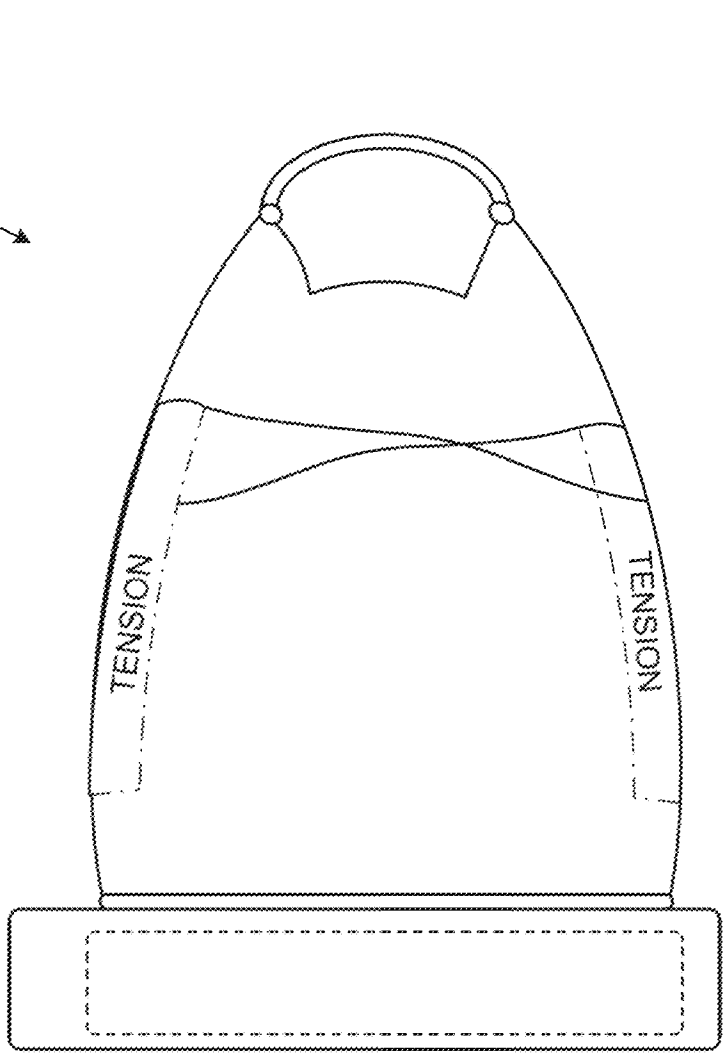
FIG. 2E illustrates bending stress profiles across opposite sides of enclosure 110 with respect to tensile stress components of bending, which can be mitigated and reinforced to resist via attachment of tensile members along portions of the enclosure.
Figure 2D:
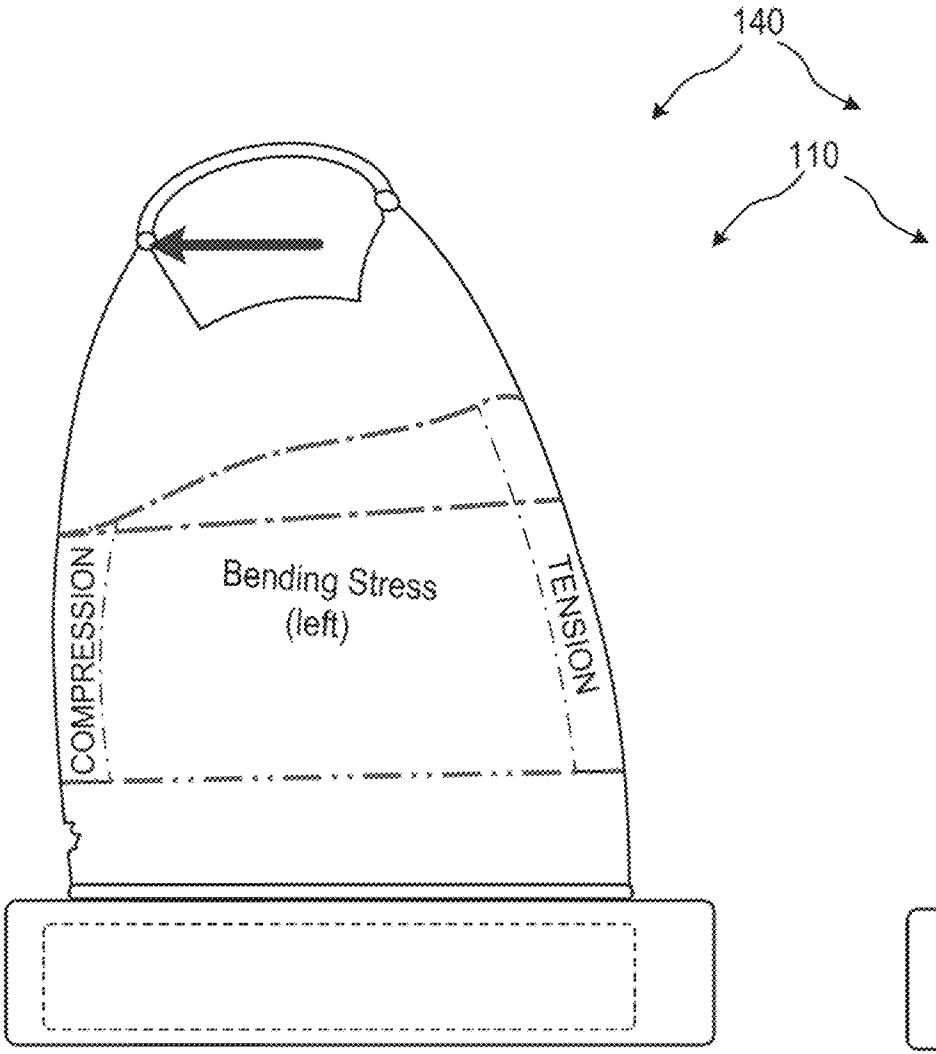
FIG. 2D is a cross-sectional view of the inflatable enclosure and DAP System of FIG. 2A similar to FIGS. 2B & 2C illustrating modeling data for left bending data.

With continued reference to FIGS. 2A & 2B, an inflatable enclosure 110 is generally shown in an inflated condition operating as part of a schematic representation of a DAP system 140. DAP system 140 generally includes a support platform 142 to which a base 152 of inflatable enclosure 110 is securely attached in a sealed or airtight connection with an inflation device (not shown), as well as a generic exercise device 160, which can include a treadmill. Although DAP system 140 is illustrated as having a support platform 142 arranged as a structure enclosing the exercise device 160 and supporting a base connection with the enclosure, it is understood that the enclosure could be attached directly to the exercise device, supported by a skeletal frame or other attachment arrangement without partially or fully enclosing the exercise device, and/or via other frameworks or arrangements that operatively secures a base portion of the inflatable enclosure for unweighting operations of the user for the exercise device while inflated. However, the general arrangement of DAP system 140 shown enables various beneficial features described in the December 2020 Prov. Appln., such as arranging the base portion of the inflatable enclosure vertically over exercise device 160 along with aligning the base portion with an access region 162 for the exercise device that allows a user to access the exercise device and perform exercises via the exercise device.

In addition, as depicted in FIG. 2A the support platform 142 provides a secure support surface 144 closely arranged about the base of the inflatable enclosure 110, which can firmly attach or secure the base of the inflatable enclosure in an airtight connection permitting independent support of the enclosure when inflated as it extends from base 152 upward in a substantially vertical direction for supporting a user above the access region 162 of the exercise device 160. Further, the inflatable enclosure 110 in such an orientation and arrangement operatively supports itself and the user within in a low-profile, space-saving environment about the same size as the profile and environment as for using the exercise device apart from the DAP system 160. When in the inflated condition shown, air pressure acting against the surface of the flexible enclosure skin 113 applies upward unweighting forces on the user and opposite reaction forces against the support platform 142 at the support surface 144, as well as support forces for independently supporting the enclosure in upward orientation are carried within the enclosure skin 113.

As further shown in FIG. 2A, a top port 130 can be formed through a top portion of the inflatable enclosure 110, which as shown can be arranged generally in a vertical alignment with, and above, the exercise device 160 and corresponding access region 162 through an inner space of the inflatable enclosure. A top port frame 132 can be installed proximate and within a perimeter region of top port 130 for securely supporting a user in an airtight, supported arrangement with the inflatable enclosure 110. In addition, top port frame 132 can be formed as a rigid frame that maintains a low surface stress, mechanical equilibrium arrangement of the inflatable enclosure 110. In short, the top port frame 132 can be affixed to top port 130 in an inner, outer, or inner/outer, rigid support arrangement that transmits tensile and compressive forces, and any other stresses and strains encountered in the top portion of the inflatable enclosure proximate the top port frame, which can maintain the mechanical equilibrium arrangement with internal pressure of the enclosure as would be provided in the absence of top port 130 in the inflated condition.

The meridional radial lines 124 shown for the inflatable enclosure 110 are representative to an extent of a surface stress arrangement that can be provided through the enclosure while inflated, for which the top port frame 132 can maintain despite top port 130 interrupting a portion of the enclosure surface by transmitting stresses across the frame. However, the radial lines are shown only for schematic, illustrative purposes without necessarily denoting any tension members, reinforcements integrated in the enclosure surface, embedded fibers, isotensoid supports and the like. Rather, the radial lines are indicative of the innovative, low surface tension arrangement of the inflatable enclosure, which enables many of the numerous beneficial features, improvements, and aspects of inventive subject matter described herein.

Moreover, the radial lines 124 generally represent meridional stress orientations that can be associated with zero or low hoop stress arrangements, such as a low hoop stress dome structure forming an upper dome end 115 of the enclosure or an overall low hoop stress shape. The use of zero or low hoop stress arrangements can enable many and various beneficial features for inflatable enclosures for use with DAP Systems, such as features pertaining to low profile shapes, low and balanced force arrangements, and enhanced freedom of movement for the user internally (lack of leg kick interference) and externally (arm swing clearance).

Flexible Hollow-Shell Support Mechanism; Customizable/Enhanceable via Restraints In the inflated, operational configuration illustrated in FIG. 2A, the example DAP system 140 forms an independently-supportable, hollow-shell support mechanism 175. The hollow-shell support mechanism 175 generally includes: an enclosure 110 formed from a flexible, thin-walled material; a secure airtight base attachment 157 between base opening 154 and support platform 142; top port 130 formed at an upper portion of the enclosure; a top port frame 132 securely attached to the enclosure proximate the top port; and a supportive airtight user-interface 159 connecting the user (not shown) to the top port frame and the enclosure proximate the top port. The secure attachment 157 between the base opening 154 and support platform 142, as well as the attachment between the top port 130 and the top port frame 132, can be configured to transmit lateral enclosure stresses across the respective base opening and top port, such that the enclosure is configured to form a flexible hollow-shell support framework 161 extending vertically from the base attachment 157 at a bottom portion of the enclosure upward to the user-interface 159 at an opposite upper portion of the enclosure.

As discussed in greater detail below, aspects and features discussed herein pertaining to the use of restraints with inflatable enclosures can be used with independently-supportable, partially independently-supportable, and supported enclosures. Further, many beneficial arrangements and uses of restraints with enclosures as described herein can provide support assistance, such that inflatable enclosures can more readily be independently-supportable.

As has been repeatedly discussed and described in detail along with the December 2020 Prov. Appln., the flexible hollow-shell support framework 161 for enclosure 110 can be arranged to provide a substantially balanced, offset-forces 163 arrangement for outboard forces applied against the enclosure in horizontal directions, which can extend across the flexible hollow-shell support framework for the extent of its height. As discussed in the December 2020 Prov. Appln., the flexible hollow-shell support framework 161 can be configured to carry stresses along the hollow-shell or skin 113 of enclosure 110, which can primarily include carrying stresses in its skin or shell from its base attachment 157 up to the top port frame 132 and user-interface 159. Such an arrangement can provide and enable various benefits and beneficial features for use with a DAP system, such as a balanced, stable enclosure configuration, independent support for the user via the enclosure itself without requiring external, rigid supports, and reduced enclosure volumes along with correspondingly reduced force applications and safety concerns. Such benefits can be enhanced through the use of restraints as described below.

Nonetheless, even without high force applications or demands for enhanced safety considerations, and even though the enclosure can independently support itself and the user in a stable inflated arrangement, beneficial features and enhancement functions can be provided for DAP system 140 and enclosure 110 in accordance with aspects, features, and concepts described below pertaining to restrains and lift and/or safety mechanisms. Further, aspects, features and concepts described herein are not limited to DAP system 140 and enclosure 110 and/or similar arrangements and can likewise provide various benefits and enhanced features for conventional DAP systems and enclosures or other DAP arrangements.

Example Restraints Implementations with Hollow-Shell Frameworks

Aspects, features, options, design choices and arrangement considerations pertaining to additional features and mechanisms discussed hereafter can be configured to support, enhance, augment and/or otherwise cooperate with, if not synergistically improve, beneficial features, arrangements and functions enabled or provided via hollow-shell framework enclosures and related examples discussed in the December 2020 Prov. Appl. Thus, it is understood that discussions pertaining to example height adjustment, lifting and safety mechanisms, and/or restraint devices and related concepts described hereafter can be implemented with example DAP systems and related concepts described in the December 2020 Prov. Appln.

Further, significant aspects, features, options, and arrangements discussed hereafter can be configured to cooperate with features and aspects of hollow-shell flexible support arrangements. As such, examples shown and described herein primarily include arrangements that can be incorporated with and/or enhance subject matter pertaining to DAP systems and flexible enclosures related to the December 2020 Prov. Appl. However, it is also understood that many significant aspects and features, options and arrangements discussed hereafter can likewise be configured for beneficial or cooperative use with other types of DAP systems and enclosures including conventional DAP systems, and/or that subject matter described herein can be incorporated in the same without requiring, suggesting or implying that the subject matter of the present application imports or necessarily adds aspects, features, design options and/or other concepts pertaining to the subject matter of the December 2020 Prov. Appln.

Reinforcement and Stabilization of DAP Enclosures via Restraints

Referring now to FIG. 2B along with FIGS. 2C to 2L, cross-sectional view representations of DAP System 140 and inflatable enclosure 110 are shown in FIGS. 2B to 2H & 2K according to Line A-A of FIG. 2A, which is discussed above and described in greater detail in the December 2020 Prov. Appl. DAP System 140 and other example DAP Systems shown herein are illustrated and described for use with an elongated exercise device (primarily a treadmill) that extends a greater distance in a fore-aft direction of the user during use than it does in the widthwise (Left-Right) direction across the user during use of the exercise device. As such, vertical cross-sectional views through the top port 130 can generally represent a vertical cross-section having the largest ratios of height to column width for the inflatable enclosure 110, which can be a worst-case scenario of the enclosure regarding column strength. Evaluation of enclosure 110 according to the corresponding cross-sectional depiction, ratios and other parameters regarding column strength and bending features can provide objective insights, guidance and information regarding potential reinforcement and stabilization of DAP System enclosures, which can improve enclosure performance and encourage, if not enable, the enclosure to be independently supportable.

As discussed in greater detail below along with, for instance, examples shown in FIGS. 3A to 6B, such reinforcement and stabilization features can be implemented through selective attachment of restraints in the form of flexible tensile members to portions of the enclosure including to the seal frame 132. In addition, such restraints or similar restraint arrangements can be configured to provide enclosure height adjustment features in combination with the reinforcement and stabilization features, and/or provide height adjustment features independent of the reinforcement and stabilization features. Height adjustment features are further shown and discussed along with FIGS. 3A to 6B for examples having height adjustment features integrated with reinforcement and stabilization features, and/or configured for independent operation.

With continued reference to FIGS. 2A to 2L, enclosure 110 and other example enclosures described herein can be considered as thin-shelled inflatable columns for computer modeling considerations and corresponding evaluations of stresses and potential failure modes of the inflatable columns. Enclosure 110 and other example enclosures described herein each have a bottom opening 154 secured to a substantially horizontal bottom support 146, which can be considered a boundary condition constraint of the respective inflatable column. Bending and buckling analysis when extended to the point of failure for such thin-shelled inflatable columns can be considered by assuming a surface Traction, T, (FIG. 2B) applied in a perpendicular direction at the top of the column (e.g., applied normal to the top port 130 in the widthwise (Left-Right) direction), such as can be, for example, imparted by a user during use such as via Left-Right sway type movements.

FIGS. 2B to 2E show within lower portions of the inflatable enclosure 110 representations of mathematical functions for bending stresses within left and right lateral walls of the enclosure, which are essentially mirror images of each other if applied in an opposite manner (e.g., left bend vs. right bend). The curves show that high stress functions can approximate profiles of stresses carried within enclosure wall 113 during use of the DAP System 140. FIGS. 2F to 2H, 2K & 2L show potential modifications and improvements of DAP System 140 and enclosure 110 that can be implemented based on stress profiles and related evaluations.

Referring now to FIGS. 2B to 2E, approximate stress profiles for lateral wall portions of enclosure 110 are shown based on characteristics of enclosure 110 (e.g., height and shape profile of the enclosure), which are generally applicable for use of DAP System 140 by persons walking or running at for a wide range of skills and sway variations. The alternating nature of a person walking, and the chiral nature of each person's legs for interacting with the ground and/or for interacting with DAP Systems, as well as the shape and arrangement of enclosure 110 in a longitudinal direction aligned with the user's orientation during use, support evaluations of bending stresses encountered withing the enclosure, such as via FEA or FEM studies, established engineering models, and the like. FIGS. 2B to 2E shown general representations of bending stress profiles for enclosure 110 during user movements such as walking and running movements based on evaluations of thin-shelled inflatable columns having similar boundary condition constraints as enclosure 110 and related arrangements.

Based on the bending stress profiles of FIGS. 2B to 2E, the Applicant determined that high tension stresses occurring within and through the enclosure material or "skin" appear to be the types of failure modes and high stress conditions that can be significantly mitigated by attaching tensile members to the enclosure at locations for anticipated high tensile stresses, such that reinforcing members can share tensile loads and help prevent buckling and high stress conditions. In addition, the Applicant determined that it could be unsafe to pursue height adjustment actions that can apply forces within the enclosure shell in a direction opposite forces applied by inflation (i.e., directly countering inflation flows and directions), because doing so can cause DAP enclosures or similarly-supported enclosures to collapse. However, as exceptions, Applicant identified potentially safe height adjustment options acting contrary to inflation forces that can be implemented, such as height adjustments at a base end of an enclosure in which a short length of column height remains for which it can be safe to collapse. The Applicant further identified the lack of significant stresses being encountered at top portions or top ends of DAP enclosures during lateral bending conditions. As such, in accordance with such stress evaluations, tensile force connections between the seal frame 132 and mid to upper height portions of the DAP enclosure height can help reinforce the DAP enclosure, such as the examples shown in FIGS. 2F to 2H and 2K.

With particular reference to FIGS. 2B & 2C, in accordance with bending stress evaluations for enclosure 110, the Applicant determined that potential buckling can occur at a buckling distance, B, above base opening 154, which was found to be 10% to 20% of a height, H, of the enclosure. More particularly, the Applicant determined that a buckling distance, B, can be about 15% to 17% of the height, which can be rounded to a distance of about 20% of the enclosure height, H. Further, that Range I indicates high tensile stress regions along the height, H, extending from a location just above (excluding) buckling distance, B, upward along the height to a location about 65%-70% of the column height bending in one lateral direction, whereas Range II identified high compression stress along the height, H, of the inflatable enclosure 110 that can occur that can generally occur for matched bending stresses in the opposite lateral direction.

Figures 2F, 2G:
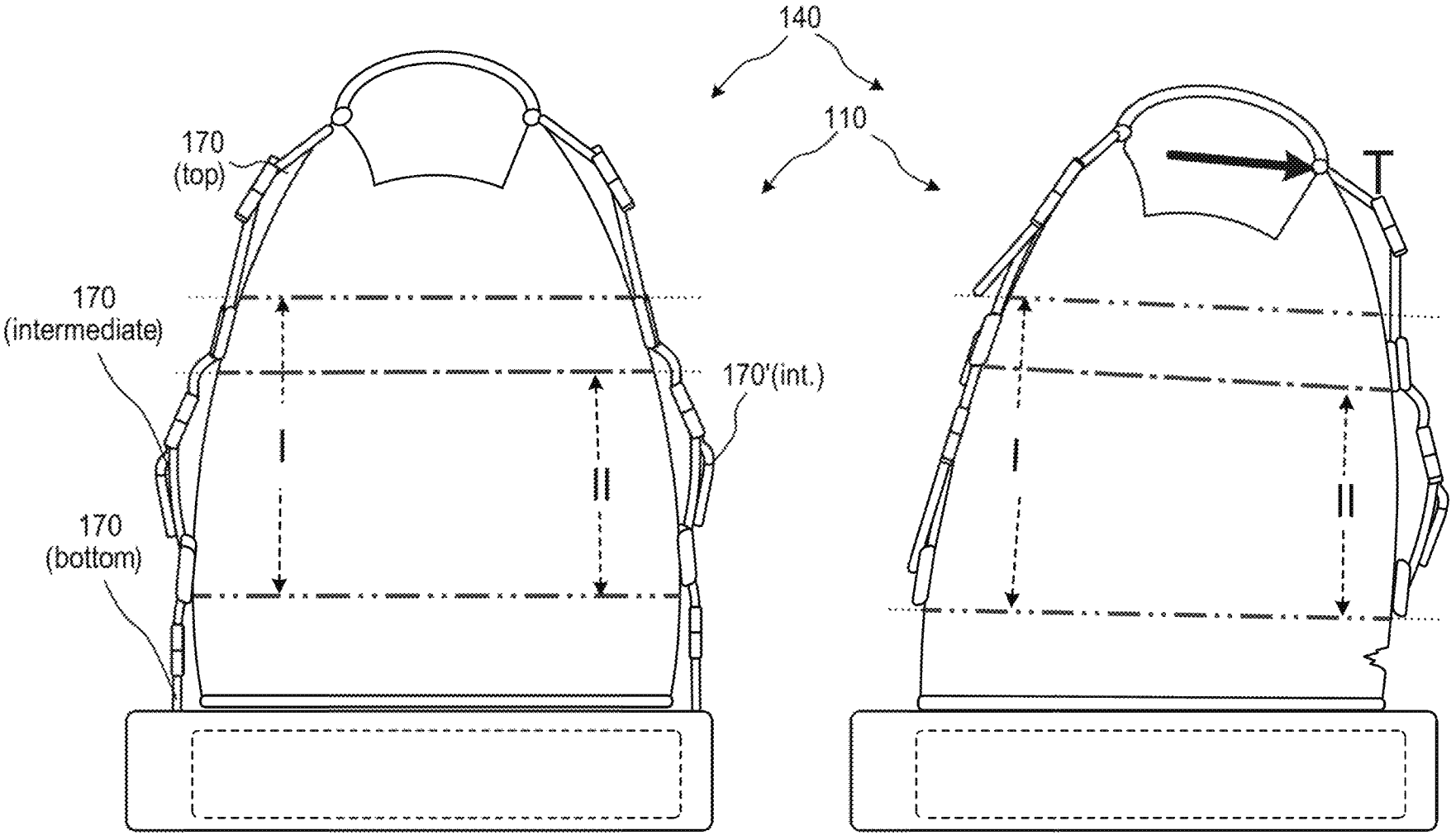
FIGS. 2F, 2G, 2H and 2K are further cross-sectional views of the cross-sectional views of FIGS. 2A to 2E illustrating reinforcing attachments of restraint members that can be used with DAP enclosures as generally discussed herein.

Enclosure 110, and other example enclosures discussed herein and in the December 2020 Prov. Appl., as well as most conventional DAP System inflatable enclosures are arranged to form balanced, force-offsetting enclosures having matching performing characteristics and other parameters on each side of centerline of the enclosure when oriented for use, such as a left vs. right side of the enclosure 110 shown in FIG. 2A on each side of the enclosure seam. As such, each of Range I and Range II apply along each of the Left and Right sides of the cross-sectional shape of FIG. 2B depending on whether bending forces are applied for bending/buckling in the Left vs. Right direction. Thus, restraints 170 in the form of flexible or unidirectional tensile members that can be attached to the enclosure 110 at a first end and to the seal frame 132 or another vertical location at a second end in a generally ascending (vertical) orientation spanning portions of Range I can help the enclosure resist bending in an inboard direction toward the opposite lateral side by reinforces and distributing tensile stresses encountered within the enclosure during periodic bending movements. As shown in FIGS. 2F and 2G, restraints 170 (top) and 170 (intermediate) that extend across portions of Range I and connect vertical locations of the corresponding lateral side of the enclosure with each other and/or with seal frame 132 during inboard bending can cooperate with enclosure 110 to reinforce tensile stresses carried within the corresponding lateral portion of the enclosure.

Properties of thin-shelled inflatable columns with respect to column strength and bending/buckling analysis noted above can apply to example inflatable enclosure 110 and related enclosures discussed herein. Further, these properties can differ for different enclosure arrangements according to factors such as enclosure geometry, air flow properties and static/dynamic characteristics, air pressure, and enclosure material properties such as flexibility, rigidity, permeability, and the like. Further, such principles can differ in accordance with boundary conditions such as venting options, number and/or arrangement of openings, and constraints such as pinned and/or partially pinned parameters such as can be incurred via connections with framework members and/or discrete rigid supports. In addition, properties for range I and range II discussed above can likewise differ for similar reasons.

That said, general principles applicable to thin-shelled inflatable columns can nonetheless apply to inflatable enclosures for DAP Systems having a wide variety of arrangements and properties including both independently-supportable and supported/partially supported inflatable enclosures having one or more connections with rigid support members. Further, such general principles can impact arrangements for reinforcement, height-adjustment, safety and/or other types of devices configured for use with DAP System inflatable enclosures including enhancing functionality and structural integrity. For instance, with respect to column strength and bending/buckling considerations of inflatable enclosures for use with DAP Systems, it is understood that column strength can be enhanced, and resistance for bending and buckling can be improved by improving tensile strength along a vertical portion of the enclosure opposite a bend force and/or by improving compressive strength along a vertical portion of the enclosure aligned with the bend force. However, basic properties of inflatable thin-walled columnar arrangements can limit options for improving compressive strengths, which can degrade structural integrity of the enclosure.

Solutions and improvements for stabilizing and reinforcing enclosures based, at least, on evaluations of bending stresses can include geometric, pressure and/or material (enclosure wall) modifications for example. As discussed in greater detail below along with aspects and preferences of example configurations described herein, supplemental tensile members in the form of restraints 170 can be selectively attached to the enclosure in various example arrangements that can span portions of the enclosure skin, transmit stresses there through in cooperative arrangements with the enclosure, reinforce high stress portion so of the enclosure, and/or enhance capabilities of the enclosure to carry stresses and/or carry upweighting stresses.

With continued reference to FIGS. 2C to 2H, analysis of static and dynamic properties of enclosure 110 under varying loads, pressures, and boundary conditions indicates enclosure 110 is generally configured to experience minimal compression and/or tensile forces proximate seal frame 132 that are significantly related to structural integrity of the enclosure. This appears to be the case even though relatively high tensile stresses can be incurred within the enclosure skin at a distance below the seal frame that it is about 30% of the overall enclosure height (i.e., within upper portions of Range I).

Thus, tensile connections of the seal frame 132 with the enclosure wall at a location below the seal frame can help improve structural integrity and can resist bending along an opposite, lower portion of the enclosure. As shown and described herein along with various example arrangements, balanced pairs of restraints 170 (top) and corresponding attachments with opposite sides of the enclosure 110 can bilaterally enhance column strength and integrity of the enclosure, as well as permit usage of the bilateral seal frame restraints and enclosure connections to enable and provide height adjustability, user customizations regarding features of the seal frame with respect to the enclosure, such as lateral tilt, fore-aft orientation and other preferences. These and other benefits can be provided through different types of restraint connections.

Figure 2H:
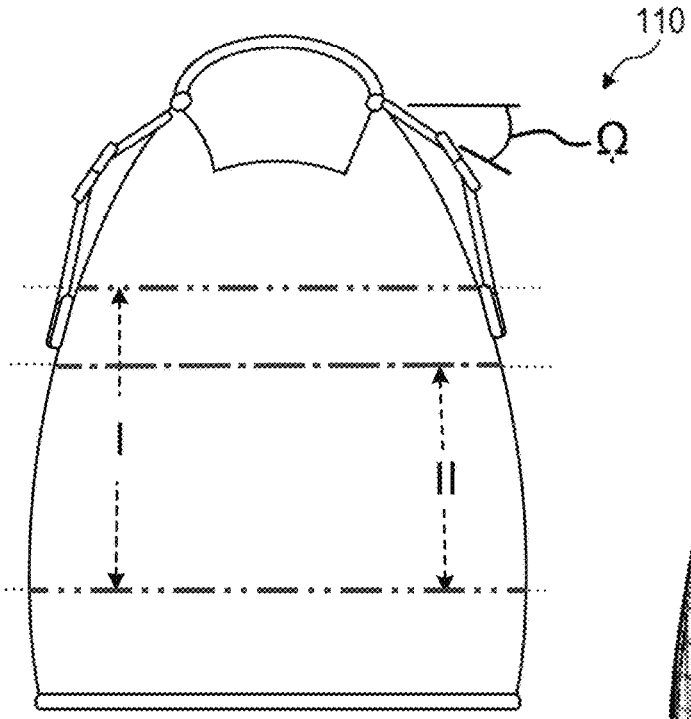
Figure 2J:
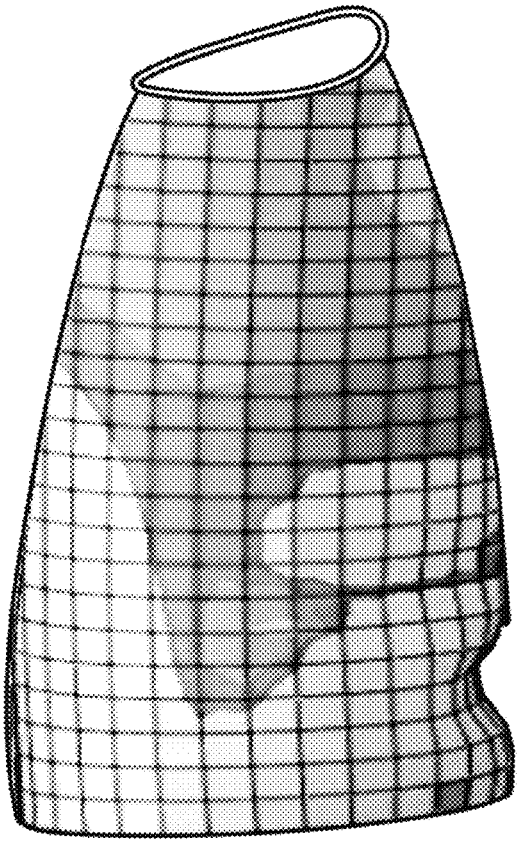
FIG. 2L shows a schematic perspective view bending stress illustration corresponding with the example enclosure of FIG. 2G.
Figure 2K:
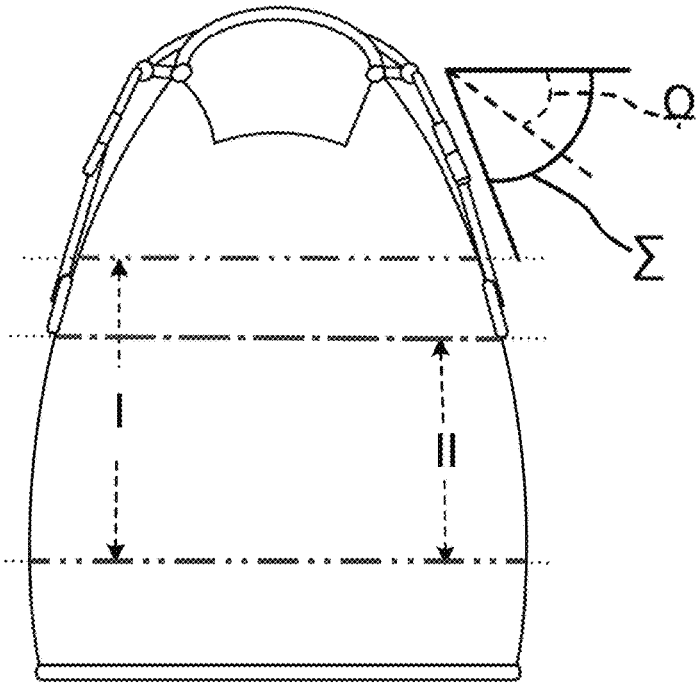
Figure 2L:
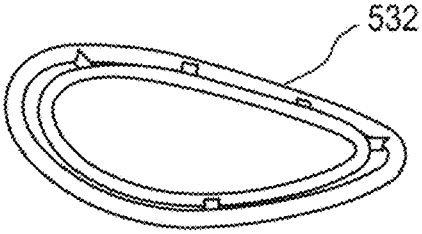

Top Restraints: For example, as shown in FIGS. 2F to 2H, top oriented and connected restraints 170 (top) in the form of flexible tensile members (e.g.,) straps can extend from a first enclosure attachment at an intermediate height location to a second enclosure attachment proximate the seal frame 132 (or to the seal frame itself), which can be configured to share the load carried within the enclosure wall, locally reinforce the enclosure, and provide benefits based on their arrangement and characteristics along with aspects and features of the enclosure described in more detail below. The first height location for attachment of the first end of restraints 170 (top) can be attached to the enclosure wall at an enclosure height disposed within a top portion of Range I and potentially above Range II, which can thereby attach the first end of restraint 170 (top) to the enclosure skin at a location that can enhance column strength along with reinforcing the secure attachment of the seal frame with the enclosure.

Intermediate restraints: Further, intermediate restraints 170 (intermediate) can optionally be used, for example, for stabilization and reinforcement purposes including having vertically-directed arrangements extending between a first end and an opposite second end of each intermediate restraint attached to the enclosure wall at intermediate height locations, which can be selectively attached and arranged for providing various beneficial features, such as bolstering or enhancing tensile strength of the enclosure wall in a vertical direction located on an opposite side of the enclosure for resisting high stresses during use. In some arrangements, a first end of an intermediate restraint 170 (intermediate) can be attached to the enclosure wall at a lower portion of Range I and a second end of the restraint can be attached to the enclosure wall at a location within an upper portion of Range I and can further be attached above Range II for avoiding attaching to the enclosure wall at a location that can encounter high stresses. Accordingly, intermediate restraints 170 (intermediate) can include ascending orientations that substantially span Range I. Further, intermediate restraints can be configured to share the load carried within the enclosure wall, locally reinforce the enclosure, and provide benefits based on their arrangement and characteristics along with aspects and features of the enclosure described in more detail below. Further, intermediate restraint 170 (intermediate) can be employed effectively for beneficial purposes as part of reinforcement, stabilization, and/or height adjustment mechanisms as described along with aspects and features of example DAP Systems described hereafter. Intermediate restraints may also be reinforcement patches that thicken and reinforce the strength of the enclosure in the vicinity of attachment of the lower end of the height adjustment restraint.

Bottom restraints: Further, tensile member arrangements having one or more straps each connected at a first end to an intermediate height location along the enclosure and at a second end connected to the base support 146, such as restraints 170 (bottom) can be effectively employed for configurations of height adjustment systems configured for height adjustment via collapsing a bottom portion of the enclosure wall as discussed in greater detail below. Thus, principles, aspects and features related to thin-shelled inflatable columns including column strength and resistance to bending and buckling, as well as principles, aspects and features related to arrangements of tensile members attached to portions of inflatable enclosures of DAP Systems can be incorporated as improvements of DAP Systems, as well as learnings applied regarding supplemental enclosure devices and mechanisms in accordance with aspect and features of example DAP Systems described herein including example discussed in greater detail below. These principles, aspect and features including related reinforcement, stabilization and/or height adjustment devices, mechanisms and systems that can apply to independently supportable inflatable enclosures including inflatable enclosure 110, inflatable enclosures described in the December 2020 Prov. Appl., and to other example arrangements described and shown herein, and also to supported inflatable enclosures having connections with one or more rigid support structures or a rigid support framework.

In addition, as further discussed along with examples shown and described herein, bilateral restraint connections with the seal frame 132, such as via restraint 170 (top), can help support and retain the seal frame 132 at a desired position and orientation for a user along with maintaining the seal frame in a 'floating' arrangement at a top portion of the enclosure that permits freedom of movement by the user similar to natural movements while exercising, such as while walking or jogging on a treadmill. In contrast, conventional DAP Systems and enclosures typically include rigid structural connections for a seal frame or similar user support interface, which inhibit natural movement variations of the user and interfere with permitting the seal frame to float on top of the enclosure.

Height Adjustment Restraints: Restraints can further cooperate with enclosure 110 and principles of operation of DAP Systems to further provide height adjustment functionality while maintaining structural support capabilities of the enclosure. Differential Air Pressure systems generally apply an upward 'upweighting' force to the user via the seal frame and user interface that is transmitted as tensile stresses through the thin shell forming the enclosure, which can be approximated as the vertical cross-sectional area of the enclosure above a support/attachment multiplied by the gage or relative pressure (differential pressure with respect to atmospheric pressure) within the enclosure. The structural integrity and stability of the enclosure relies in large part on the enclosure being inflated and pressurized even at a low pressure to maintain a pressure differential within the enclosure with respect to atmospheric pressure. As such, reinforcement, stabilization, and/or height adjustment mechanisms and the like that apply downward tensile forces from the seal frame 132 of inflatable enclosure 110 to the base support secure attachment can directly diminish the net upward forces transmitted through the enclosure thin shell, and thereby reduce structural integrity of enclosure.

Likewise, such mechanisms that can apply tensile forces from an attachment to the enclosure at an intermediate height location above the base opening 154 downward to the base support secure attachment can directly diminish net upward forces transmitted through the enclosure to the intermediate height attachment and thereby reduce structural integrity of the enclosure below the intermediate height attachment. Stated differently, if upward tensile forces carried through the enclosure wall from the base support 146 to the seal frame 132 are directly opposed by downward tensile forces applied to the seal frame 132 via an independent connection to the base support, such as via straps extending from the base support to the seal frame, the opposing downward forces can counteract stresses carried through the enclosure wall, such that, at an extreme, net stresses carried through the enclosure can go to zero and the enclosure can collapse.

Accordingly, it can be beneficial to avoid the application of downward tensile forces to the seal frame or an intermediate height location of the enclosure 110 applied from a connection with the base support or other support outside of connections with the enclosure or arrangements that can interfere with functionality of the enclosure for carrying stresses along its flexible material shell, such as via a restraint 170 or other tensile member connected to the base support. However, consistent with FIG. 2A and identification of a particular failure location and/or induced failure location, an options for providing height adjustability for enclosure 110 can include selectively collapsing one or more discrete sections of the enclosure, such as at a base end of enclosure 110 across distance B, which would avoid impairing structural integrity of the enclosure wall beyond a base portion that can be collapsed and retained securely attached to the base support, for which related examples are discussed herein.

Height Adjustment: Independent and/or Integrated W/Reinforcement/Stabilization

Figure 3A:
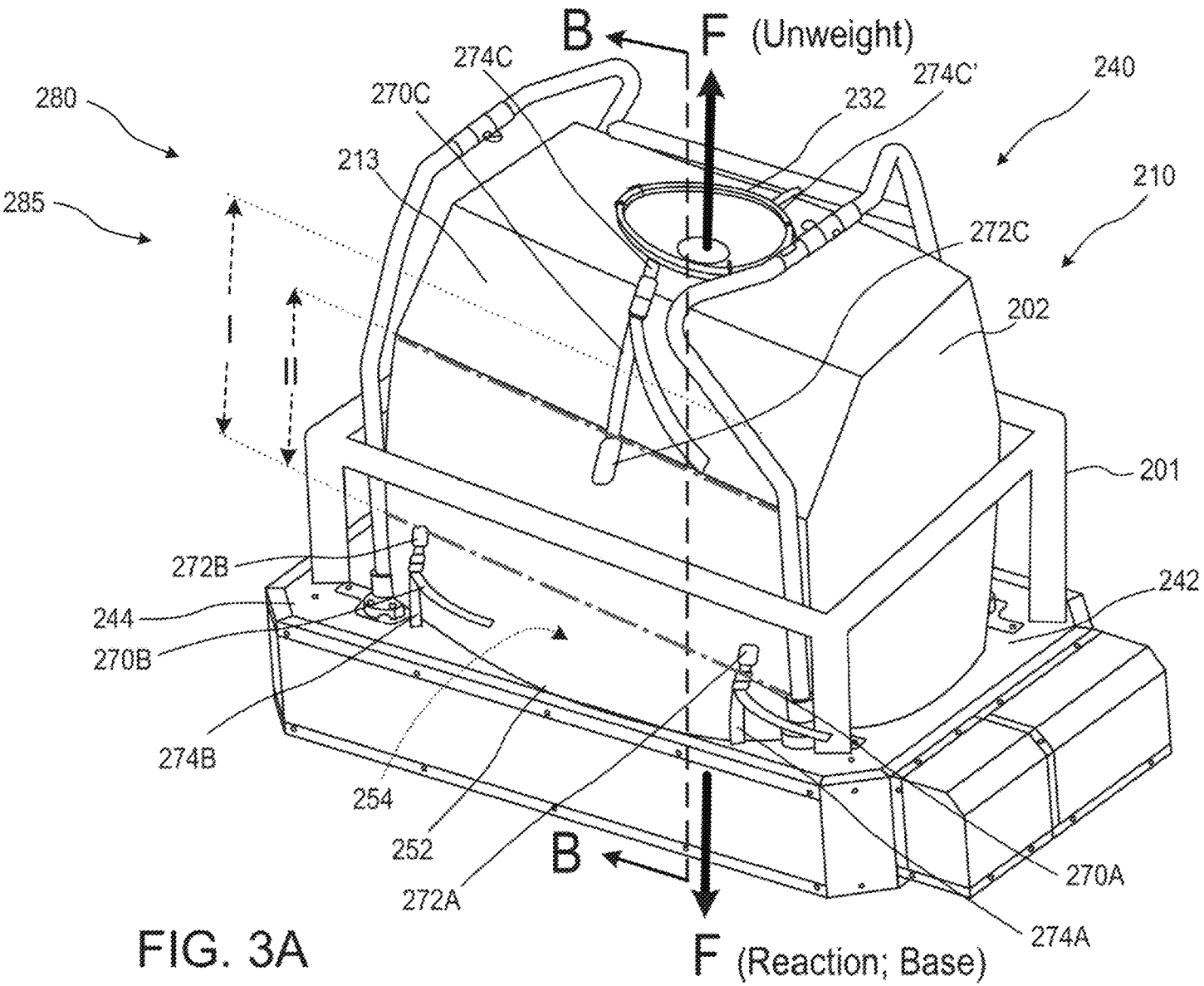
FIG. 3A is a top perspective view of a schematic representation of a supported inflatable enclosure as part of an example DAP System having a height adjustment system and seal frame reinforcement system according to aspects and features of subject matter discussed herein.
Figure 3B:
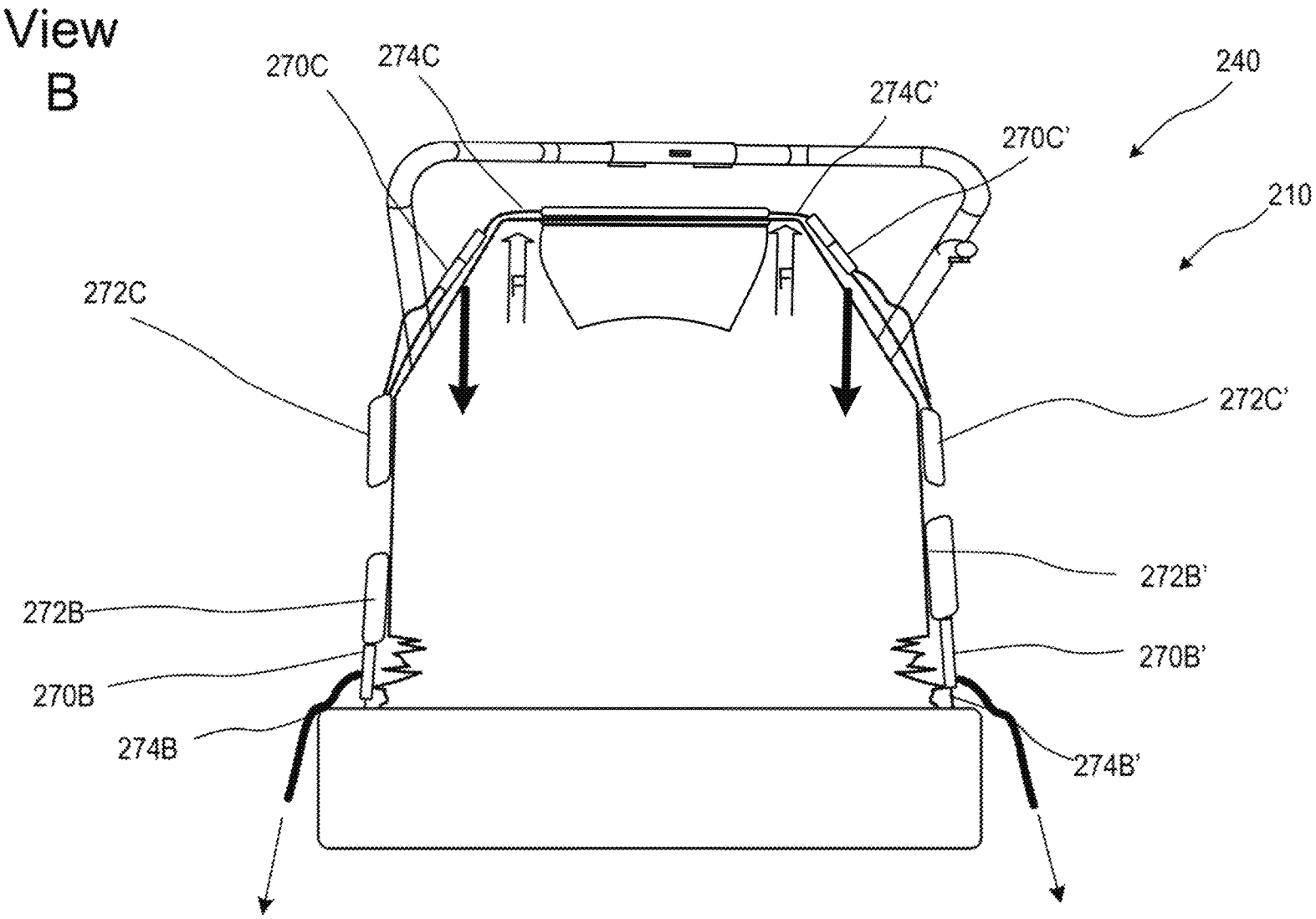
FIG. 3B is a cross-sectional view of the inflatable enclosure and DAP System of FIG. 3A (support omitted) as taken along line B-B of FIG. 3A.

Referring now to FIGS. 3A and 3B, an example DAP system 240 having a supported enclosure 210 is generally shown including a support platform 242, an inflatable enclosure 210 secured to a top support surface of the support platform, and an external rigid support framework 201 attached to the support platform 242 and extending about a perimeter portion of the inflatable enclosure. DAP System 240 and inflatable enclosure 210 generally include similar aspects and features as example DAP Systems and enclosures described herein except as discussed hereafter and with respect to frameless, independently-supportable enclosures as described in greater detail above and along with the December 2020 Prov. Appl.

The external support framework 201 includes a rigid, generally horizontal top rail that is vertically disposed at about half the height of enclosure 210 when in the inflated condition and extends around the perimeter of the inflatable enclosure, such that the framework substantially forms a fence-like retainer around the enclosure that limits excessive lateral expansion of the enclosure via contact or interference without requiring attachments or securement connections between the framework and enclosure. Such an arrangement can provide benefits that can be available for independently supportable enclosure arrangements, such as allowing greater user freedom of movement and eliminating usage of complex mechanical support, retention and/or adjustment equipment and devices that are typically required for conventional, reinforced DAP Systems.

As shown in FIG. 3A, an upper portion of the inflatable enclosure 210 defines a tapered enclosure top 202 forming a barn-type roof shape having a wide central ridge oriented in the fore-aft direction, which can reduce volume of the enclosure compared with a substantially constant vertical cross-sectional arrangement typically occurring in conventional DAP Systems, such as the generally rectangular profiles shown in FIGS. 1A-1C, and can also reduce the overall forces applied to enclosure based on reduced upward cross-sectional area. The tapered enclosure top 202 can be defined via a plurality of elongate internal, external, and/or embedded frame elements (not shown), such as metal or fiberglass rods attached to sheet material that forms the enclosure. The arrangement of frame elements can attach to each other and/or be affixed to the enclosure fabric via sewn-in attachment, geometric retainers such as threaded within sleeves or other fitment structures (not shown), and/or via supplemental attachments (e.g., clamped, or other secure connections).

Modification of the enclosure top from a rectangular shape to the tapered enclosure top 202 can reduce overall forces applied to the structure and can provide a generally balanced Left-Right enclosure arrangement as it extends in a longitudinal direction parallel with the top ridge. Such changes to the column top can also improve column strength by reducing the likelihood of bending or buckling during use. Accordingly, the arrangement of enclosure 210 including having the tapered enclosure top 202 can permit enclosure 210 to readily extend upward from its attachment with the base support along with reducing needs for reinforcement from a rigid support structure, such as secure attachments or rigid connections to framework or support members. Thus, enclosure 210 and DAP System 240 can generally be configured as a partially-rigid framework-supported inflatable enclosure, which has a support connection in the form of a rigid support structure 'cage' that can prevent significant bending or bucking of the inflatable enclosure as necessary without requiring a rigid connection between the top frame 252 disposed about the user and/or another rigid connection between an upper portion of the enclosure and a rigid support structure.

Such an arrangement that can be at least partially independently-supportable via the lack of a rigid connection of the enclosure during use and, even more so for lacking rigid connections with the seal frame 232. Rather, seal frame 232 forms bilateral, flexible support connections with opposing portions of the enclosure skin 213, which is enabled by the tapered shape of the enclosure top portion. In particular, DAP System 240 includes a stabilization system 285 for stabilizing and reinforcing the arrangement of the enclosure 210 with respect to the seal frame 232 during use, as well as enhancing functionality of the seal frame and enclosure with respect to each other. In particular, stabilization system 285 includes a pair of opposed restraints 270C and 270C' attached to opposite lateral side portions of the seal frame that can securely retain the seal frame via angled downward flexible tensile restraints extending away from the seal frame while permitting sufficient flexibility via the flexible restraints allowing the seal frame 232 to float on the enclosure 210 and permit natural user movement variations. In addition, opposite first ends 272C of the pair of restraints are each securely attached to enclosure skin at locations within Ranges I and II, and by forming an attachment with the enclosure along a face oriented close to ninety degrees or perpendicular with respect to a horizontal orientation of the seal frame 232.

With continuing reference to FIGS. 3A and 3B, DAP System 240 further includes a height adjustment mechanism 280 configured as a manual mechanism including a plurality of adjustment restraints 270A, 270B, 270A' and 270B', such that at least one adjustment restraint is located at each corner of the system platform 242 and integrated with the secure, airtight connection between enclosure 210 and system platform. Each adjustment restraint can be configured as a manual mechanism for restraining movement of a portion of enclosure 210 or other related portion of the DAP System contrary to or against an applied DAP force or bias, in which each adjuster can act flexible tensile member similar to arrangements and functionalities of lift restraints 170 and 270 discussed above and/or hereafter. In some arrangements, adjustment restraints 270A, B, A' and B' can be preset to a particular height-related setting for a user prior to inflation or before performing actions for actuating or setting up the enclosure for use, such as permitting bias, air pressure or other actuation actions to occur that can lock height settings for the enclosure. In the alternative, adjustment restraints 270A, B, A', and/or B' can configured for on-demand or as-needed height adjustment, such that one or more, adjustment restraints can be configured to require manual application of force for modifying structural relationships that can impact enclosure height settings. For example, as illustrated in FIG. 3B, each adjustment restrain can include a ratchet-type, cinch-type or other type high-stress tensile strap configured to permit adjustment of strap length while under tension, such as while enclosure 210 is inflated.

Adjustment restraints 270A, B, A' and B' can be configured to collapse a portion of the enclosure base downward while inflated in order to modify its height. As such, a first end 272A, B, A' & B' of each adjustment restraint can be attached to the enclosure skin 213 at corner portions of the platform as shown in FIGS. 3A & 3B and at an offset height, such as height B of FIG. 2C related to a buckling location or a slightly greater height, such as about 20% of an overall height of the enclosure. Thus, as can be seen in the cross-sectional view of FIG. 3B, adjustment mechanism 280 can be activated including modifying each of the adjustment restraints for collapsing enclosure 210 and thereby implement a reduced height for the enclosure.

Figure 4A:
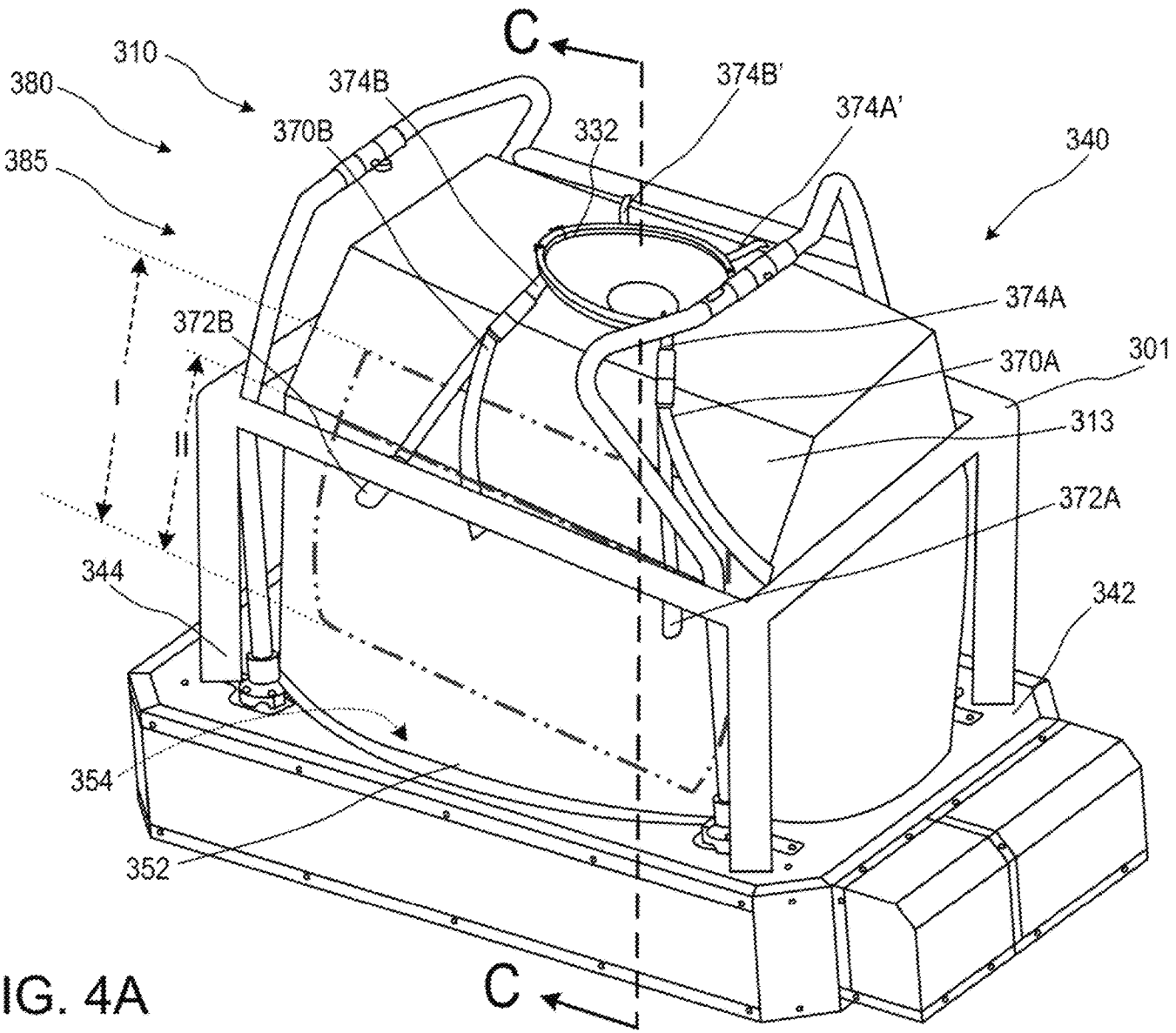
FIG. 4A is a top perspective view of a schematic representation of a supported inflatable enclosure as part of an example DAP System having a combined height adjustment and seal frame reinforcement system according to concepts discussed herein.
Figure 4B:
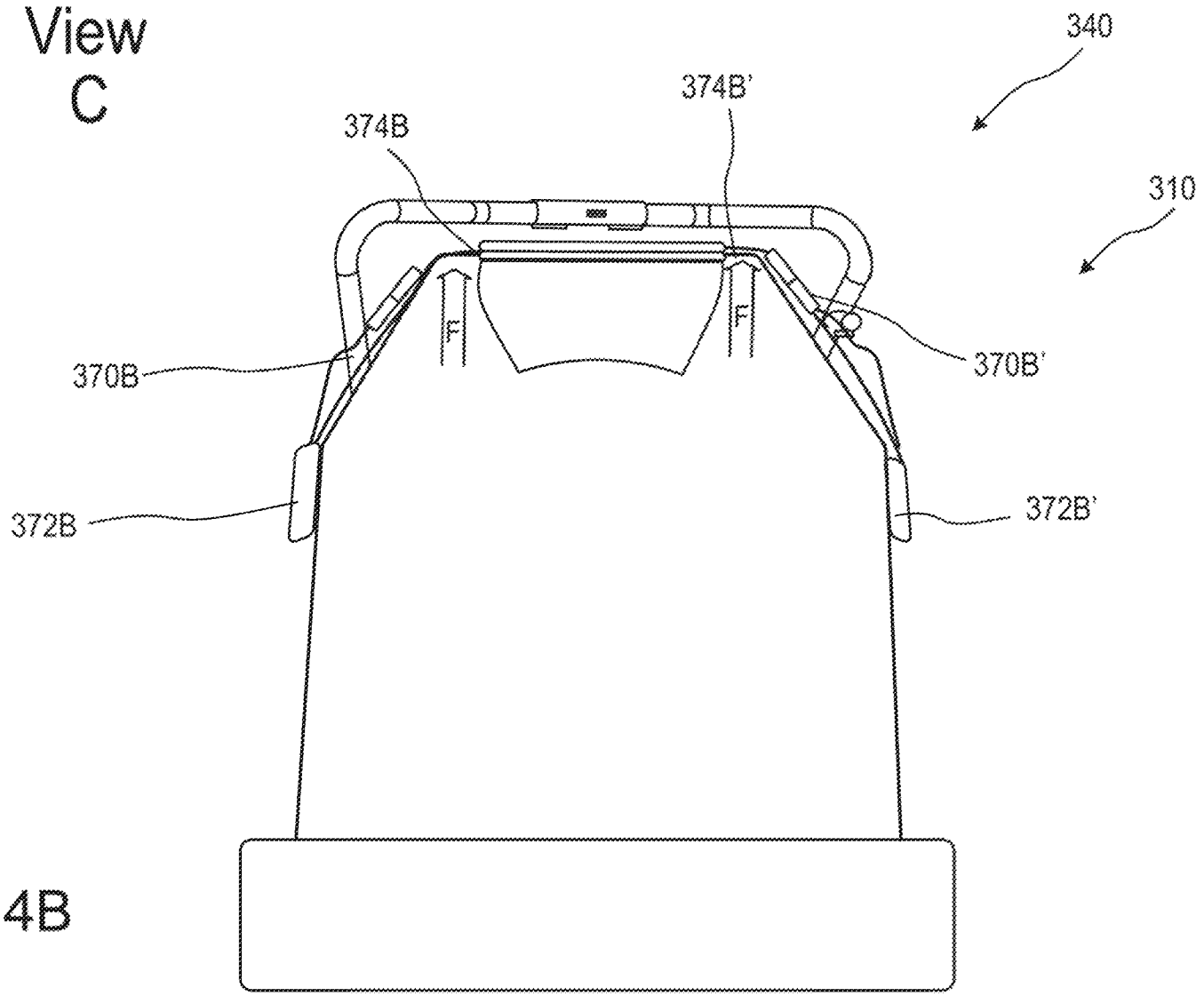
FIG. 4B is a cross-sectional view of the inflatable enclosure and DAP System of FIG. 4A (support omitted) as taken along line C-C shown in FIG. 4A.

Referring now to FIGS. 4A and 4B, an example DAP system 340 having a support enclosure 310 is generally shown including a support platform 342, an inflatable enclosure 310 secured to a top support surface of the support platform, and an external rigid support framework 301 attached to the support platform 342 and extending about a perimeter portion of the inflatable enclosure. DAP System 340 and inflatable enclosure 230 generally include similar aspects and features as example DAP Systems and enclosures described herein except as discussed hereafter and except with respect to a frameless, independently-supportable enclosures as described in greater detail above and along with the December 2020 Prov. Appl., and with respect to a height adjustment mechanism integrated with reinforcement/stabilization mechanisms.

The external support framework 301 includes a rigid, generally horizontal top rail that is vertically disposed at about half the height of enclosure 310 when in the inflated condition and extends around the perimeter of the inflatable enclosure, such that the framework substantially forms a fence-like retainer around the enclosure that limits excessive lateral expansion of the enclosure via contact or interference without requiring attachments or securement connections between the framework and enclosure. Such an arrangement can provide benefits that can be available for independently supportable enclosure arrangements, such as allow greater user freedom of movement and elimination of complex mechanical support, retention and/or adjustment devices that are typically required for conventional, reinforced DAP Systems.

As shown in FIG. 4A, an upper portion of the inflatable enclosure 310 defines a tapered enclosure top 302 forming a barn-type roof shape having a wide central ridge oriented in the fore-aft direction, which significantly reduces the inflatable volume of the enclosure compared with a conventional DAP Systems that maintains a generally rectangular shaped enclosure, such as DAP Systems shown and discussed along with FIGS. 1A-1C. The reduced volume of the DAP System 340 shown in FIG. 4A would likely require and apply lower air volumes at a lower gage pressure within the enclosure vs. its conventional arrangement, such that the DAP System generates, receives, and transmits much less force compared without an unmodified or conventional DAP System. Modification of the enclosure top from a rectangular shape to the tapered enclosure top 302 reduces the forces applied to the structure, such that it can provide a generally balanced Left-Right enclosure arrangement as it extends in a longitudinal direction parallel with the top ridge. Accordingly, the arrangement of enclosure 310 including having the tapered enclosure top 302 can permit enclosure 310 to independently extend upward from its attachment with the base support along with reduced needs for reinforcement from a rigid support structure, such as secure attachments or rigid connections to external or internal frameworks or support members.

Further, DAP System 340 benefits from principles pertaining to a robust stabilization system that is described herein along with various examples. DAP Stabilization System 385 as described herein can stabilize and reinforce the arrangement of the enclosure 310 with respect to the seal frame 332 during use, and further enhance functionality of the seal frame and enclosure with respect to each other. In particular, stabilization system 385 as shown in FIGS. 4A and 48 includes two pairs of opposed restraints 370A and 370A' that are each attached to opposite lateral side portions of the seal frame 382 and help securely retain the seal frame with enclosure 310 via angled downward flexible tensile restraints extending away from the seal frame while also permitting movement flexibility for the top enclosure 382. This reinforcement functionality along with flexibility provided by the restraints configured as flexible straps allow the seal frame 332 to "float" on the enclosure 310 such that the seal frame can move and be responsive to natural movements while also being closely controlled to remain within a desired optimal range of locations for structural support and integrity purposes.

In comparison with stabilization system 285 of FIGS. 3A and 3B, the two-pair; four-strap restraints 370 of FIGS. 4A and 4B have two pairs of restraints 370A,A' and 370B,B' extending radially from the seal frame 332 in a substantially spoke-like manner (i.e., two restraints extending laterally away from the user on one side while other two extend away in an opposite lateral direction; two each also extend generally forward and two each extend generally aft). This 'spoke-like arrangement has been shown to provide enhanced levels of stabilization, reinforcement and support compared with other arrangements. However, it is understood that other arrangements can also be desired and provide enhanced levels of stabilization, reinforcement and/or support. In addition, opposite first ends 372C of the pair of restraints are each securely attached to enclosure skin at locations within Ranges I and II of the tapered 'barn-roof' type shape and thus each forms a secure attachment with the enclosure along a face oriented close to ninety degrees or generally perpendicular with respect to a horizontal orientation of the seal frame 432.

Further, the four-restraint top-bracket configuration shown in FIG. 4A has been shown to provide an effective arrangement for adjusting the height of enclosure 310 and seal frame 332, as well as for reinforcing and stabilizing the enclosure 310. Such an arrangement allows the enclosure height to be reduced from its maximum height downward based on a length of each restraint 370A,B,A'&B' being reduced by the user, which acts to limit the distance seal frame 332 can extend above a height of the first attachments 372A,B,A'&B'. Four-restraint connections of the type shown in FIG. 4A and similar have been shown to provide effective mechanisms for adjusting height of the enclosure in an independent manner, such that connections with external structures or frameworks can be avoided. The height adjustment mechanism 385 generally reduces enclosure height by selectively collapsing upper portions of the enclosure according to factors such as number of restraints, arrangement of restraints including orientation and locations of first attachments, and aspects and features of the enclosure.

Figure 5A:
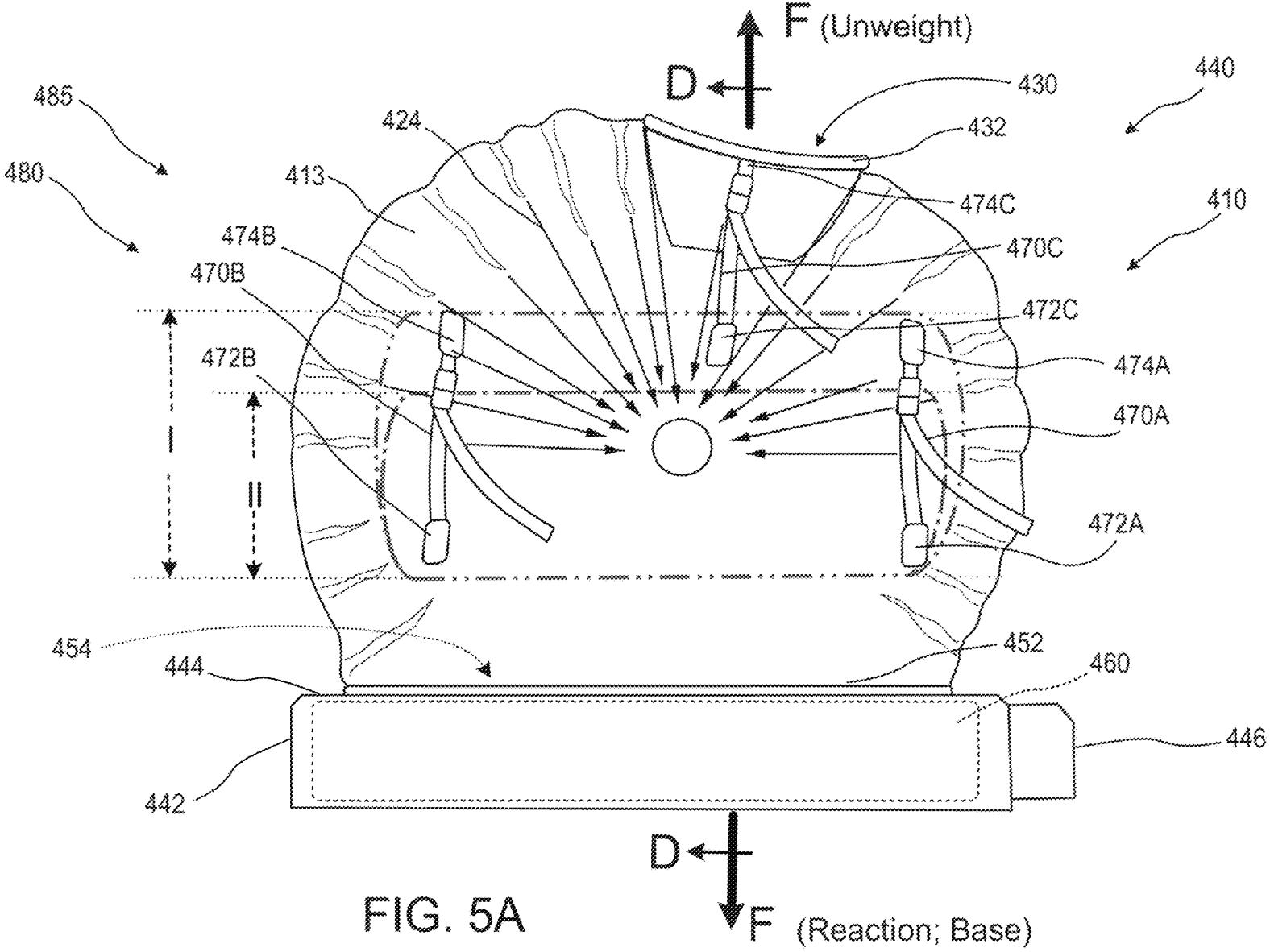
FIG. 5A is a side view schematic representation of an independently-supportable inflatable enclosure as part of an example DAP System having a course height adjustment mechanism and a seal frame reinforcement system according to inventive concepts discussed herein.
Figure 5B:
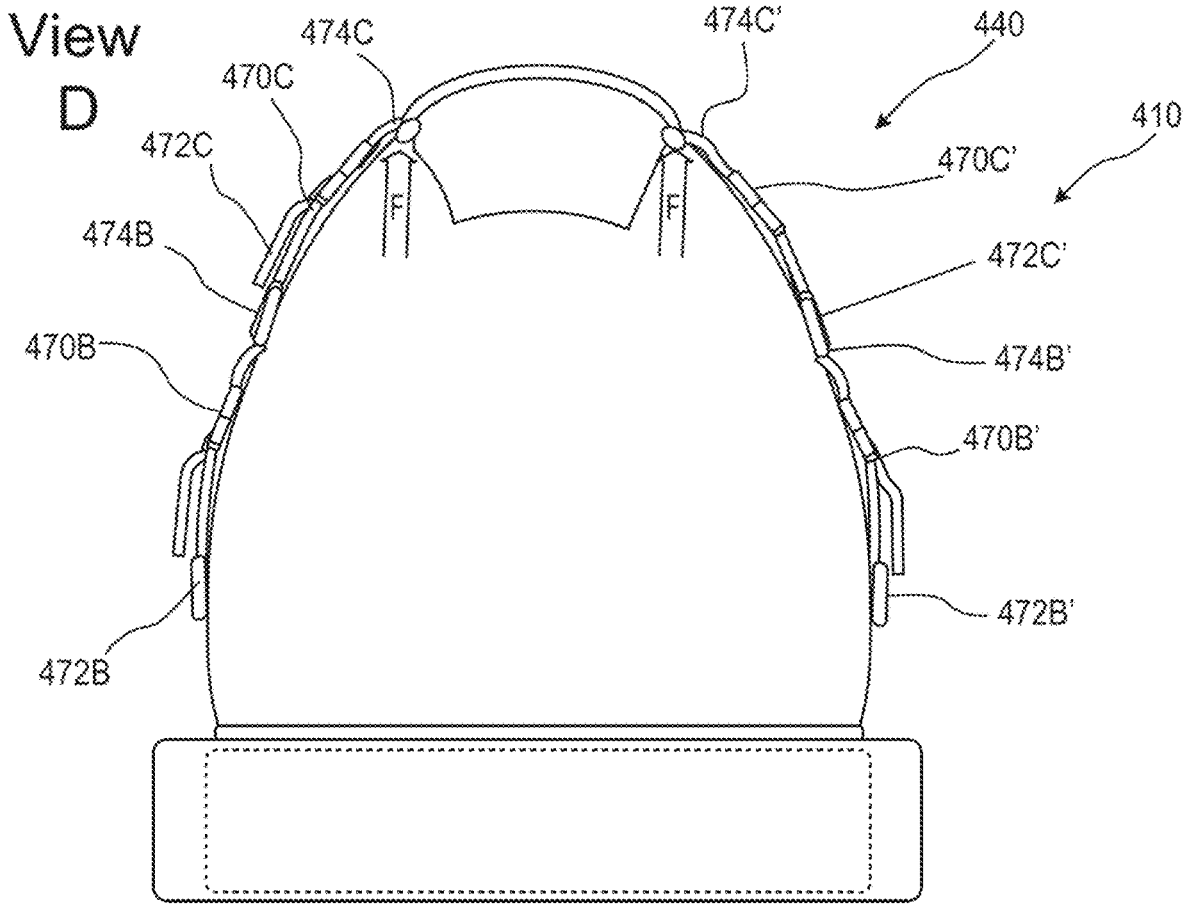
FIGS. 5B and 5C are cross-sectional views of the inflatable enclosure and DAP System along line D-D as shown in FIG. 5A.
Figure 5C:
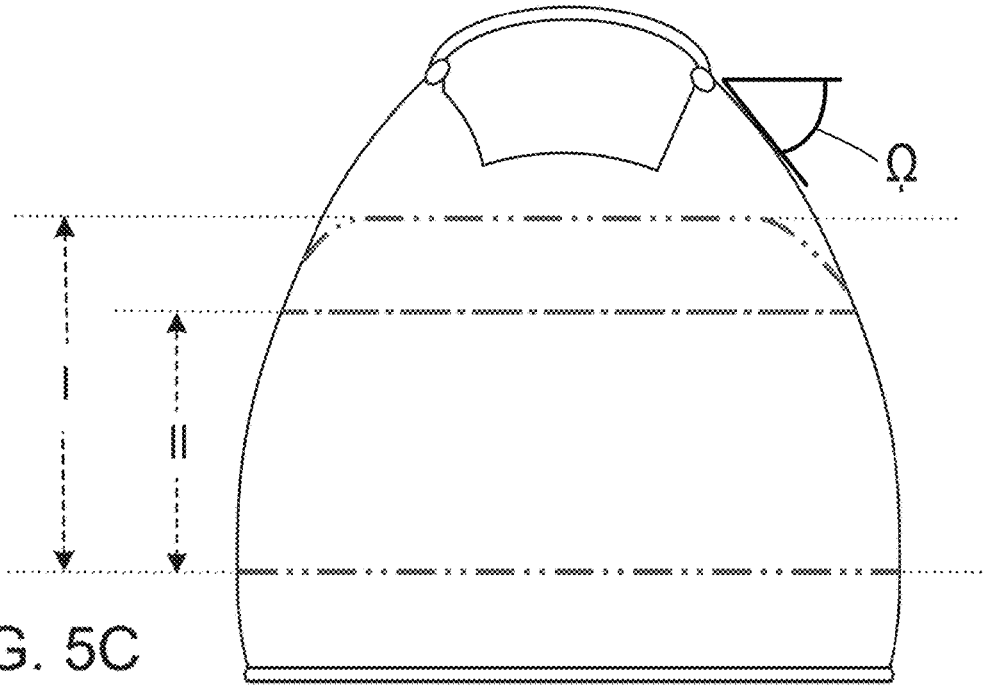

Referring again to FIG. 5A along with FIGS. 5B and 5C, enclosure 410 corresponds with enclosure 110 having a low hoop stress arrangement that is shown above along with FIG. 2A, during which enclosure 110 and related options and features were discussed in significant detail. Enclosure 410 provides an optional arrangement with respect to restraints that can permit height adjustment for the enclosure along with reinforcement and stabilization, which has a pair of adjustable intermediate restraints on each lateral side, 470A and 470B and 470A' and 470B', attached at their first and second ends to the enclosure at locations above and below a centerpoint of the enclosure. The pair of adjustable restraints have been installed in a vertical, fore-aft spaced apart arrangement located proximate low-stress curved or radiused edge portions of the enclosure. Length reductions of restraints 470A,B,A'&B' can fold or partially collapse enclosure 410 along relief folds that naturally occur at edge portions of the low hoop stress enclosure, which can provide at least coarse or preliminary height adjustments to the enclosure via the intermediate adjusters/restraints 470A,B, A'&B'.

Figure 6A:
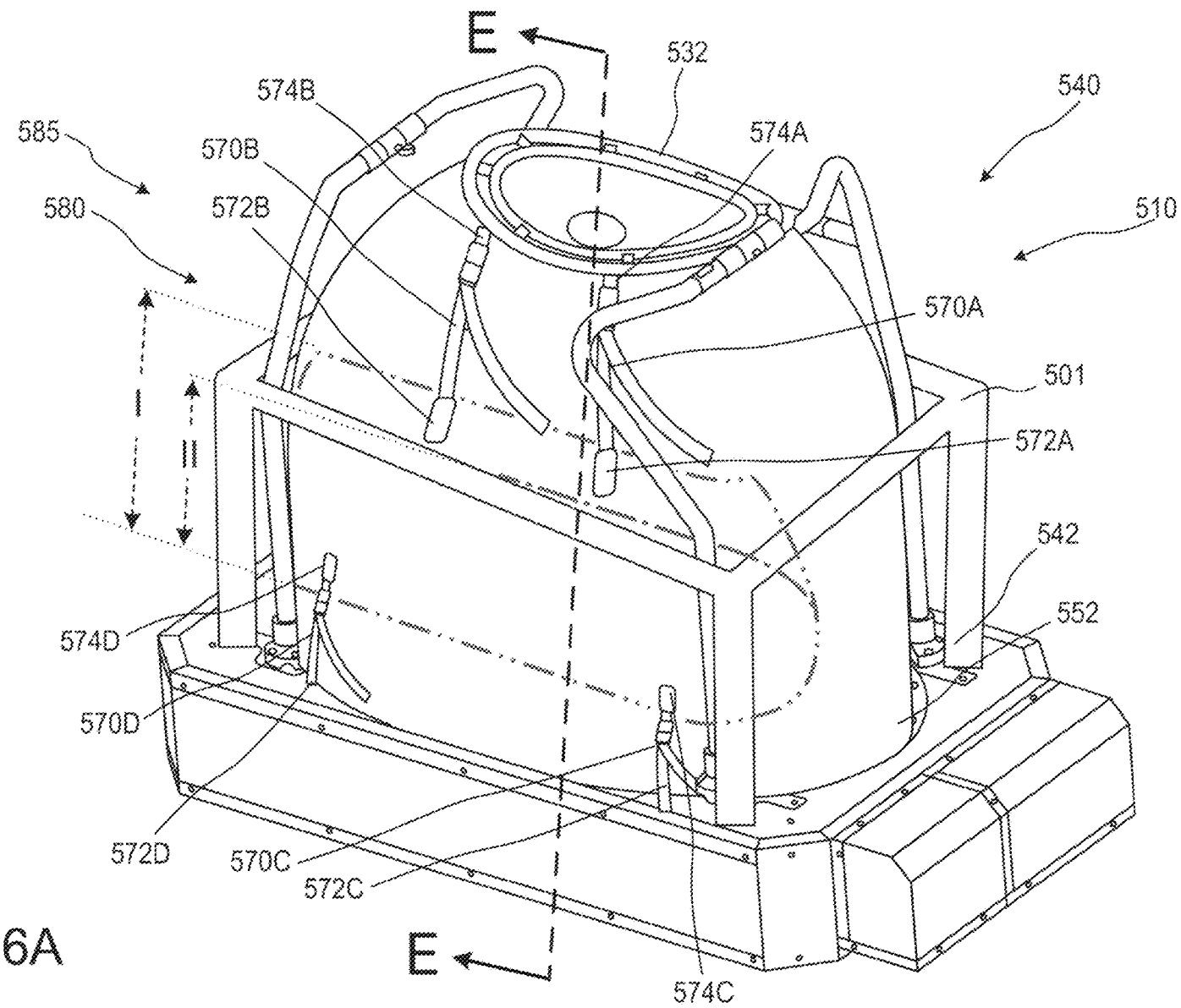
FIG. 6A is a top perspective view of a schematic representation of a supported and/or independently-supportable inflatable enclosure as part of an example DAP System having a course height adjustment mechanism and a combined height adjustment and reinforcement seal frame reinforcement system along with a seal frame having an outer attachment ring in accordance with concepts discussed herein.
Figure 6B:
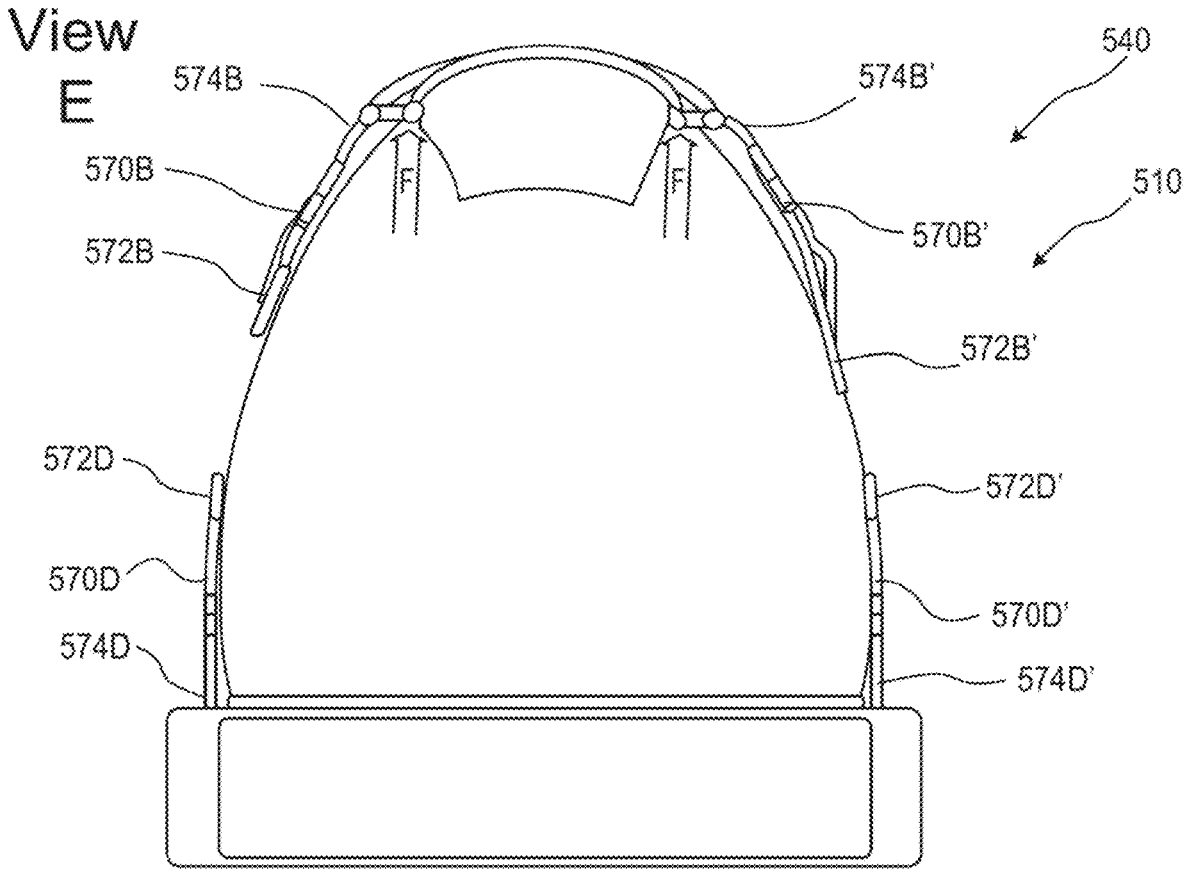
FIG. 6B is a cross-sectional view of the inflatable enclosure and DAP System along line E-E shown in FIG. 6A.
Figure 6C:
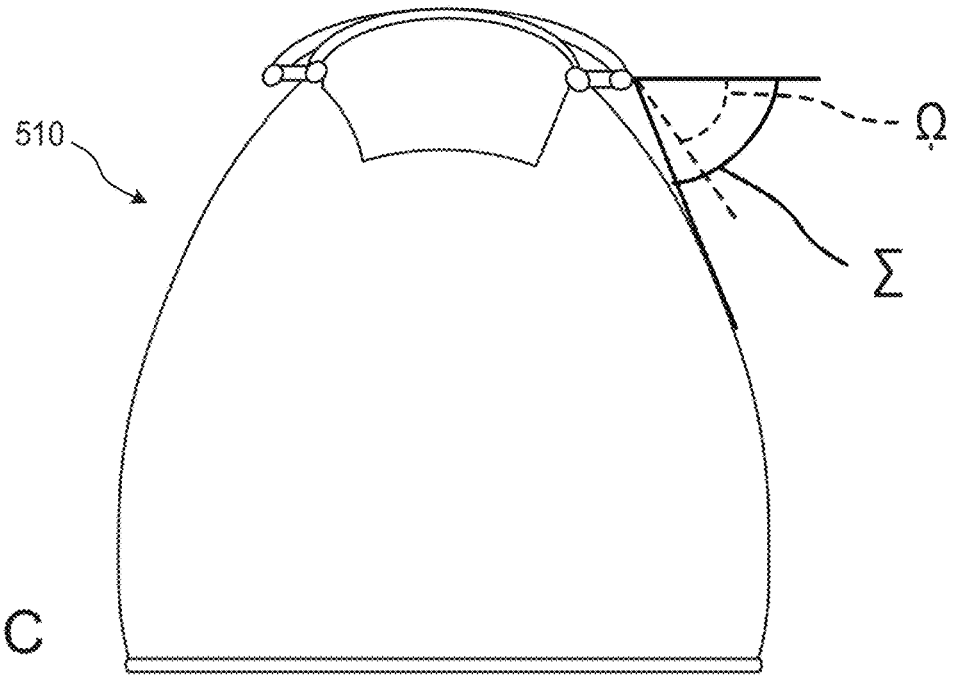
FIG. 6C is the cross-sectional view of FIG. 6B without showing the base support and using the seal frame of FIG. 2L.

Referring now to FIG. 6A, a DAP System 540 and corresponding enclosure 510 is shown that includes aspects and features of enclosure 110 of FIG. 2A with respect to having a 'dome-shaped' top, which may or may not be independently-supportable depending, for example, on features for the lower half of the enclosure. Notably, DAP System 540 and enclosure 510 includes use of a top frame 532 having an expanded external attachment ring. As best seen in FIGS. 6B and 6C, an initial angle of attachment, Ω, between each of the restraints 570A,B,A'&B' downward from attachment with seal frame 532 can be modified to an increased angle of attachment, Σ, that is closer to ninety-degrees or substantially vertical. Increasing an angle of attachment for top restraints extending from a seal frame downward to the enclosure wall can significantly increase reinforcement, stabilization and height adjustment benefits provided by the restraints by applying larger vertical components of force to be applied through the restraints. Increasing the vertical force components applied through the restraints 570A,B,A'&B' can increased the amounts of height adjustment forces applied, as well as increasing amounts of reinforcing forces applied, and corresponding counteracting stabilization moments discussed above along with FIGS. 2B to 2E.

Lift System and Safety Restraint System

Figure 7A:
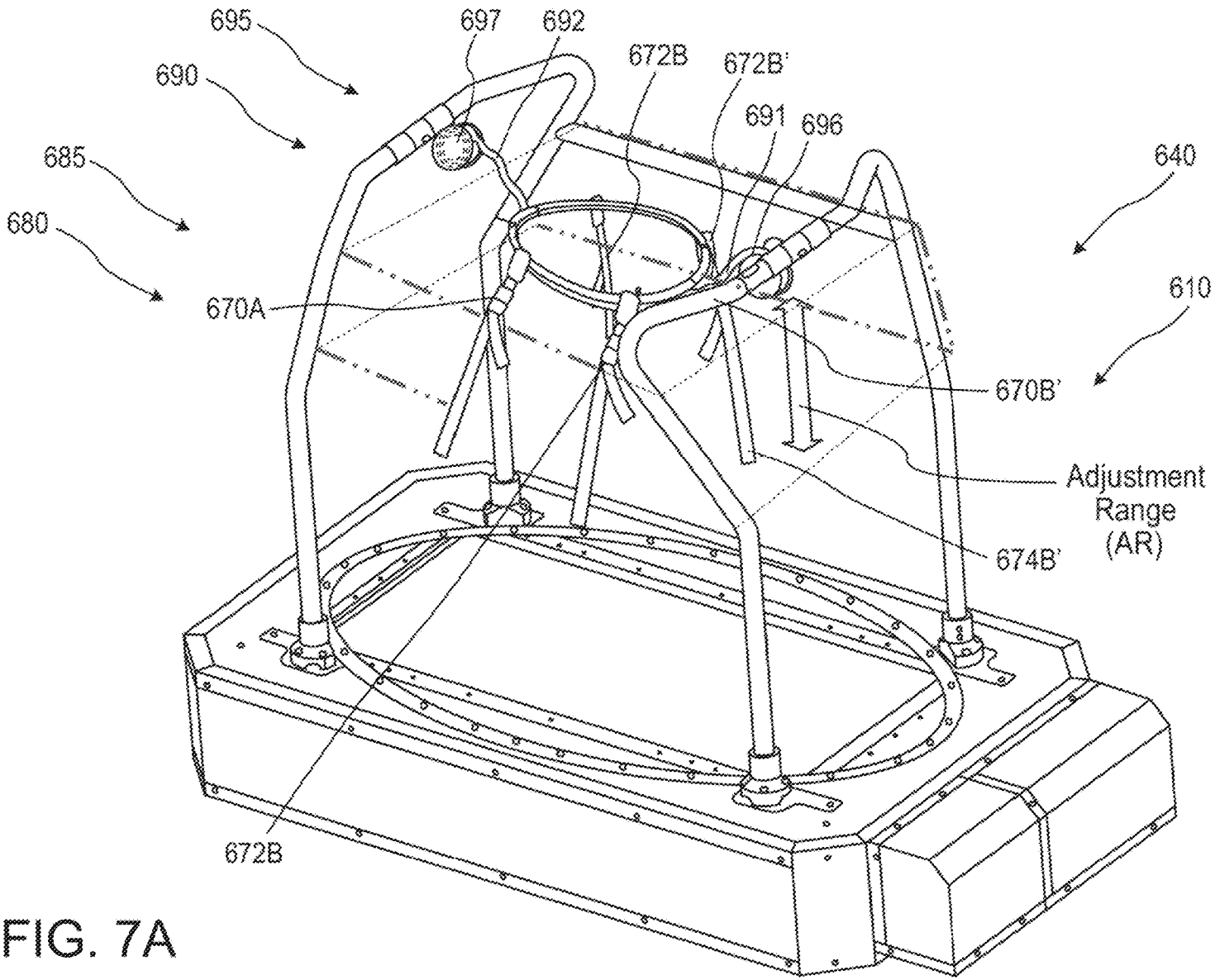
FIGS. 7A to 7C are perspective views of schematic representations for example DAP systems in various height positions without the enclosure shown, which includes an exercise device in the form of a treadmill, a DAP base, non-frame safety bars attached to the base, a seal frame, and lift and safety restraints attached to the non-frame safety bars.
Figure 7B:
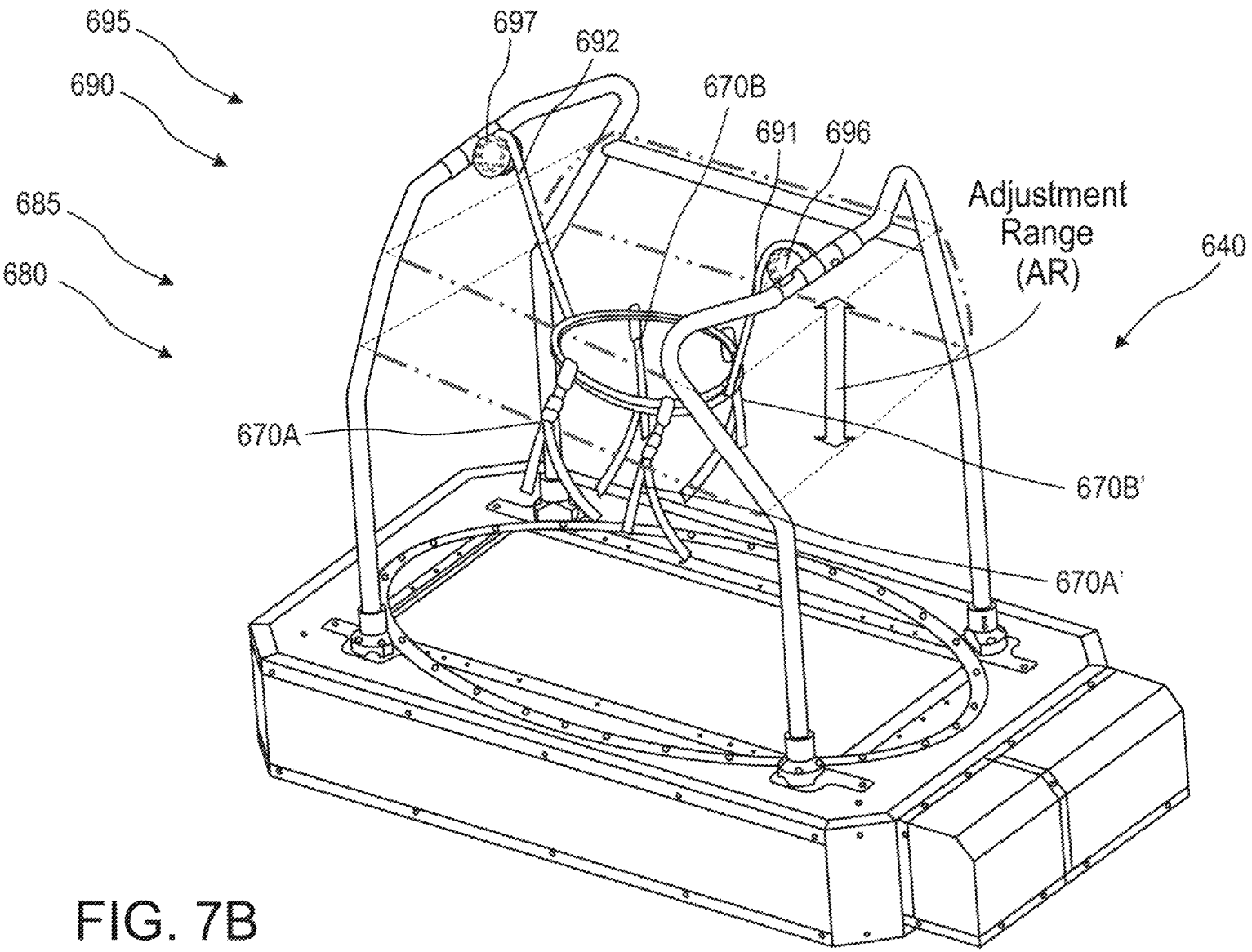
Figure 7C:
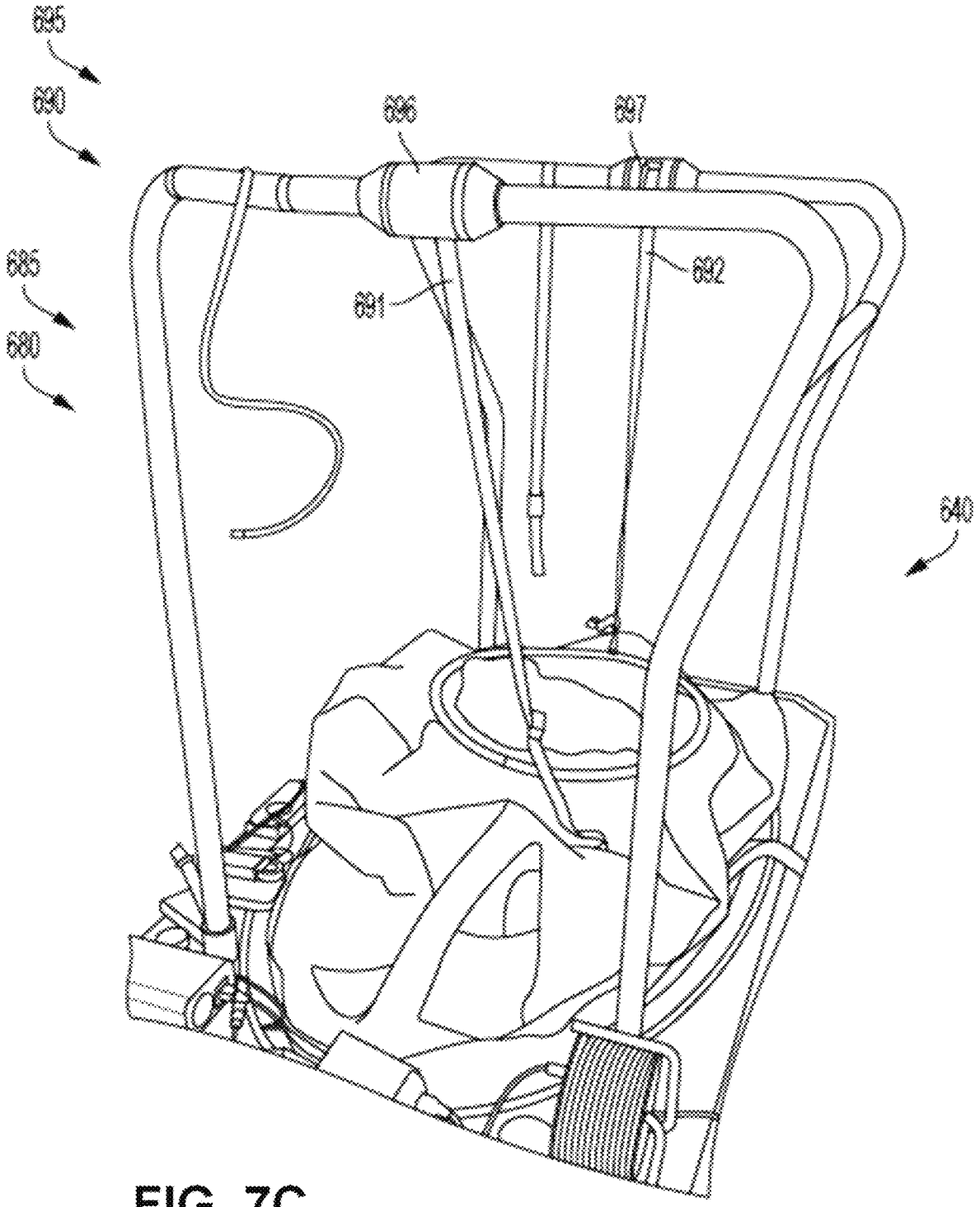

Referring now to FIGS. 7A-7C, a DAP System 640 is generally shown without showing the corresponding enclosure 610, which generally includes aspects and features of DAP Systems and enclosures discussed previously except as discussed hereafter pertaining to safety restraints and a lift mechanism. Like numbers refer to like features. Further, DAP System 640 includes a combination stabilization system 685 and height adjustment system 680 similar to arrangements discussed above along with FIGS. 4A, 4B and 6A-6C including four-restraints 670A,B,A'&B' extending in spoke-like manner from seal frame 632.

In addition, DAP System 640 includes a safety restraint system 690 and a lift system 695. The lift system 695 includes a first lift 696 attached to a front bar and a second lift 697 attached to a rear bar, as well as the safety restraints of the safety restraint system. The safety restraint system 690 includes first safety restraint 691 attached to a front portion of the seal frame 632 at one end and connected to the first lift 696 at the other end, and second safety restraint 692 attached to a rear portion of the seal frame at one end and connected to the second lift 697 at the other end. Similar to lift restraints 670A,B,A'&B', each of the safety restraints 691 and 692 can be configured as flexible tensile members, such as a high tensile strength strap, cord, cable and the like. The first and second lifts 696 and 697 can include powered lifts, spring-loaded or reverse spring-powered roller lifts, and manual lifts.

The lift system 695 can operate to raise and lower the seal frame 632 as needed to assist the user with initial set-up and inflation operations prior to use of the DAP System 640. Likewise, the lift system 695 can assist with reverse deflation operations and reverse set-up. As shown in FIG. 7B, the lifts can be configured to raise the seal frame 632 from ground level (FIG. 7C), after the user is located within the seal frame, up to set-up height. For example, the set-up height can be at a low end of a height adjustment range for the DAP System 640 or slightly below the low-end height. The lifts 696 and 697 can support the seal frame 632 at the set-up height while the user fully connects the user interface (not shown) corresponding connections of the user's exercise clothing. Thereafter, as shown in FIG. 7A, the lifts can be configured to raise the seal frame 632 to an enclosure height for the user and support the seal frame at the enclosure height while the enclosure inflates and provides support for the seal frame 632 along with unweighting support for the user.

During use of the DAP System 640 by the user in the inflated condition, the safety restraint system 685 can control operation of the lifts 696 and 697. The lifts 696 and 697 can release a safety length of each of the safety restraints 691 and 692, such that the safety restraints are not taut during exercise and use of the system by the user. Rather, the safety restraint system 690 can be set to provide a safety 'catch' for the user in the event of emergency (e.g., power loss) or mistake (e.g., user stumble), such that the seal frame 632 catches the user and prevents falling or injury. In other words, the safety restraint system 690 can provide a 'low end' or 'low height' safety mechanism for the user. At the same time, the stabilization system 685 and lift restraints 670A,B,A'&B' can provide a 'high end' safety mechanism that restrains the enclosure in the event of emergency or fault, such as a tear or other failure of the enclosure. In this manner, the safety restraints 691 and 692 and the lift restraints 670A,B,A'&B' can cooperate to provide 'bracketed' protection for the user including both high end and low-end mechanisms for catching and/or supporting the seal frame 632 and enclosure (not shown) from unsafe contact with the user. Further, neither the lift system 695, the safety restraint system 690, nor the stabilization system 685 are configured to provide height adjustment. Rather, as discussed above along with FIGS. 4A & 4B, and 6A-6C, as well as hereafter along with FIGS. 9A to 20, various arrangements of lift restraints can cooperate with the seal frame to provide height adjustments as part of non-powered height adjustment systems.

Referring now to FIG. 8, an optional arrangement for an example DAP System 740 is shown that generally includes the same aspects and features as DAP System 840 except as described hereafter. Like numbers refer to like features. DAP System 740 primarily differs from DAP System 840 in that the first lift 796 and the second lift 797 are both attached to a front rail. Further, first safety restraint 791 is arranged to extend from the first lift 796, through multiple lateral attachments on one side of the seal frame 732, and to an attachment at a rear bracket. Similarly, second safety restraint 792 is arranged to extend from the second lift 797, through multiple lateral attachments at an opposite side of the seal frame 732, and to an attachment at a rear bracket. Such an arrangement can locate both lifts in front of the user for improved access, control and monitoring of lift operations. In addition, the attachment arrangement between the safety restraints and the seal frame 732 via multiple attachments can help maintain a desired alignment of the seal frame 732 during lift and set-up operations.

Manual Height Adjustment Arrangements

Referring now to FIGS. 9A to FIG. 20, various options and arrangements are generally shown as described in greater detail hereafter for implementing height adjustment systems or mechanisms along with stabilization and reinforcement systems or mechanisms. Each of these DAP Systems 840 are generally represented to include enclosure 810 that can include similar aspects and features as low hoop stress enclosure 110 described along with FIG. 2A. However, except as discussed along with each of the example arrangements, the depiction of enclosure 110 is merely for illustrative purposes. As such, it is understood that arrangements pertaining to lift restraints 870 and/or safety restraints 891, 892 shown and discuss along with FIGS. 9A to 20 can be implemented with other DAP Systems and enclosures, such as are depicted in FIGS. 4A & 4B and 6A & 6B discussed above or as described in detail in the December 2020 Prov. Appl., as well as along with other arrangements that can include conventional systems, and with enclosures and additional descriptions thereafter in the present application.

Each of the DAP Systems 840 shown in FIGS. 9A to FIG. 20 generally includes the aspects and features discussed above along with other DAP Systems discussed herein except as noted otherwise. Accordingly, like numbers refer to like features. Further, although various design considerations, benefits and features have been described along with various examples herein including the examples of FIGS. 9A to 20, such descriptions are not limiting. For instance, although functional benefits pertaining to, for example, height adjustment are described along with the figures for an example DAP System and/or enclosure, such description does not limit the description for being applicable to other features or benefits. With particular reference to FIGS. 9A to 20, example benefits, features and/or functions discussed along with corresponding lift restraints shown in the various examples are not limiting. Rather, it is understood that lift restraints shown and described along with examples herein can provide functional benefits pertaining to structural reinforcement, stabilization, bending resistance, safety functions, and/or height adjustment as examples even though corresponding descriptions may be limited to a subset of features and benefits.

Figure 9A:
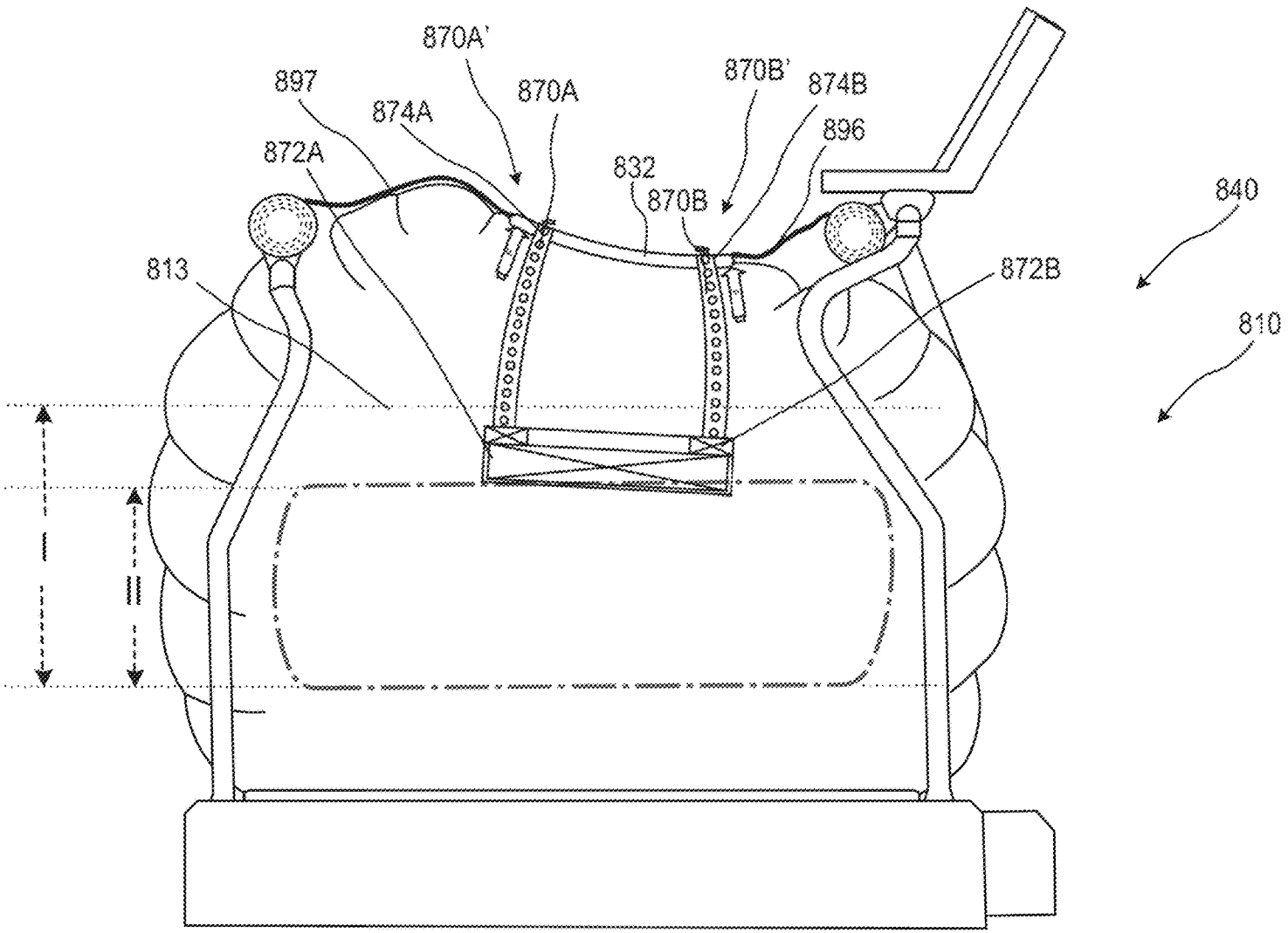
Figure 9B:
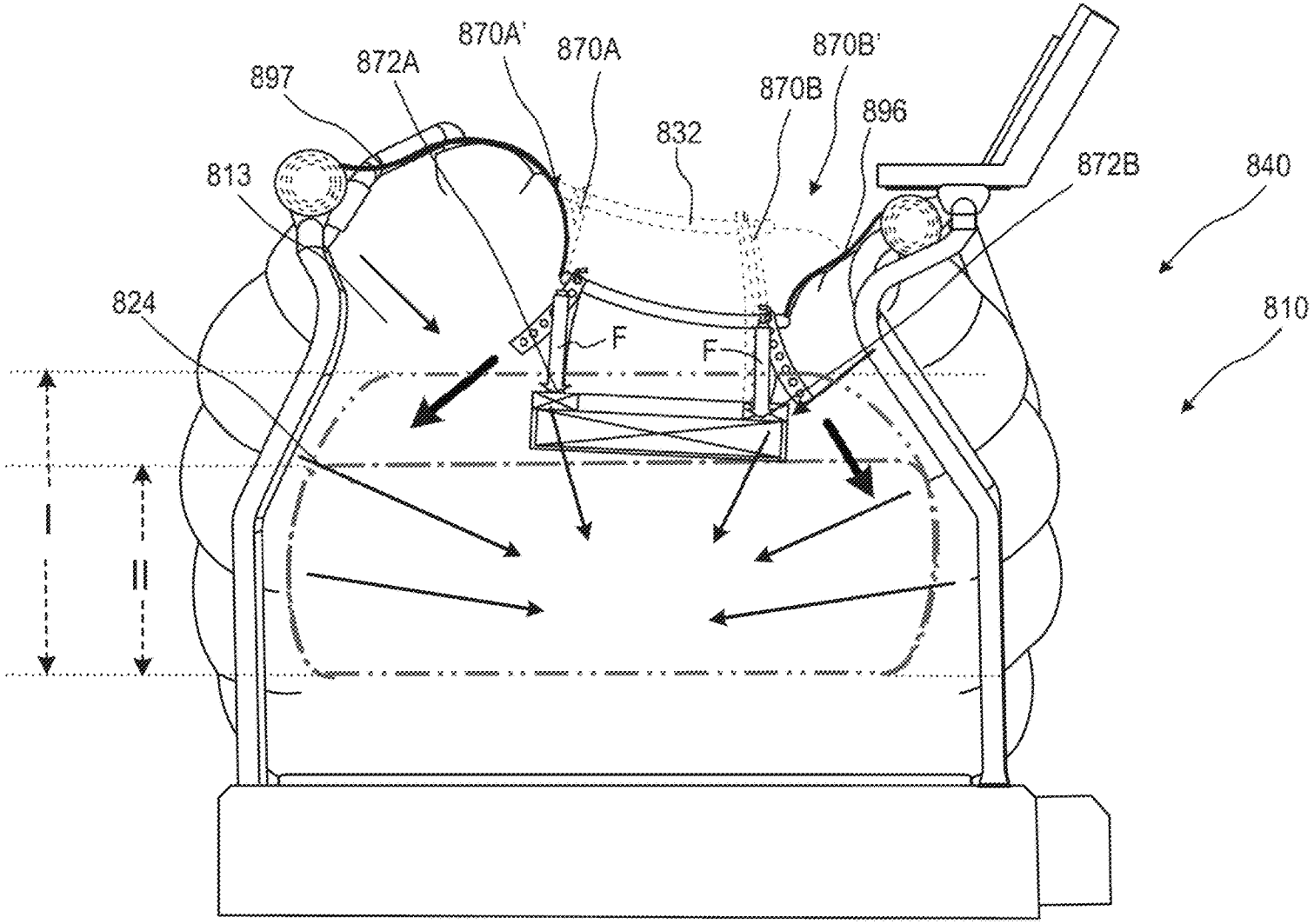
FIG. 9B illustrates a post-adjustment arrangement of the same showing modified orientations for meridional stresses after adjustment.

Referring now to FIGS. 9A and 9B, DAP System 840 and enclosure 810 include a bilaterally balanced arrangement of four (4) lift restraints 870A,B,A'&B', in which an opposing pair of lift restraints 870A,A' and B,B' are each attached at a second attachment 874A,B,A'&B' to a front or rear portion of the seal frame 832. Each pair of lift restraints extends in opposite lateral (L-R) and downward directions to corresponding second attachment 872A,B,A'&B'. As shown, the second attachment can be located within Range I and can be attached via a sewn reinforcement along the enclosure wall 813, which in some configurations can include a single reinforcement connecting the first attachments 872A,B & A',B' that is disposed on the same lateral side. Such an attachment option can help spread attachment loads along the enclosure wall and further ensure uniform applications of tensile force are applied from corresponding pairs of restraints on each lateral side to the first attachment. Further, a rigid bar or other rigid member can span the reinforcement for improved attachment and load-spreading, and the lift restraints may be attached to the rigid member, which in turn imparts the vertical restraining forces along its full length to the fabric enclosure.

As best seen in FIG. 9B, such an arrangement of lift restraints can permit user-controllable height adjustment of the enclosure 810 including adjustment while using the DAP System 840. The lift restraints can be configured as adjustable straps 870A,B,A'&B' having a series of pre-established adjustment settings, such as in a belt arrangement, which can permit the user to continue making adjustments while within the enclosure until a desired enclosure height is reached. Further, the lift restraints 870A,B,A'&B' can be arranged such that height adjustments requiring high forces to be applied by the user, such as changing the enclosure from a greater height down to a lower height, can be implemented by pushing on the top frame 832 and reconnecting the belt restraint 870A,B,A'&B' at a shorter distance. As such, the user can take advantage of body weight to assist with implementing adjustments that act contrary to the upweighting forces being applied by the enclosure 810. As further shown in FIG. 9A vs. 9B, safety restraints 896 and 897 can be released corresponding amounts along with height adjustments to provide adjusted lower limit safety benefits discussed above along with FIGS. 7A to 8. As can be seen in FIG. 9B, for enclosures configured as low hoop stress enclosures, meridional stresses can be shifted downward as a result of user-implemented height adjustments, which can maintain benefits of low hoop stress enclosures. It is understood that a reverse configuration could be implemented, such that the restraints can be anchored on the top frame and the hook or adjustment anchored on the enclosure wall.

Figure 10A:
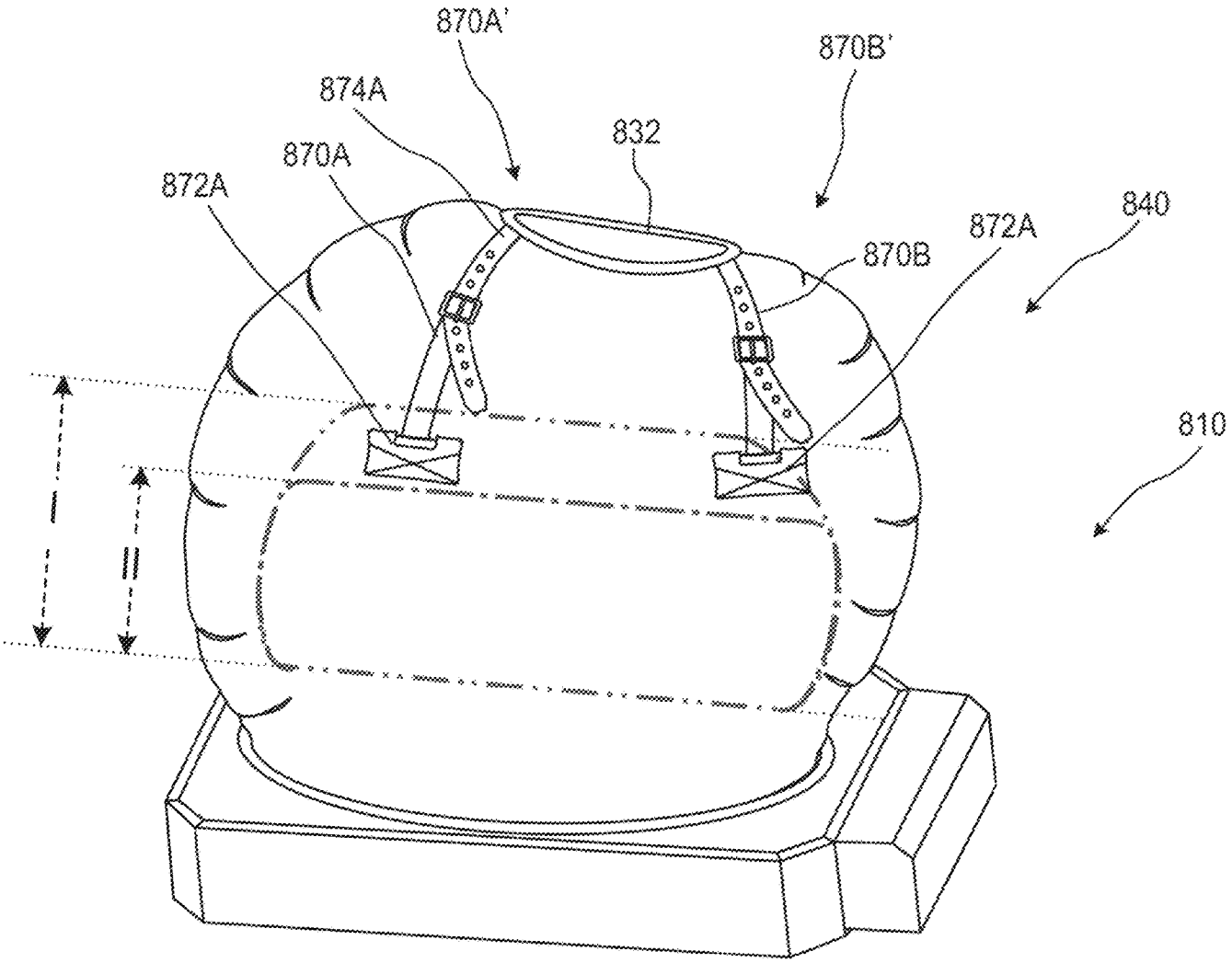
FIG. 10A shows a side perspective schematic representation of another example arrangement of an inflatable enclosure having a combined height adjustment and reinforcement system including of four (4) adjustable lift restraints without showing safety restraints or safety bars according to inventive concepts discussed herein, which include a different enclosure attachment arrangement in comparison with FIGS. 9A and 9B.
Figure 10B:
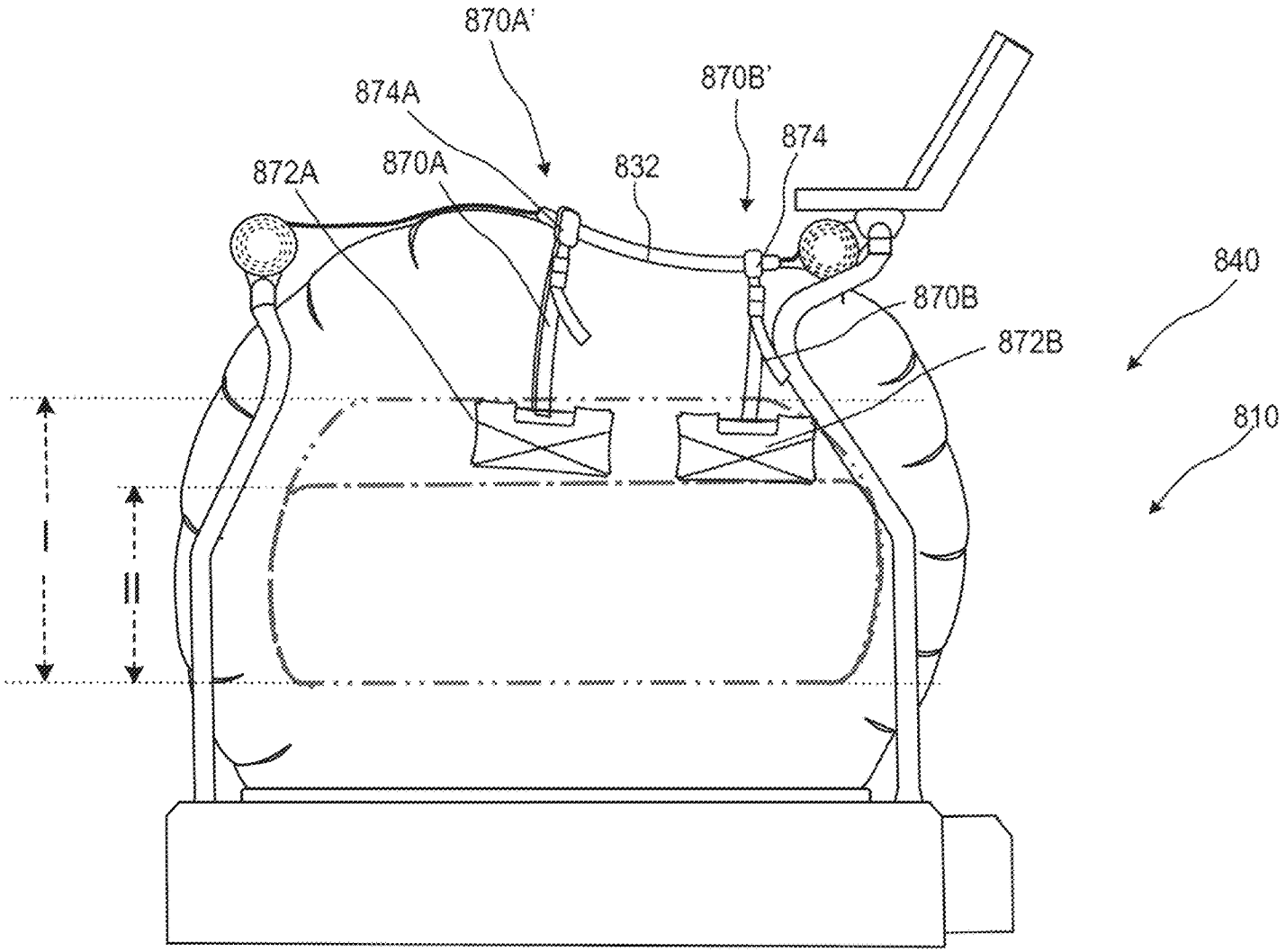
FIG. 10B shows a side view schematic representation of a further example arrangement of an inflatable enclosure having a combined height adjustment and reinforcement system including four (4) adjustable lift restraints along with safety restraints according to inventive concepts discussed herein, which includes a different enclosure attachment arrangement than previous examples including the use of discrete attachment bars at the lower ends of the lift restraints.

Referring now to FIGS. 10A and 10B, alternative arrangements are depicted for the arrangement of FIGS. 9A and 9B. FIG. 10A illustrates an arrangement of the lift restraints 870A,B,A'&B' that spread out from the seal frame 832 in a somewhat spokelike arrangement, which can reduce enclosure bulges before and aft of the seal frame 832 that can occur during height adjustments with configurations like FIG. 9B. Further, the first attachments and corresponding reinforcements sewn into the enclosure wall are separate and discrete from each other, which can avoid unnecessary limitations and stresses being imposed on the enclosure walls based on the first attachments being spaced further apart from each other. In addition, spacing of the first attachment locations apart from each other can enhance stabilization and reinforcement benefits provided by the lift restraints.

In contrast, the arrangement of FIG. 10B maintains the orientation and shape for lift restraints 870A,B,A'&B' of FIGS. 9A & 9B, but separates the first attachments 872A,B from each other for permitting greater flexibility for the user to implement fore vs. aft adjustments or customizations for tilt or other preferences without imparting unnecessary twisting stresses along the enclosure wall. This can permit customized user adjustments including height adjustments along with tilt or twist adjustments with respect to the seal frame 832. In addition, as discussed along with FIG. 12A in greater detail, FIG. 10B includes continuous adjustment restraints such as cinch straps, which can further enhance user customization with respect to enclosure height and orientation of the seal frame 832. A benefit of splitting up the adjustments is that when the bag folds, there is much greater flexibility as the patches are small enough not to materially impact the natural design of the fabric under the reinforcement patches to fold in a natural direction. Especially when there are metal rods spreading the load inside the patch, a metal rod, cross horizontally across the bag significantly impacts the ability of the bag to collapse into a low profile shape when it is uninflated.

Figure 12A:
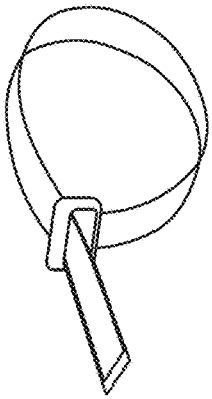
FIGS. 12A-12C are schematic representations of other example types of variable, non-preset position adjustable lift restraints including a fold-over, Velcro-type attachment strap, a cinch strap, and a ratchet strap.
Figure 12B:
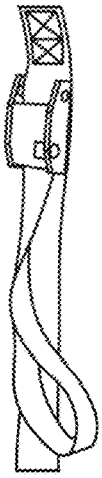
Figure 12C:
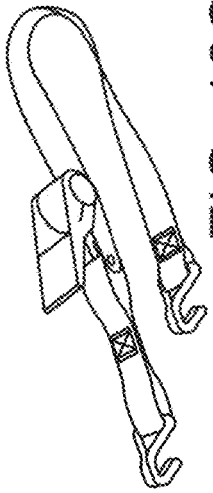

Referring now to FIG. 11 along with FIGS. 12A to 12C, an arrangement of DAP System 840 and enclosure 810 is generally shown that corresponds with the arrangement of FIG. 10A and further demonstrates advantages that can be provided via a spokelike arrangement of lift restraints 870A, B,A'&B' along with allowing the user to apply downward force for implementing adjustments in lengths of the lift restraints. FIG. 11 along with FIGS. 12A to 12C provide various examples of beneficial restraints that enable greater flexibility for the user for implementing adjustments. For example, FIG. 12A illustrates a potential restraint arrangement that takes advantage of VELCRO-type attachments and length adjustments for the lift restraints. Similarly, FIG. 12B illustrates a cinch-type adjustment buckle for use with lift restraints, and FIG. 12C illustrates a ratcheting-type adjustment connection for use with lift restraints. These and other types of continuously-adjustable restraint arrangements can allow great flexibility for the user when implementing desired length adjustments without requiring the user to adhere to pre-set length settings. Further, such restraint adjustment features can simplify implementation of adjustments, such as allowing the user to simply pull downward on a cinch strap for reducing height, or to use a ratchet-type connection for counteracting high upweighting forces.

Referring now to FIGS. 13A-15, example configurations of DAP Systems 840 and enclosures 810 are shown that have enclosures with low hoop stress arrangements, which may or may not be configured as discussed above along with FIG. 2A. As discussed above and along with the December 2020 Prov. Appl., based on significant research, testing and development, Applicants have identified inventive parameters for providing independently-supportable and/or partially independently-supportable enclosure arrangements including balanced force configurations and/or configurations having beneficial dome-like upper portions, such as enclosure 510 shown in FIG. 6A. Such arrangements can include relatively low hoop stress arrangements even if such enclosures differ in various respects from enclosure 110 described along with FIG. 2A. The enclosures 810 shown in FIGS. 13A-15 include enclosures having relatively low hoop stress arrangements and corresponding curvatures along upper portions of the enclosure (e.g., hoops along upper portions of the enclosure).

As shown in FIGS. 13A-15, Applicants have determined optional arrangements for till restraints 870A,B,A'&B' that can cooperate with low hoop stress arrangements of such enclosures 810 for beneficial purposes including for providing height adjustment and/or reinforcement and stabilization features. Lift restraints 870A,B,A'&B' can be arranged such that opposing pairs of lift restraints can be disposed proximate low hoop stress regions of the enclosure including being oriented substantially parallel with fore-aft orientations of the hoop regions. Such configurations allow the user to implement length adjustments of lift restraints in a similar manner as discussed above along with other enclosure arrangements, but which can apply tensile stresses along hoop regions of the enclosures rather than primarily along lateral portions. As such, tensile stresses applied by the lift restraints can thereby flatten the hoop shapes and/or impart folding along creases that naturally form along low hoop stress regions including, for example, along meridional lines of the enclosure. Effectively, adjusting these straps is modifying the curvature to effectively shrink the overall diameter of the self-supported enclosure in a way where there was no load being carried along the shell. This means little to no stress in the tensioning members and little to no added stress on the reinforcement patches which are the week point structurally.

Figure 13B:
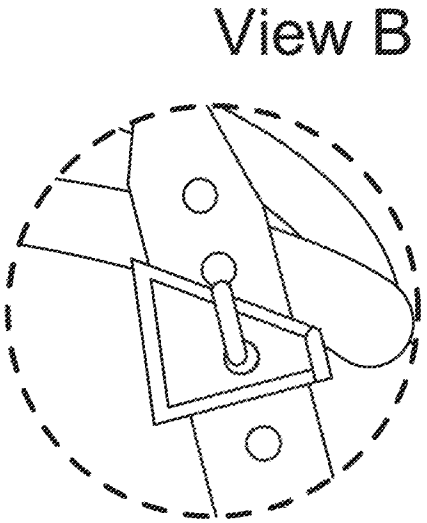
FIG. 13A shows a front elevational schematic representation of yet another example of an inflatable enclosure having a combined height adjustment and reinforcement system including an arrangement of four (4) adjustable lift restraints without showing safety restraints or safety bars according to inventive concepts discussed herein, which includes a different enclosure attachment arrangement for the adjustable lift restraints in comparison with previous examples and include a belt type adjustable lift restraint having preset options.
Figure 13A:
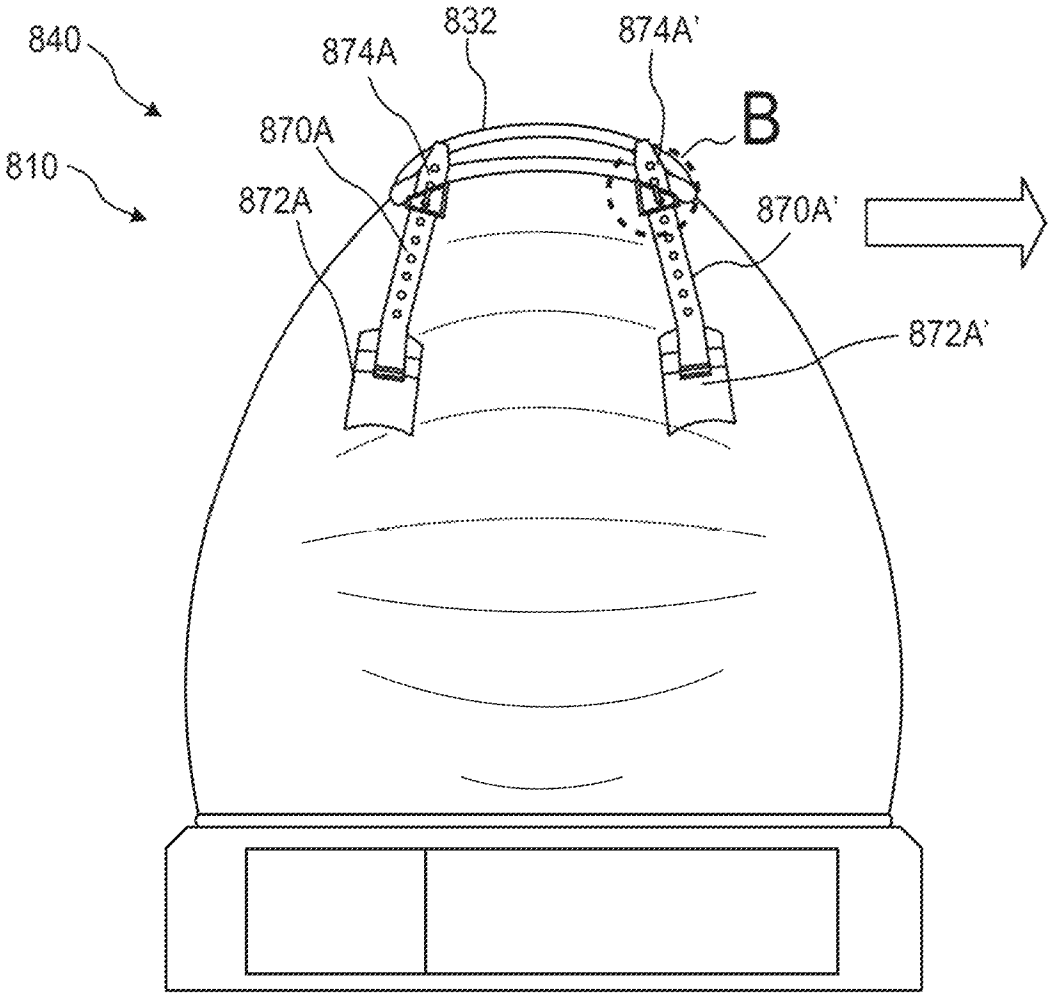
Figure 14B:
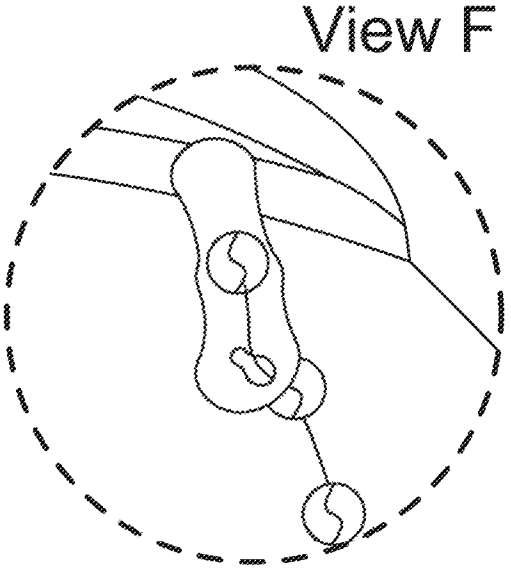
FIG. 14B shows a Detail View B of the connection.
Figure 14A:
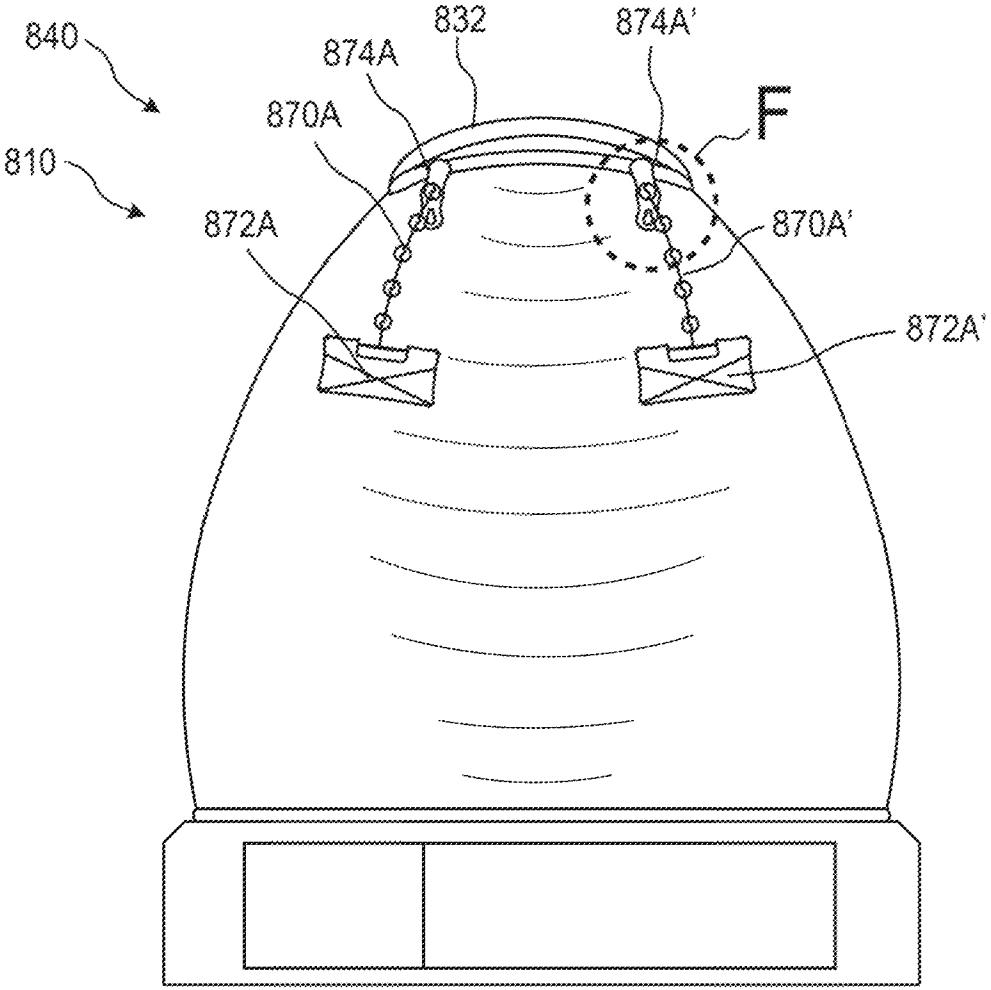
FIG. 14A shows a front elevational schematic representation of an inflatable enclosure having a combined height adjustment and reinforcement system including a further example arrangement of four (4) adjustable lift restraints without showing safety restraints or safety bars according to inventive concepts discussed herein, which includes a different enclosure attachment arrangement for the adjustable lift restraints in comparison previous examples and includes a locking bead adjustable lift restraint having preset options that can be locked into place via pressure from the enclosure in the pressurized state.
Figure 15:
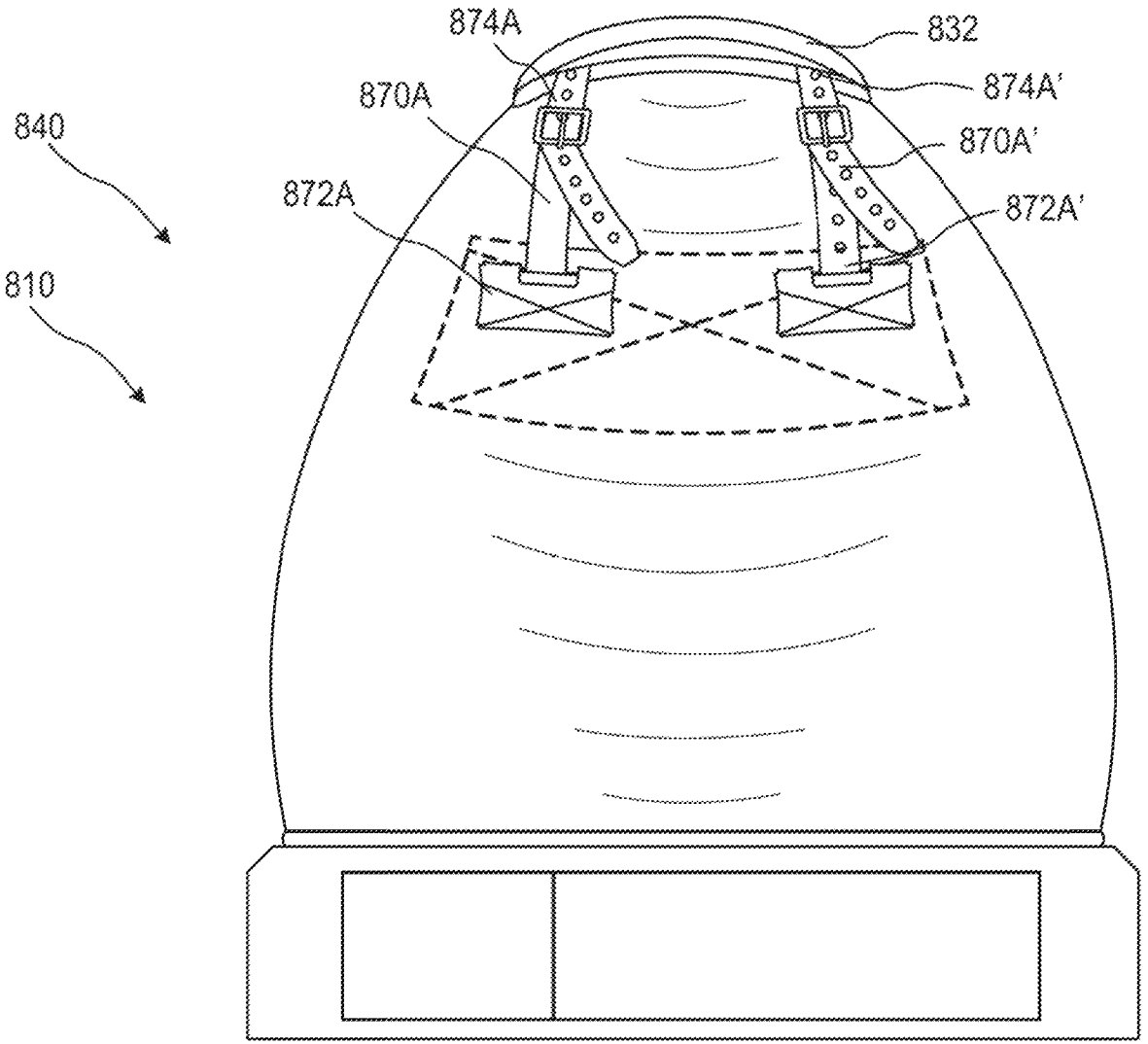
FIG. 15 shows a front elevational schematic representation of an inflatable enclosure having a combined height adjustment and reinforcement system including of another example arrangement of four (4) adjustable lift restraints without showing safety restraints or safety bars according to inventive concepts discussed herein, which includes a different enclosure attachment arrangement for the adjustable lift restraints in comparison with previous examples.

Accordingly, FIGS. 13A and 13B illustrate an optional arrangement that provides for independent adjustment along opposite, parallel portions of the hoop regions both fore and aft of the seal frame 832 compared with adjustments primarily along lateral side portions. As shown, the first attachments 872A,A' and 872B,B' can be located along side portions of the hoop regions for inducing bends, folds and overall flattening of the hoop region to provide height adjustments and other customizations. Such hoop-adjustment arrangements can include multiple adjustment options similar to arrangements discussed above, such as the belt arrangement shown in FIG. 13B. Similarly, FIGS. 14A and 14B show an optional arrangement for using string or rope-like lift restraints having discrete beads or other length adjustments, which can work well with low-force hoop-adjustment arrangements. Such an arrangement can allow the user to quickly and easily change restraint lengths by simply pulling a restraint through a corresponding attachment tab located at the second attachment 874A,B,A'&B'. Such arrangements also fasten the height adjustment setting stronger the more pressure is applied. Upweighting force from the enclosure can readily lock the lift restraint in the desired position. The user can release the lift restraint adjustment and/or modify its length in view of the restraint being disposed along low hoop stress regions without the user having to counteract substantial forces as can be the case with other arrangements discussed above. FIG. 15 differs from FIGS. 13A to 14B in that the first attachments at each of the fore and aft locations are connected via a reinforcement sewn into the enclosure wall, which can help induce bending or flattening along the low hoop stress region above the location of the first attachments.

Figure 16:
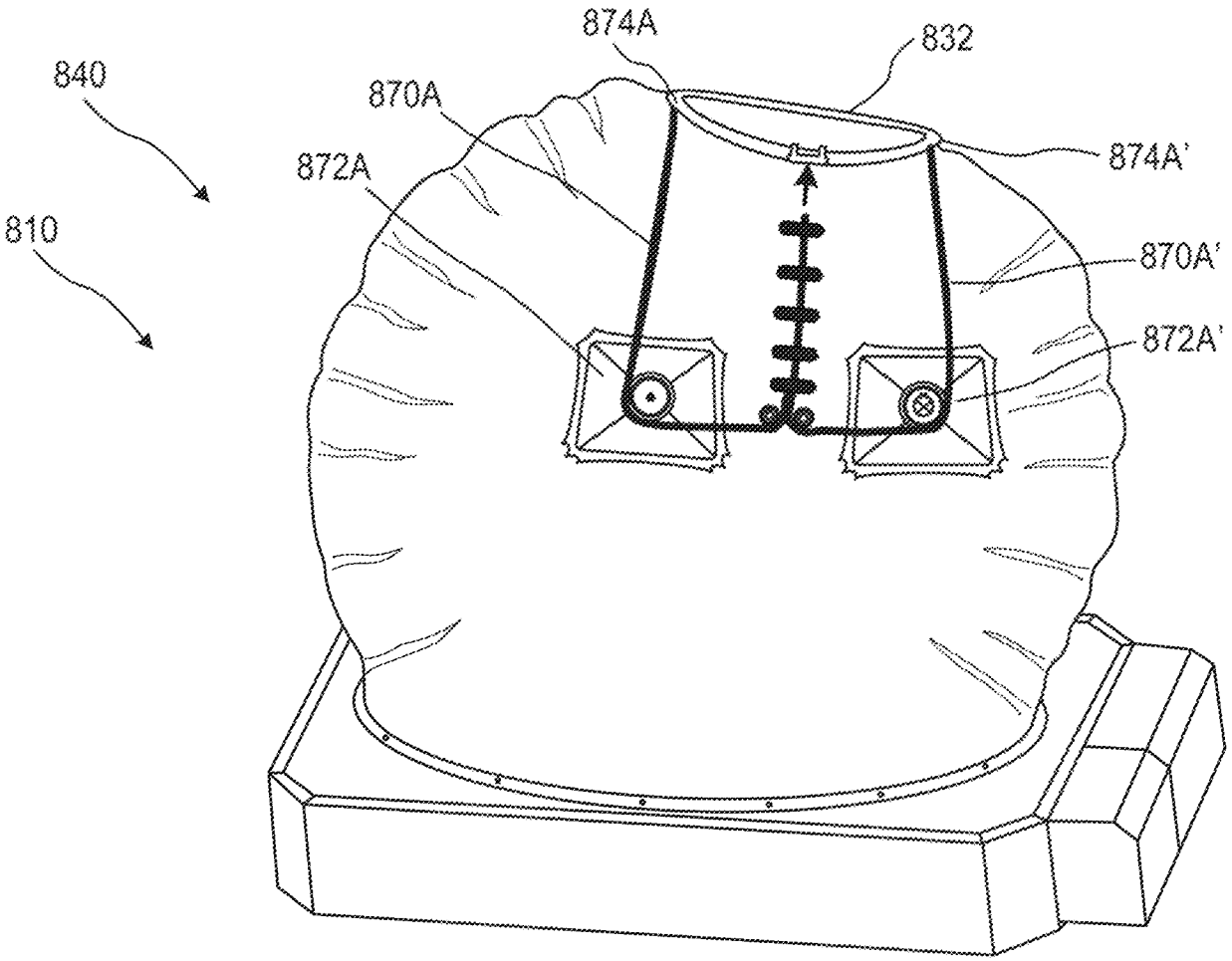
FIG. 16 shows a top perspective schematic representation of an inflatable enclosure having a combined height adjustment and reinforcement system including another example arrangement of four (4) adjustable lift restraints without showing safety restraints or safety bars according to inventive concepts discussed herein, which includes a different enclosure attachment arrangement for the adjustable lift restraints in comparison with previous examples that represents a single pull arrangement for adjusting two adjustable lift restraints simultaneously.

Referring now to FIG. 16, a DAP System 840 and enclosure 810 are shown that illustrate an optional arrangement for lift restraints 870A,B,A'&B', which can be used with various arrangements of lift restraints to simplify implementing height adjustments and other customizations based on lengths of the lift restraints. As shown, first attachments 872A,A' and B,B' can include pulleys or other direction-modifying or pivot-type devices, which can allow multiple lift restraints to be adjusted as a group. Thus, as shown in FIG. 16, a pair of lift restraints 870A,A' disposed along one side of the enclosure can be routed such that the user can pull upward on the pair of restraints to impart adjustments of multiple restraint lengths at the same time.

Referring now to FIGS. 17-20, optional arrangements for lift restraints are shown that can cooperate with low hoop stress arrangements for beneficial purposes including providing height adjustment and/or reinforcement and stabilization features. In particular, lift restraints can be arranged for providing reinforcement, stabilization and/or height adjustments in cooperation with aspects and features of low hoop stress enclosures like enclosure 110 discussed along with FIG. 2A and described in detail in the December 2020 Prov. Appl.

Figure 17:
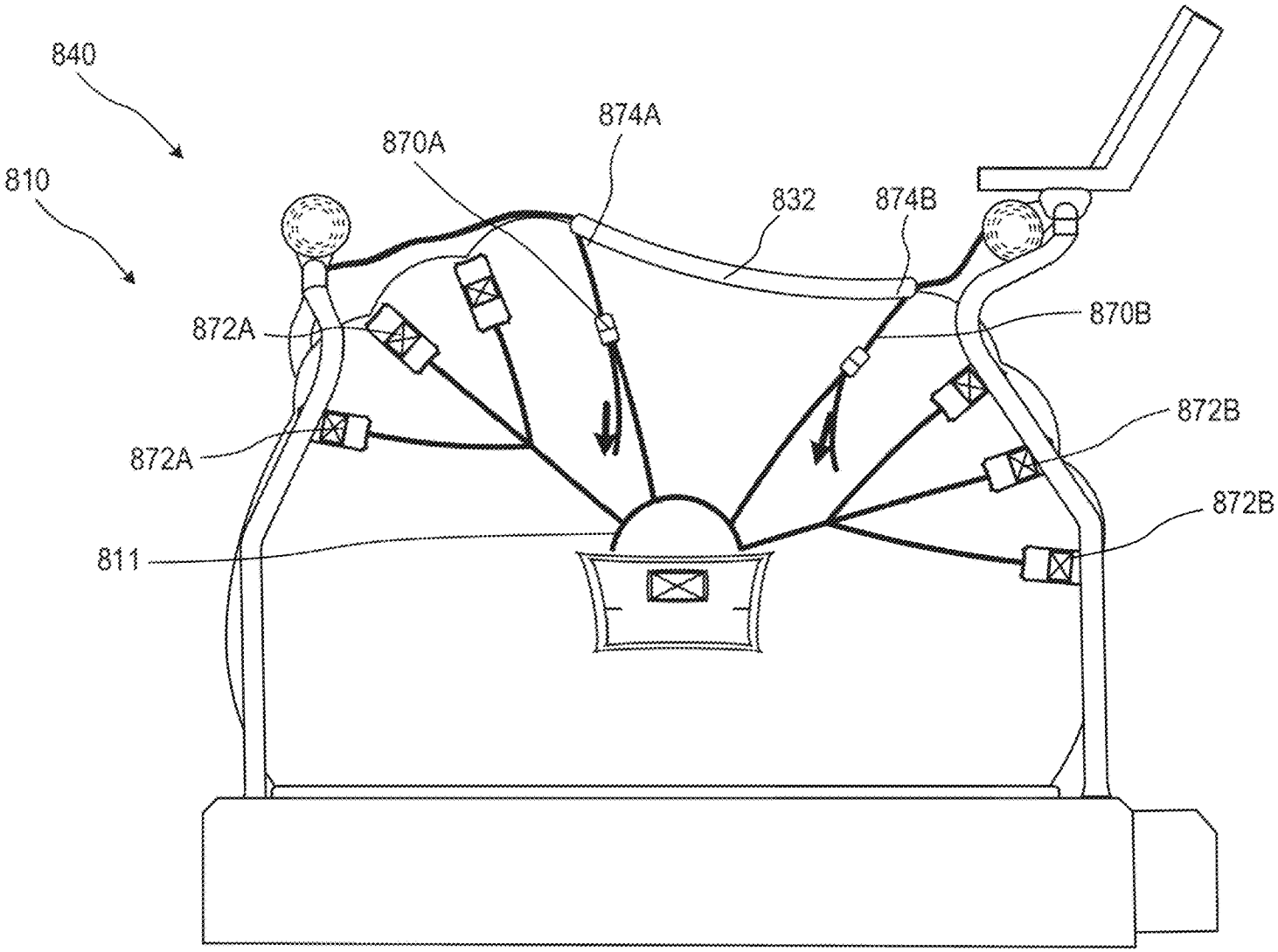
FIGS. 17 and 18 show a side view schematic representations of an inflatable enclosure having a combined height adjustment and reinforcement system including example arrangements of multiple, interconnected adjustable lift restraints for each side of the enclosure according to inventive concepts discussed herein, which are generally aligned along meridional stress lines of the enclosure.

FIG. 17 shows a DAP System and low hoop stress enclosure 810 having lift restraints 870A,B,A'&B' including opposing pairs of lift restraints disposed on opposite sides of seal frame 832, which is similar to other four (4) lift restraints arrangements discussed previously. However, each of the lift restraints extend from the second attachment 874A,B,A'&B' at the seal frame 832 to a center ring or loop 811 located at about a centerpoint of the enclosure as discussed above, which orients the lift restraints substantially along the meridional stress lines of the enclosure 810. In addition, each of the lift restraints loop around center ring 811 and attach to the enclosure at their respective first attachments 872A,B,A'&B' at a position proximate the hoop region of the enclosure 810. As such, each of the lift restraints form a second link that is also oriented in substantial alignment with meridional stresses of the enclosure. In addition, as shown in FIG. 17, the second leg of each lift restraint can branch to form several first attachments 872A, B,A'&B' along regions of the enclosure hoop. Thus, significant reinforcement, stabilization and/or height adjustments can be provided that are configured to act in concert with existing stress orientations and arrangements of the enclosure. Further, length adjustments implemented by the user in the first leg of each lift restraint can apply tensile stresses and adjustments corresponding with stress directions of the enclosure 810 and thereby cooperate with the enclosure arrangement to maintain robust features and independent supportability aspects of the enclosure.

Figure 18:
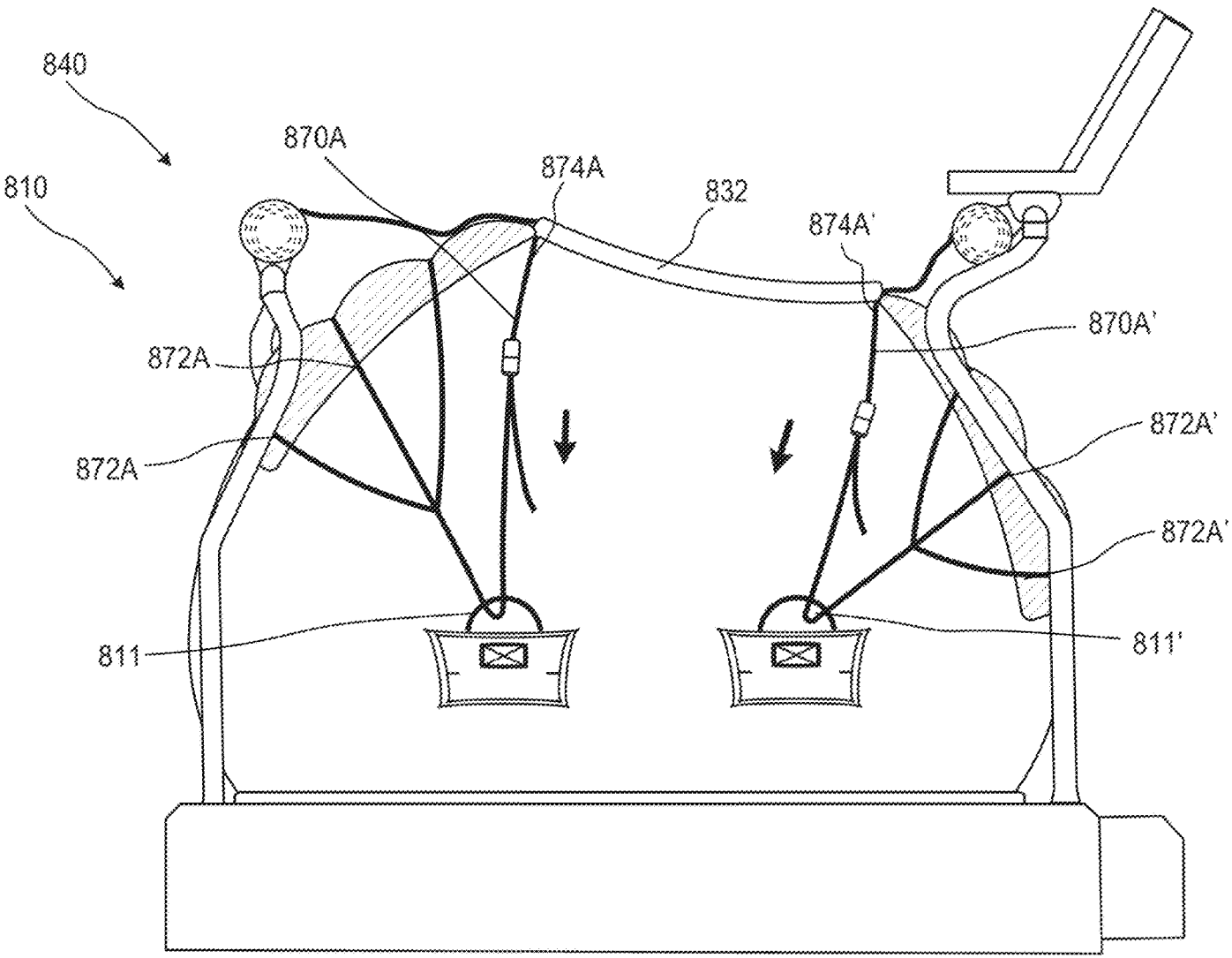
Figure 19:
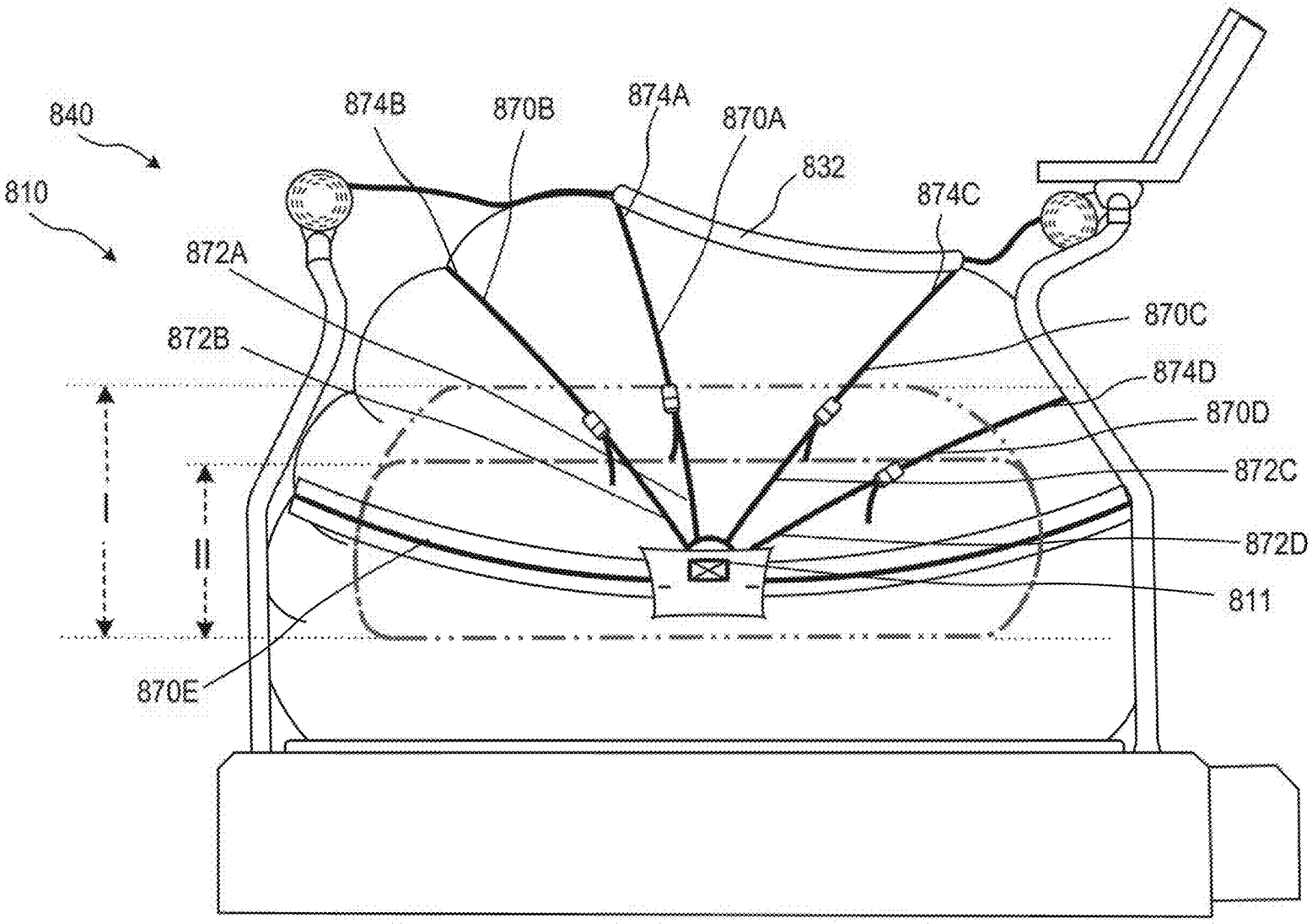
FIGS. 19 and 20 show side view schematic representations of an inflatable enclosure having a combined height adjustment and reinforcement system including example arrangements of multiple adjustable lift restraints for each side of the enclosure according to inventive concepts discussed herein, which are generally aligned along meridional stress lines of the enclosure.
Figure 20:
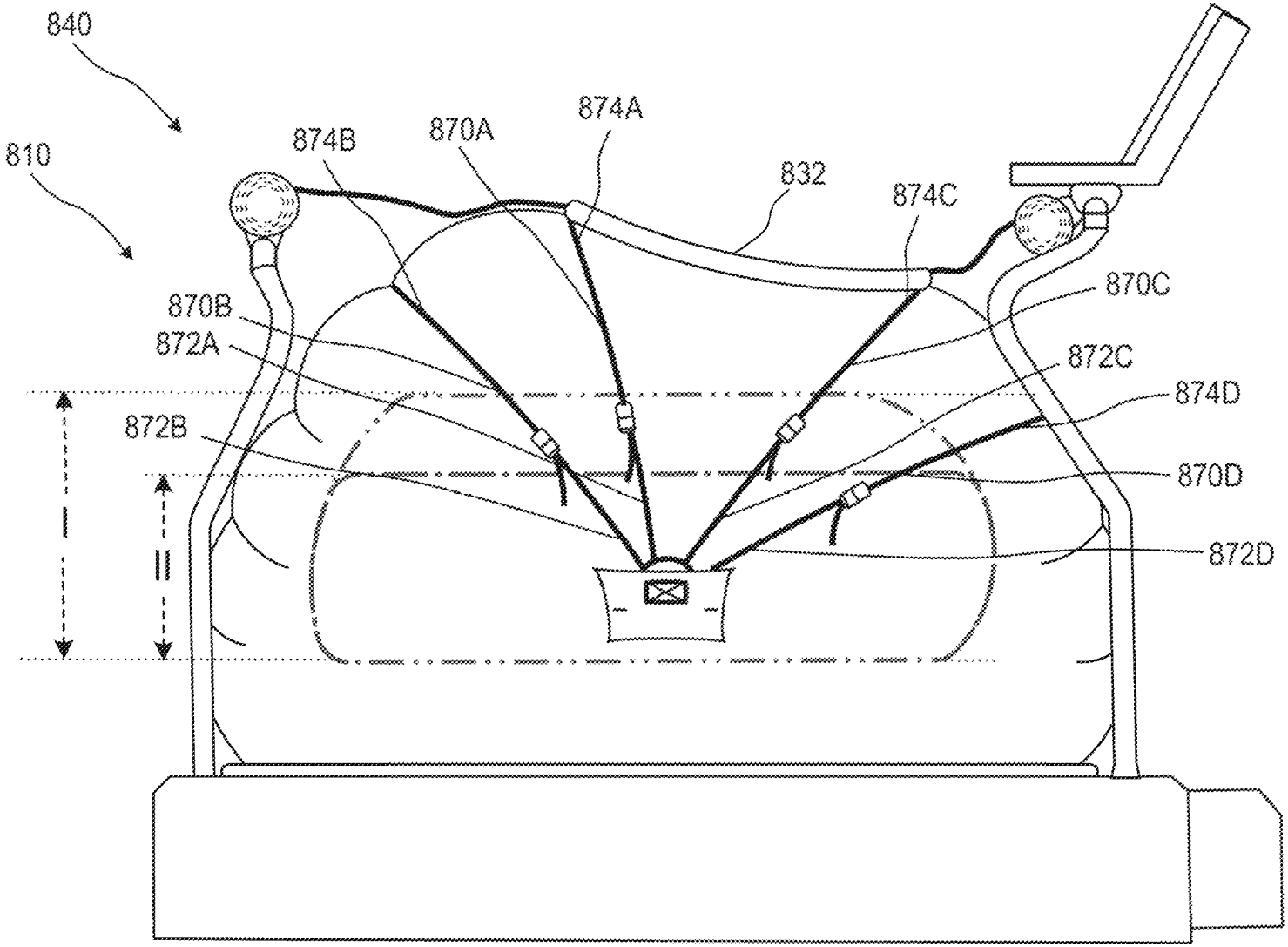

FIG. 18 depicts a similar arrangement as FIG. 17 for cooperating with beneficial aspects and features of the enclosure 810 in a similar manner as FIG. 17 but makes use of two center rings 811 and 811' for each side, which can provide customized adjustability of the seal frame 832 for the user, such as for tilt preferences. FIG. 19 depicts an optional arrangement having four lift restraints 870A,B, A'&B' extending to a center ring 811 in a manner similar to FIG. 17, but without looping back to the low-stress hoop region. Instead, additional lift restraints 870C,D,C'&D' are provided that extend between the center ring 811 and the hoop region of the enclosure, which as shown can also be adjustable for providing enhanced reinforcement, stability and/or height adjustment. Further, an additional circumferential restraint 870E extends about a central portion of the enclosure for reinforcing and stabilizing the independent support arrangement of the enclosure 810. As such, a highly reinforced and stabilized arrangement for enclosure 810 can be provided that include user customization and adjustability that cooperates with stress arrangements and features of the enclosure. FIG. 20 depicts a similar highly stable arrangement that is generally the same as the arrangement shown in FIG. 19, but without the circumferential restraint 870E.

Powered Bottom Height Adjustment Mechanisms

Figure 21:
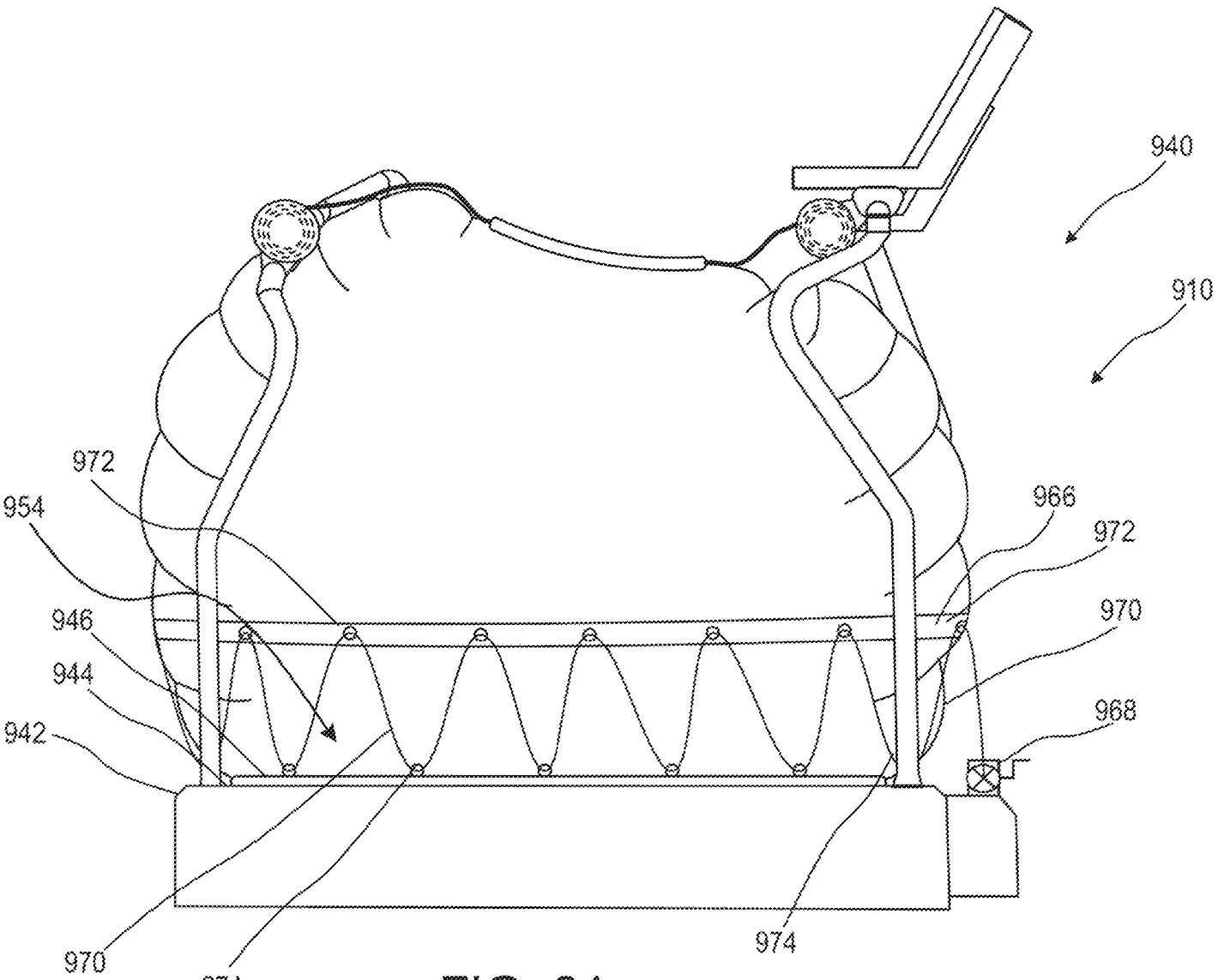
FIGS. 21-23 show a side view schematic representation of DAP Systems and inflatable enclosures having an automatic height adjustment system according to inventive concepts discussed herein, which includes an automated adjustment mechanism that operates at a bottom portion of the enclosure.
Figure 22:
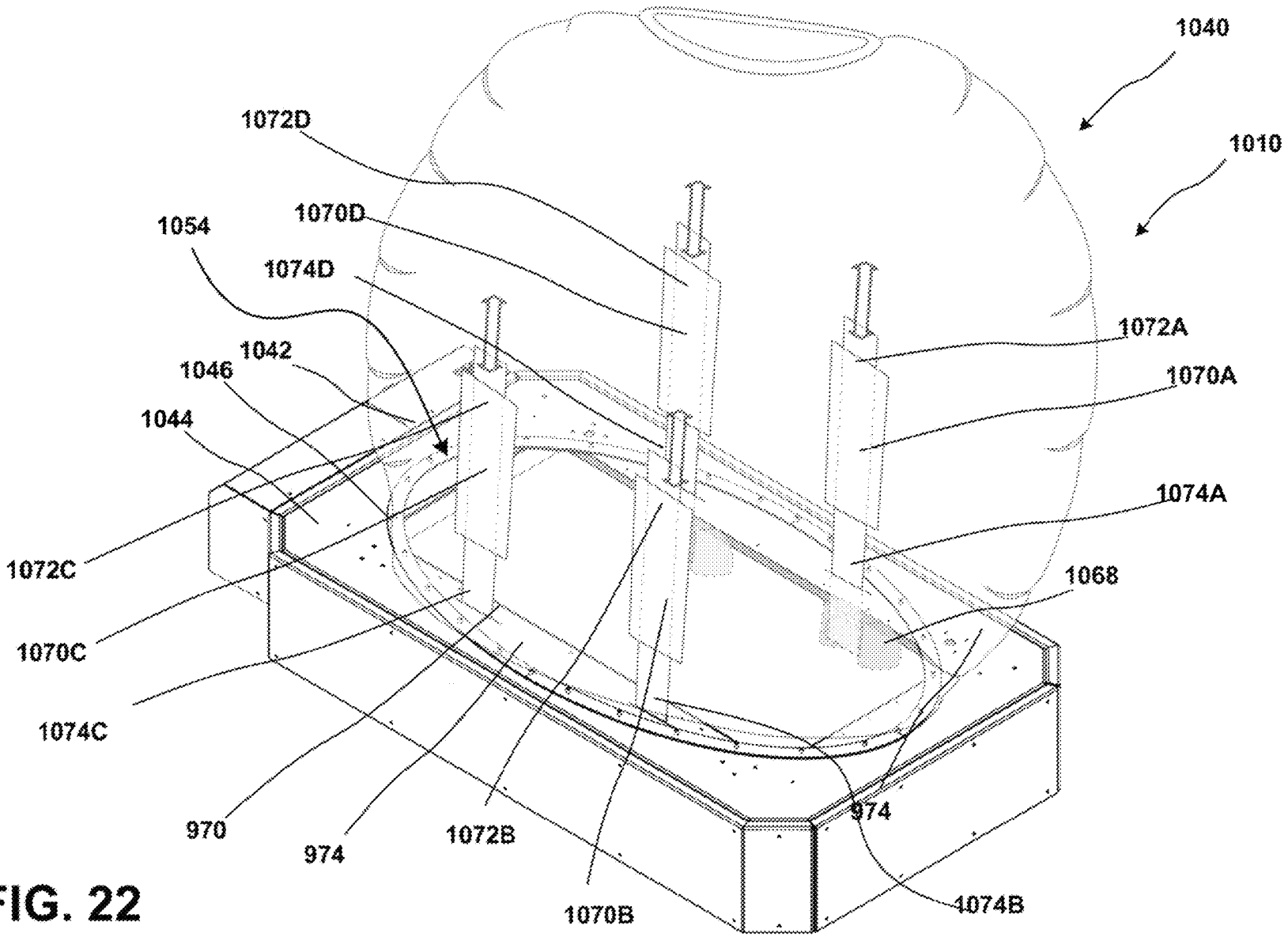
Figure 23:
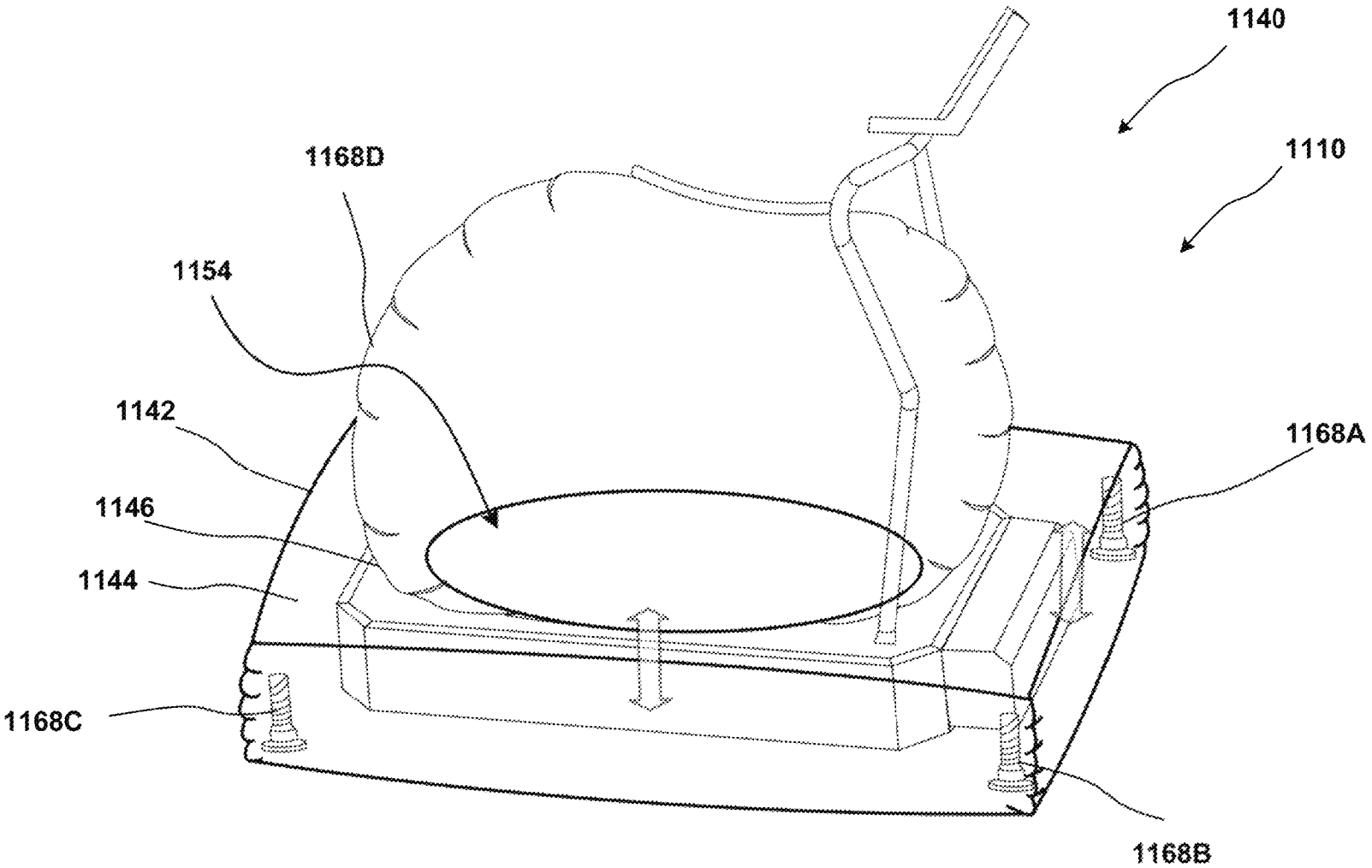

Referring now to FIGS. 21 to 23, DAP Systems 940 to 1240 and enclosures 910 to 1210 are shown that have the same general aspects and features as described above except as discussed hereafter. Accordingly, like numbers refer to like features. FIGS. 21 to 23 depict DAP Systems having automated or powered height adjustment mechanisms that can, for some configurations, operate similar to the manual, bottom lift restraints mechanisms described along with FIGS. 3A & 3B and 6A & 6B. As discussed above, bottom lift restraints can apply tensile forces to a bottom portion of the enclosure and thereby collapse a base section of the enclosure to reduce enclosure height. DAP Systems 910 and 1010 described hereafter along with FIGS. 21 and 22 can operate in a similar manner using powered controls. As described, the powered controls can operate to lower and collapse a bottom portion of the enclosure by uniformly applying force around the enclosure perimeter.

With particular reference to FIG. 21, DAP System 940 includes a support platform 942 having a support surface 944 that forms a base support 946 to which base opening 954 of enclosure 910 is securely attached. A circumferential attachment strap 966 can be sewn around a perimeter of the enclosure at a bottom portion of the enclosure 910. A plurality of bottom lift restraints 970 can be arranged to extend from a first attachment 972 at the enclosure wall down to a second attachment 974 with the support platform 942. One or more powered control devices 968 can be arranged for reducing lengths of the bottom lift restraints 970 at substantially the same time and thereby lower a bottom portion of the enclosure simultaneously and uniformly. As shown along with FIG. 21, such a control device can include one or more stepper or gear motors 968 and the like in a control arrangement with bottom lift restraints 970, such that lengths of the bottom lift restraints can be reduced together for lowering the enclosure. The arrangement of FIG. 21 includes arrangements of the bottom lift restraints extending in a zig-zag alternating manner between the circumferential attachment strap 966 and the support platform 942, such that only one or a few control devices 968 operate for reducing the lengths of multiple bottom lift restraints or lengths of bottom lift restraint connections extending between strap 966 and support platform 942, and to do so at the same time.

Figure 33:
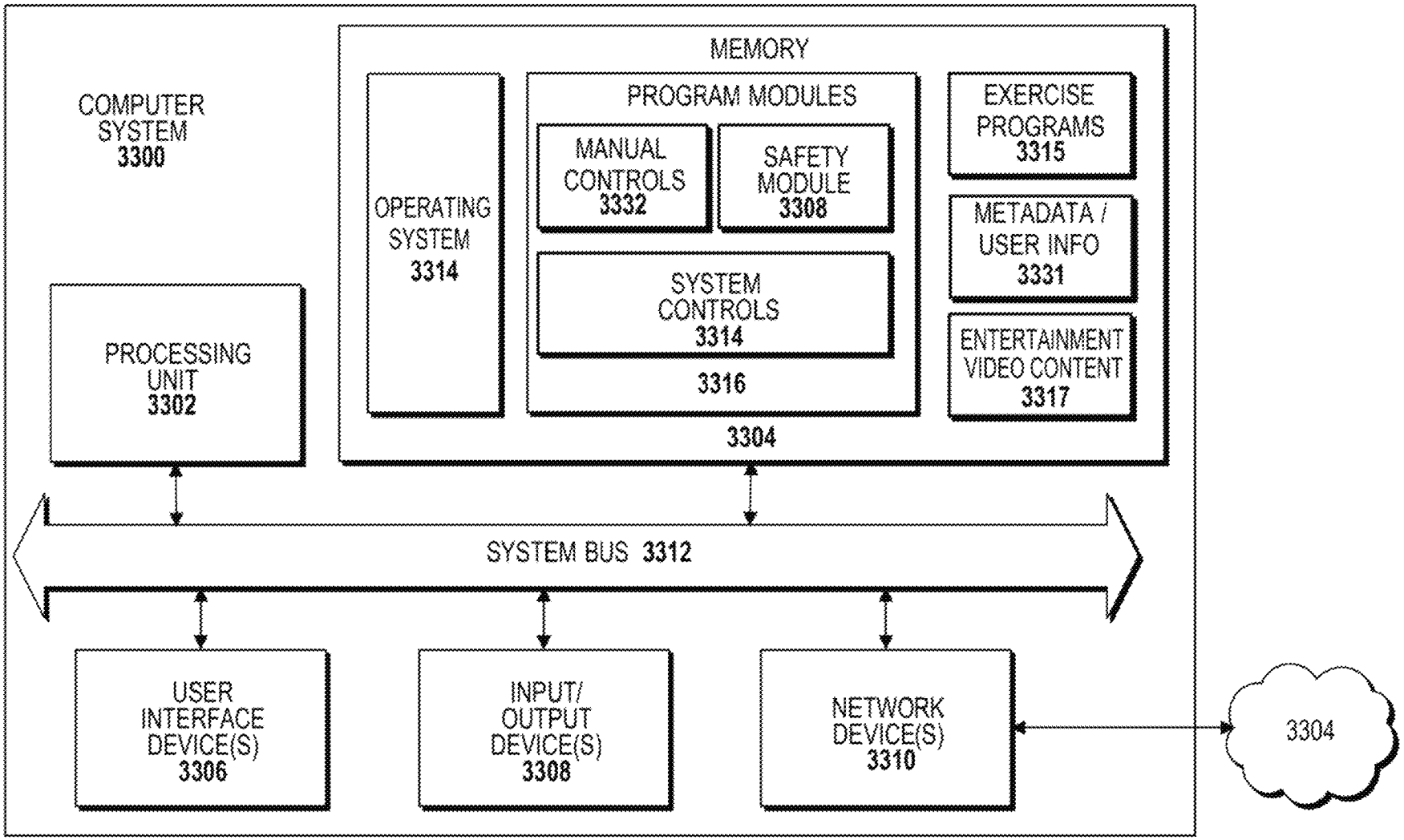
FIG. 33 is a schematic representation of a computer system for controlling an example DAP system according to aspects and features of various examples and inventive concepts discussed herein.

As discussed hereafter along with FIG. 33, a DAP System computer can be configured to provide instructions to the control device(s) for implementing height adjustments including collapsing a bottom portion of the enclosure for reducing height of the enclosure along with controlling other functional aspects of DAP System 940. Similar to the arrangement discussed along with FIGS. 5A and 5B, it is understood that bottom lift restraints 970 can be used along with other lift restraint devices and systems and can operate as supplemental or coarse height adjustment mechanisms. Such arrangements can cooperate with other lift restraint mechanisms that also adjust enclosure height and provide other functions, such as reinforcement or stabilization. Such arrangements can also cooperate with safety mechanisms where the safety mechanism define a minimum height of the enclosure. In such a zig zag arrangement the angle between the base and the adjustment cord can be between the ranges of 20 and 70 degrees to allow for smooth and even adjustment.

Referring now to FIG. 22, DAP System 1040 likewise includes a support platform 1042 having a support surface 1044 that forms a base support 1046 to which base opening 1054 of enclosure 1010 is securely attached. A plurality of bottom lift restraints including, for the example shown, an arrangement of four lift restraints 1070A,B,C&D can be arranged within the interior and/or exterior of enclosures 1010 for applying downward tensile forces to a bottom portion of enclosure 1010 and thereby providing height adjustment for the enclosure, which can include collapsing a height of the enclosure at its base. Each restraint includes a first attachment 1072A-D attached to the enclosure wall at a distance above the support platform and an opposite second attachment 1074A-D attached to an interior region of the support platform 1042, in which a control device 1068 can be located. The control device 1068 can include, for example, a powered coil roller for each lift restraint.

In a similar manner as discussed above with DAP System 940, each control device 1068 can be controlled for simultaneous operation by a system computer (not shown). In this manner, uniform simultaneous height adjustments can be implemented, which can include coarse, supplemental and/or preliminary adjustments. The use of bottom lift restraints can be desirable for use as a supplement along with other adjustment mechanisms, at least because downward height adjustments in this manner can operate by collapsing a portion of the enclosure at its base. Repeatedly collapsing and raising, or iteratively collapsing bottom portions of the enclosure, can risk impairing structural integrity of enclosure. As such, it can be beneficial for automated base height adjustments to be used primarily along with other supplement or fine-tune height adjustments. That said, the use of such uniformly controlled and operated height adjustment mechanisms can nonetheless be beneficial for quickly modifying the enclosure height and reduce it to a desired height range for a user, as well as for doing so automatically. In addition, an internal attachment arrangement for lift restraints 1070A-D can act to draw internal portions of the enclosure inward in a manner that resists natural bulge tendencies of enclosures during use—particularly in response to downward height adjustments.

Referring now to FIG. 23, a DAP System 1140 and enclosure 1110 are shown for providing powered, automatic enclosure height adjustment functionality. Unlike other arrangements discussed herein, DAP System 1140 can provide height adjustment operations without relying upon flexible lift restraints—at least for supplemental adjustments that can be implemented via the base platform 1142. The base platform 1142 can be configured to provide powered lift and lowering operations for vertically moving the support surface 1144 and base support 1146 vertically with respect to the exercise device (not shown) located within the support platform. As such, DAP System generally includes control devices 1168A-D, such as powered screw lift mechanisms, which can be simultaneously controlled in a similar manner as the control devices of FIGS. 21 and 22 for uniformly raising and lower the base support and enclosures with respect to the exercise device (not shown). Similar to the height adjustment operations of FIGS. 21 and 22, height adjustment operations incorporated within the platform 1142 of DAP System 1140 can operate as a supplemental or coarse adjustment mechanism configured to cooperate with other lift restraint mechanisms.

External Lift/Support Restraint Mechanisms

Referring now to FIGS. 24 to 30B, DAP Systems and enclosures are shown having reinforcement, stabilization and/or enclosure height adjustment mechanisms that include flexible restraints attached to the top frame at their respective second attachment, which are attached at their respective second end to an external control device. The external control device can include at least one control device located on opposing lateral sides, multiple control devices disposed in arrangements around the perimeter portions of the enclosure, and/or other beneficial arrangements including arrangements of four (4) control devices. An arrangement of four (4) control devices can include control devices generally arranged at corner locations around the DAP System, which can correspond with spoke-like arrangements of four (4) lift restraints that have been described above with various example arrangements and systems. An arrangement of two (2) control devices can include control devices generally arranged at the sides of the enclosure in the general vicinity of the opening where the user is positioned as well as in FIG. 25A.

In many cases, an advantage of flexible members connecting top frame 1232 (or similar members in other figures) to the lifting mechanism with a flexible member is that the lifting mechanism or column can be at a reduced height. For example if the lifting mechanism is stopped 12 in above the top surface of the exercise device, the flexible member can allow the top frame to continue to drop all the way down to the flexible surface. Conversely, the lifting mechanism can be stopped for example 36 in above the top surface of the exercise device, and the flexible member, if it allows for 12 in of vertical travel as in the previous sentence, can rise to 48 in when pressurized. This reduction in necessary travel of the lifting mechanism can reduce material costs compared with designs involving vertical travel for a full range of height of the enclosure and allows for standard sizing of components such as lead screws. For example, if lift restraints are attached at a first connection end to a vertical lift mechanism such that an opposite second connection end attached to a seal frame spans 12 inches from the first connection end to the second connection end, a lead screw effective length of 36 inches and corresponding lift range can support five feet or sixty inches of vertical motion (36 inches+12 inches+12 inches).

Yet another benefit of the limited travel of the lifting mechanism and flexible member configuration is that if a user or technician is working on the exercise device, and the lifting mechanism lowers unintentionally, they cannot get crushed by the top frame because the flexible member will allow the top frame to stay above the lifting mechanism (by as much as 12 inches in the previous example) and the lifting mechanism itself is already spaced off the top surface by, for example, 12 inches, allowing for 24 inches of space between the exercise machine surface and the top frame, which is plenty of space not to crush a human.

The control devices are configured as vertical lift devices proximate a DAP System and enclosure, but which lack rigid connections or attachments with the enclosure that can interfere with complex, dynamic characteristics of inflatable enclosures actively providing unweighting support for a user during exercise activities, or that interfere with balanced, self-supportable enclosure arrangements. The enclosure arrangements maintain their functional characteristics as hollow, thin-shell, air columns that carry stresses through enclosure walls between the base support and seal frame, and which provide upweighting forces to the seal frame and user through the same despite connections with the control devices. Rather, vertically-adjustable control devices having flexible restraint connections with the seal frame are configured to provide enhanced combinations of beneficial features for stabilization, reinforcement and height adjustment mechanisms for the enclosure.

Further, as can be seen along with the examples of FIGS. 24 to 30, restraint connections with the vertically-adjustable control devices merely enable applications of tensile forces to the seal frame being supported by the enclosure. Applicants' complex analyses of inflatable enclosure configurations, research and development of independently-supportable balanced-force enclosures and understanding regarding balanced applications of tensile forces to the top frame provide innovative mechanisms for stabilizing and influencing operations of such enclosures without interfering with their structural integrity and support parameters. For example, rather than applying any tensile forces directly contrary to unweighting stresses carried within the enclosure skin, the vertically-adjustable control devices are configured to provide opposing, outboard oriented tensile forces to the top frame, which can act to adjust height of an inflatable enclosure similar to applying downward force to a top portion of a ball can reduce its height. In other words, the example arrangements of FIGS. 24-30 cooperate with support parameters and unweighting forces applied by enclosure arrangements for DAP Systems rather than attempt to rigidly restrain or conflict with force parameters of the enclosures.

Accordingly, with continued reference to FIGS. 24 to 30, DAP Systems and enclosures are shown that generally includes aspects and features described above for other DAP Systems and enclosures, except as noted hereafter. As such, like numbers refer to like features. Each of the DAP Systems and enclosures of FIGS. 24 to 30 include arrangements of lift restraints attached at a second attachment to a seal frame. Further, these systems and enclosures include such lift restraints having outboard oriented connections with a vertically-movable control device extending from the seal frame, such that enhanced stabilization, reinforcement and height adjustment benefits can be provided for the enclosure.

Figure 24:
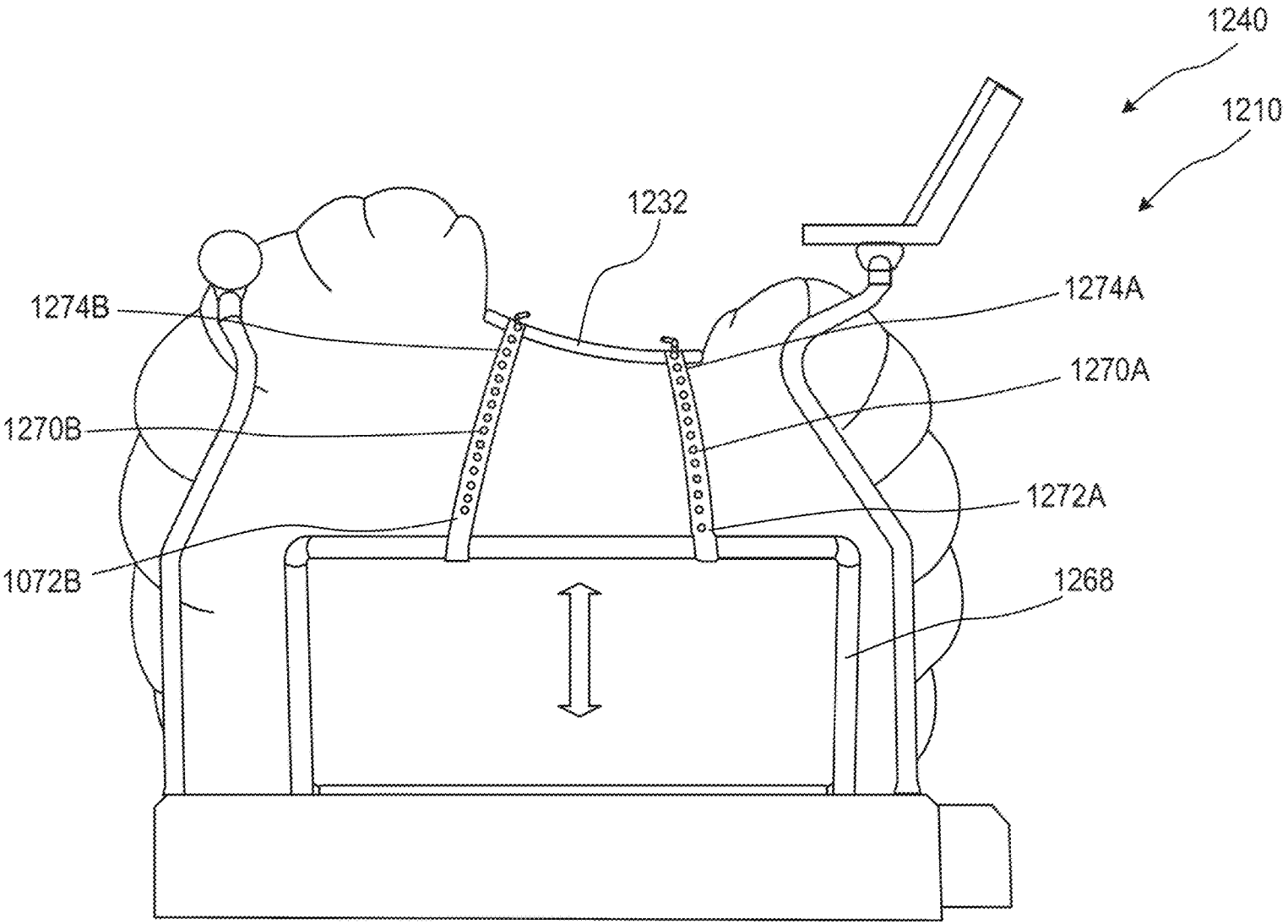
FIG. 24 shows a side view schematic representation of an inflatable enclosure having a combined height adjustment and reinforcement system including a further example arrangement of four (4) adjustable lift restraints configured as supplemental restraints according to inventive concepts discussed herein, which includes a different enclosure attachment arrangement for the supplemental restraints in comparison with previous examples and is based on a powered, movable vertical support along each side region of the DAP System.

Referring now to FIG. 24, DAP System 1240 and enclosure 1210 are generally shown having an arrangement of four (4) flexible lift restraints 1272A,B,A'&B' attached to seal frame 1232 at a second attachment 1274A,B,A'&B' similar to the example arrangement shown along with FIGS. 9A & 9B, except that each first attachment 1272A,B,A'&B' extends outboard and connects with a vertically movable control device 1268,1268' located along each lateral region of enclosure 1210. Each of the vertically-movable control devices 1268, 1268' can be configured to move vertically in response to support, reinforcement, height adjustment and/or other factors related to the operation of the enclosure and preferences or needs of the user, which can be controlled via a DAP System computer as described along with FIG. 33.

Figure 25A:
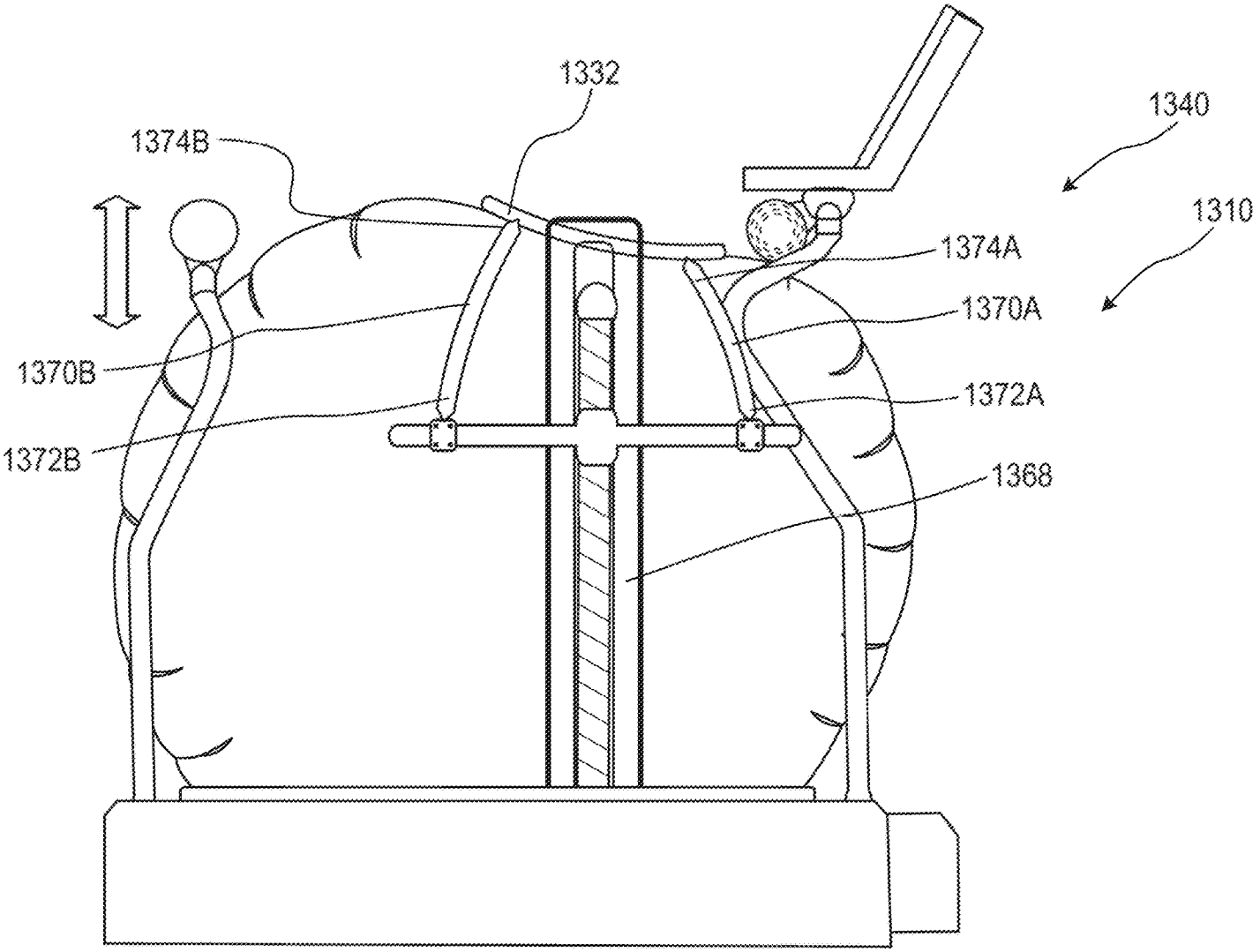
FIG. 25A is a side view schematic representation of an inflatable enclosure having a combined automatic height adjustment and reinforcement system according to inventive concepts discussed herein including a further example arrangement of a powered adjuster mechanism without showing safety restraints, a rear safety bar, or optional lift restraints, which includes a different enclosure attachment arrangement for the supplemental restraints in comparison with previous examples and is based on a powered, vertically movable adjustment bar along each side region of the DAP System.
Figure 25B:
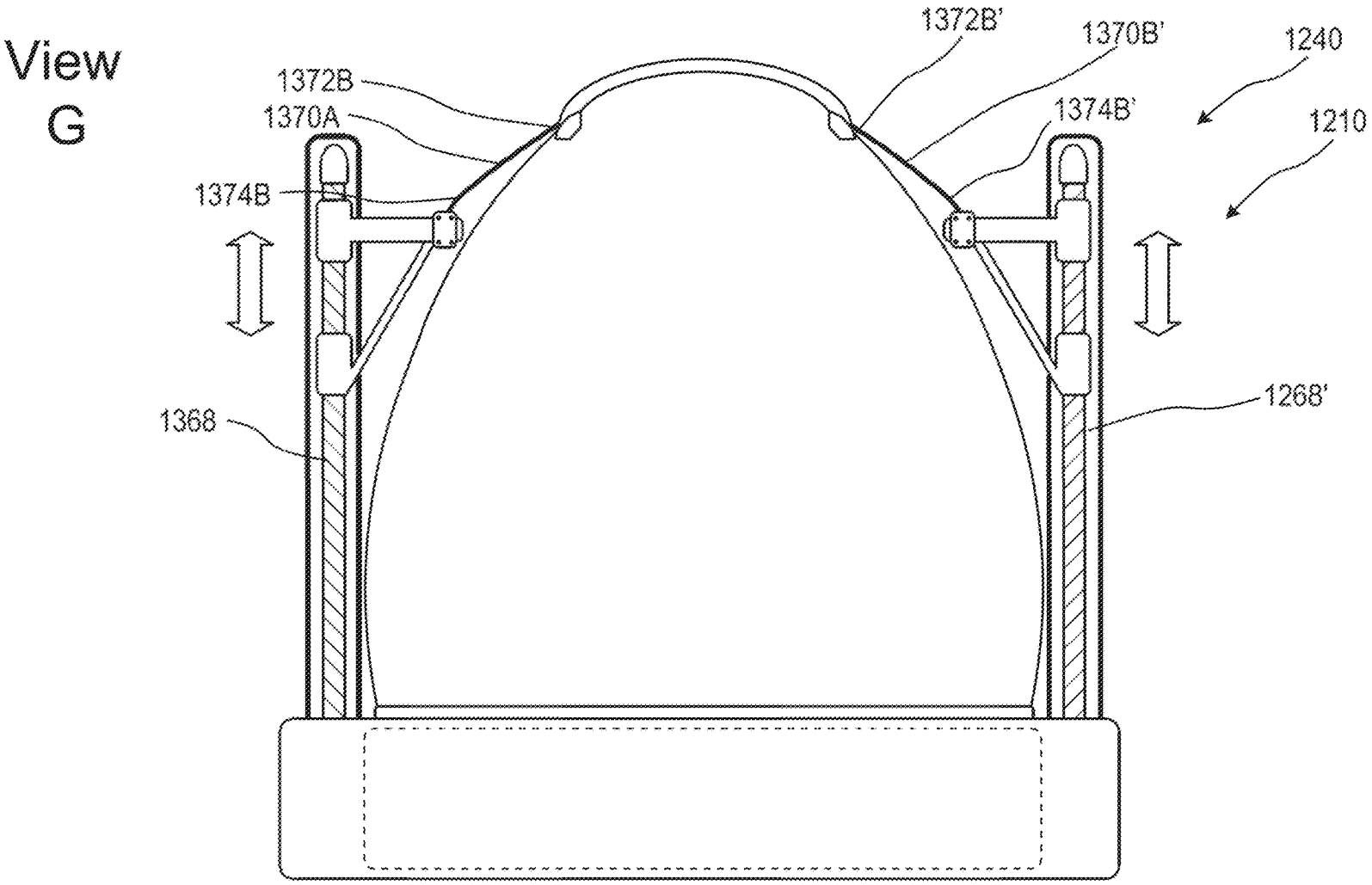
FIG. 25B is a cross-sectional view of the DAP system of FIG. 25A.
Figure 26A:
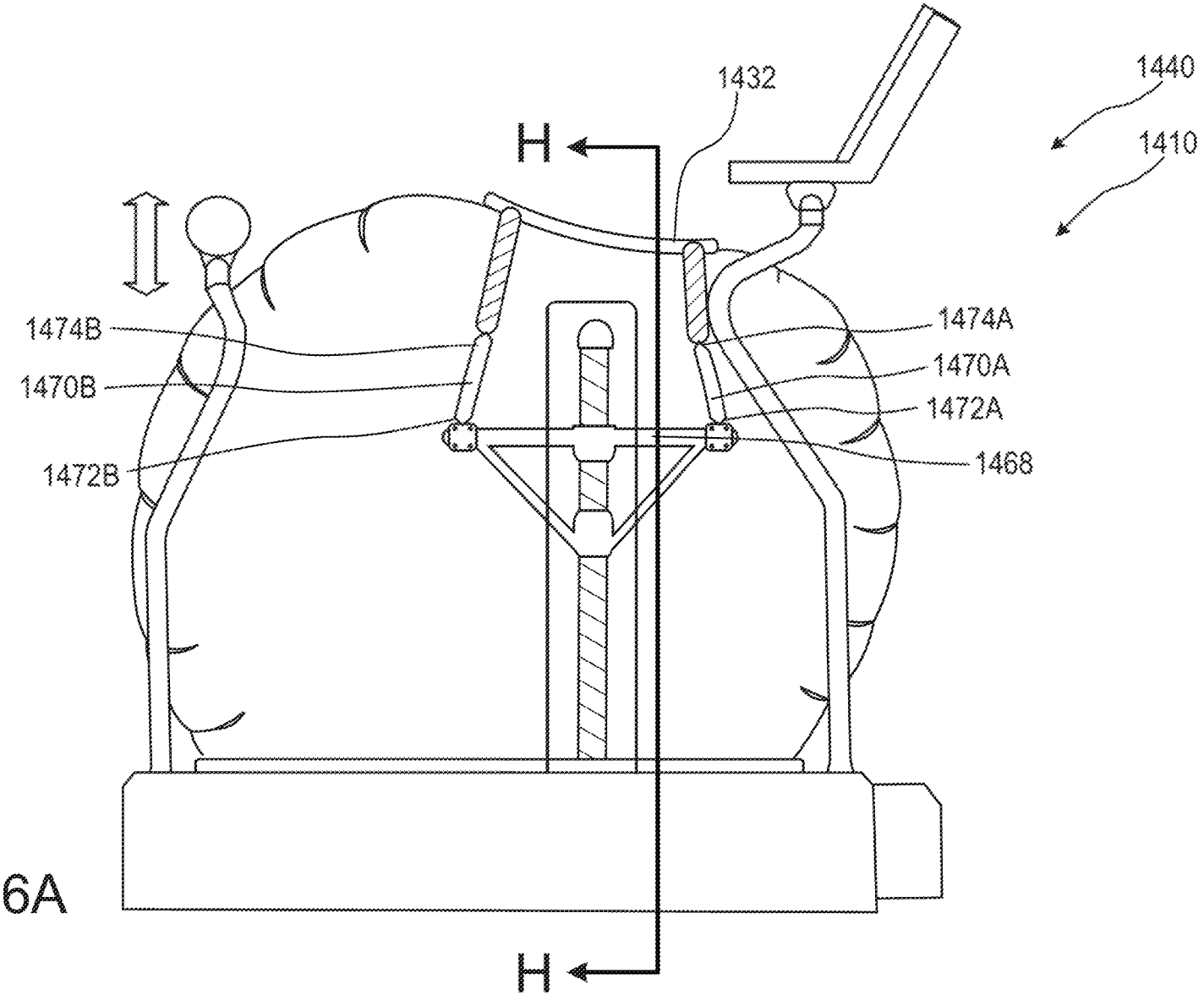
FIG. 26A shows a side perspective view schematic representation of an inflatable enclosure having an automatic height adjustment system according to inventive concepts discussed herein including an additional example arrangement of two (2) adjustable lift restraints without showing safety restraints or safety bars and four (4) supplemental restraints according to inventive concepts discussed herein, which includes a different enclosure attachment arrangement and location for the adjustable lift restraints in comparison with previous examples along with having supplemental restraints, which is a powered retractable lift restraint system having a pair of lift restraints extending externally upward from the DAP base to exert upward and downward forces on the enclosure along with safety and vertical supports.
Figure 26B:
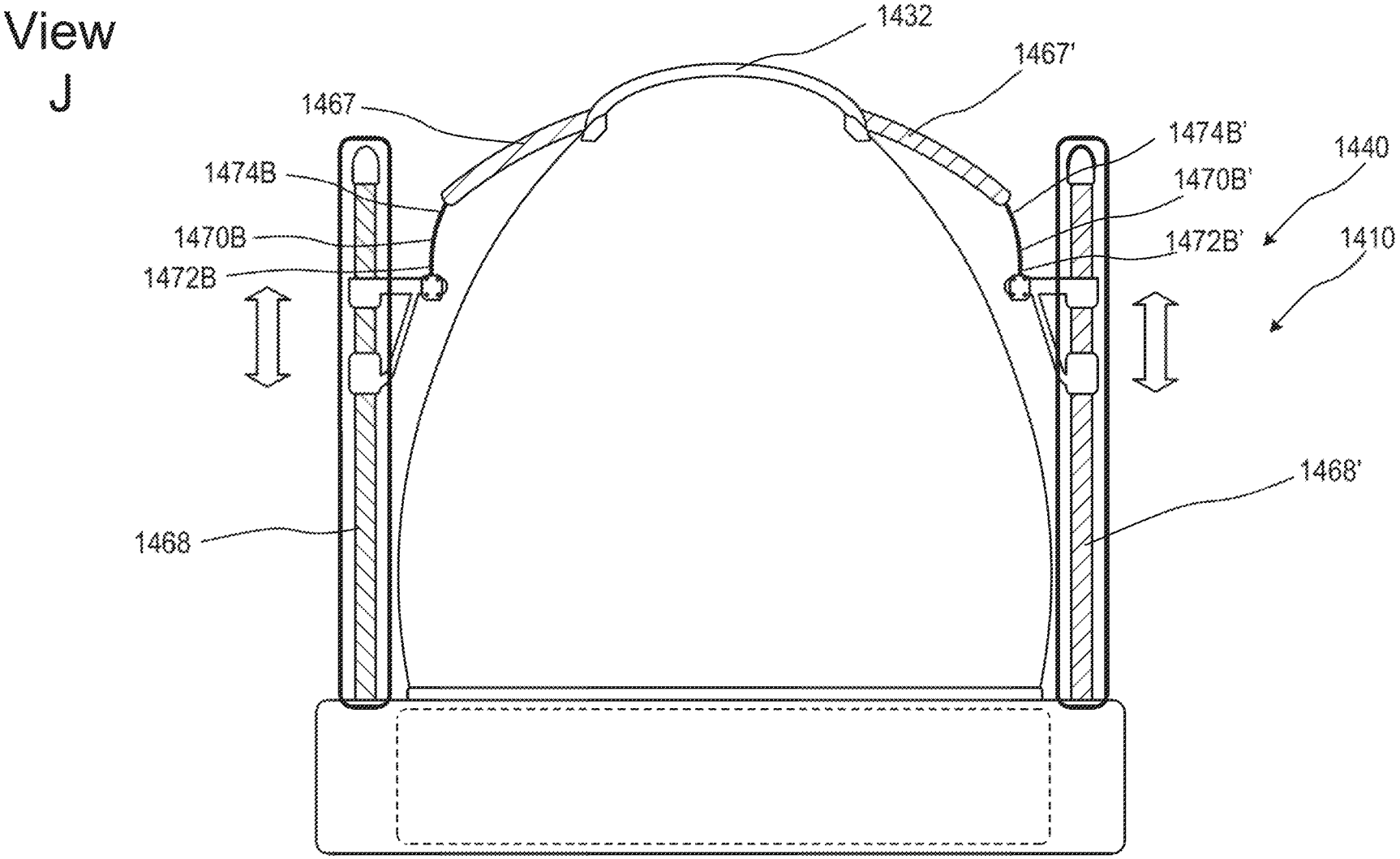
FIG. 26B is a cross-sectional view of the DAP system of FIG. 26A.
Figure 27B:
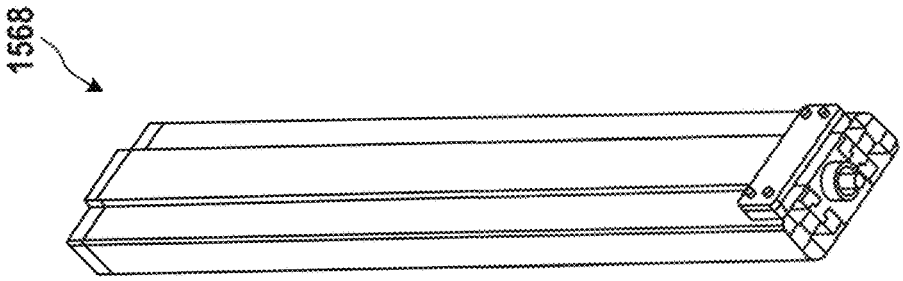
FIG. 27B is a perspective view of the lift mechanism.
Figure 27A:
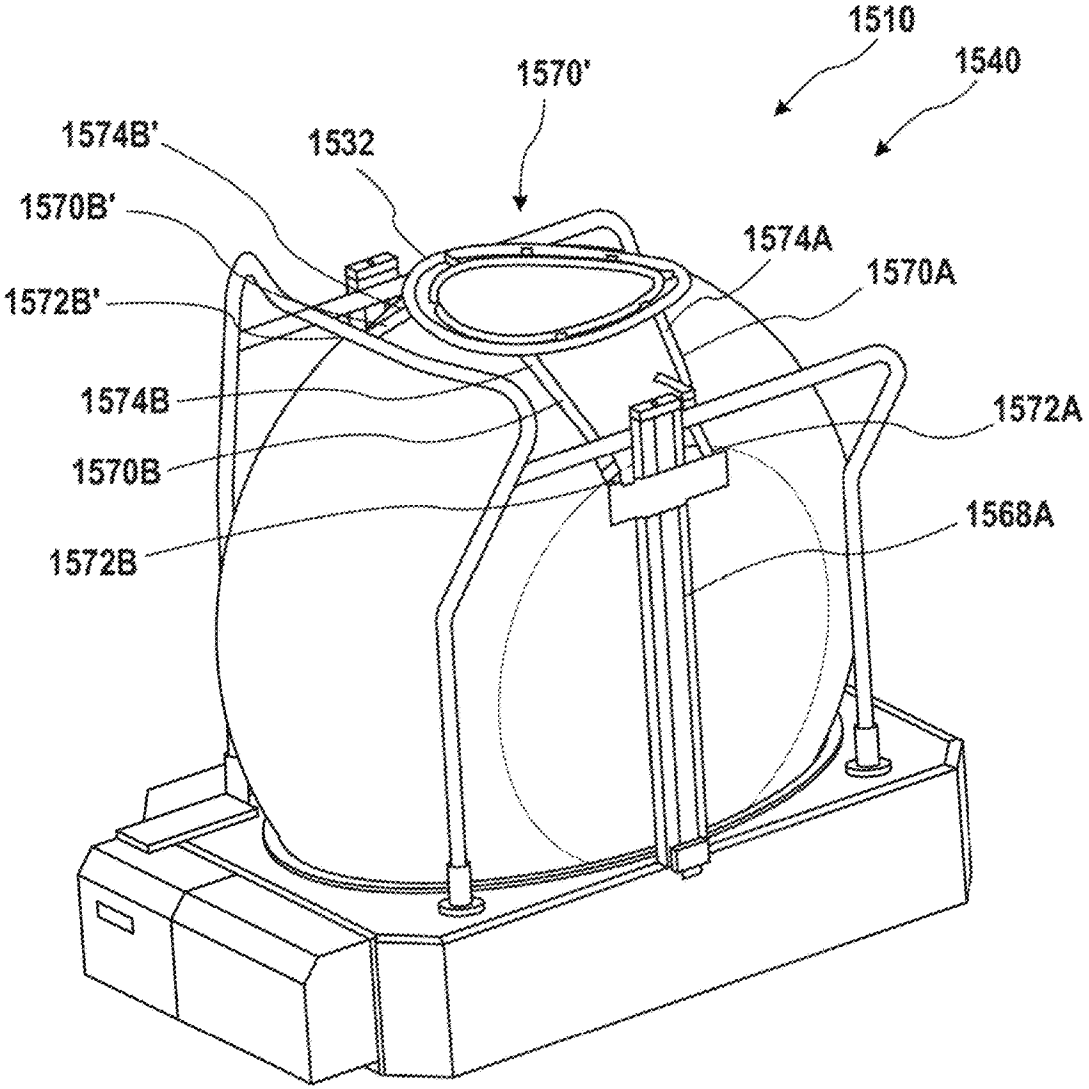
FIG. 27A is a schematic front perspective view showing of a further DAP System and enclosure having a pair of lift mechanisms along the lateral portions of the enclosure according to aspects and features of various examples and inventive concepts discussed herein.

Referring now to FIGS. 25A & 25B along with FIGS. 26A & 26B, DAP System 1340 and enclosure 1310 are generally shown having an arrangement of four (4) flexible lift restraints 1372A,B,A'&B' attached to seal frame 1332 at a second attachment 1374A,B,A'&B', which likewise extends outboard and connects with a vertically movable control device 1368,1368' located along each lateral region of enclosure 1310. Similar to the configuration of DAP System 1240 of FIG. 24, each of the vertically-movable control devices 1368, 1368' can be configured to move vertically in response to support, reinforcement, height adjustment and/or other factors related to the operation of the enclosure and preferences or needs of the user, which can be controlled via a DAP System computer as described along with FIG. 33. Further, each of vertically-movable control devices 1368, 1368' can be configured as powered screw-driven lift devices, which can quickly and accurately move upward and downward under precise controls provided by the computer system described along with FIG. 33. FIGS. 26A & 26B shows a DAP System and enclosure similar to the arrangement of FIGS. 25A& 25B, except with respect to the seal frame 1432. Accordingly, like numbers refer to like features. As shown, seal frame 1432 includes pairs of lateral extensions 1467 and 1467' to which the flexible lift restraints can attach at their second attachment 1474B,B'. The extensions 1467 and 1467' can provide an attachment angle between the seal frame and flexible lift restraints that can be close to ninety degrees for providing enhanced downward tensile force components to the seal frame along with imparting height adjustments. Angles for the flexible member can be between 20 and 90 degrees with respect to the horizon plane, depending on factors, such as strength of the strap where a generally more horizontal angle will increase strap tension according to trigonomics. Further, desired angles for the flexible member can be 30 and 70 degrees and more precisely about 40 to 60 degrees. FIG. 26A,B show the lifting mechanism on the inside of the columns, but the lifting mechanism may also be on the outside of the columns so as not to scratch or damage the enclosure when it moves up and down. As such, the extensions 1467, 1467' may be increased further as needed to maintain reasonable forces in the flexible member during inflation.

Referring now to FIGS. 27A to 29B, DAP System 1540 and enclosure 1510 are generally shown having an arrangement of four (4) flexible lift restraints 1572A,B,A'&13' attached to seal frame 1532 at a second attachment 1574A,B,A'&B', which likewise extends outboard and connects with a vertically movable control device 1568,1568' located along each lateral region of enclosure 1510. DAP System 1540 generally includes the same aspects and features of DAP Systems 1340 and 1440 described above except as shown and discussed hereafter. DAP System 1540 includes vertically movable control devices 1568 and 1568' each having an external driven slide 1569 (FIG. 28) that can be disposed on an external, outboard side of the driven slide with respect to the enclosure 1510. Accordingly, inadvertent contact can be avoided with outer portions of the enclosure wall during vertical movements that can potentially pinch or otherwise weaken outer portions of the enclosure wall. However, control devices 1568 and 1568' can be spaced apart and arranged to avoid any contact with outer walls of the enclosure. Nonetheless, such an outboard arrangement of the control devices 1568 and 1568' can further avoid any potential inadvertent contact to further protect long-term integrity of the enclosure, and avoid contacting a user who may be grabbing the internal surfaces of the lifting column for support.

Figure 28:
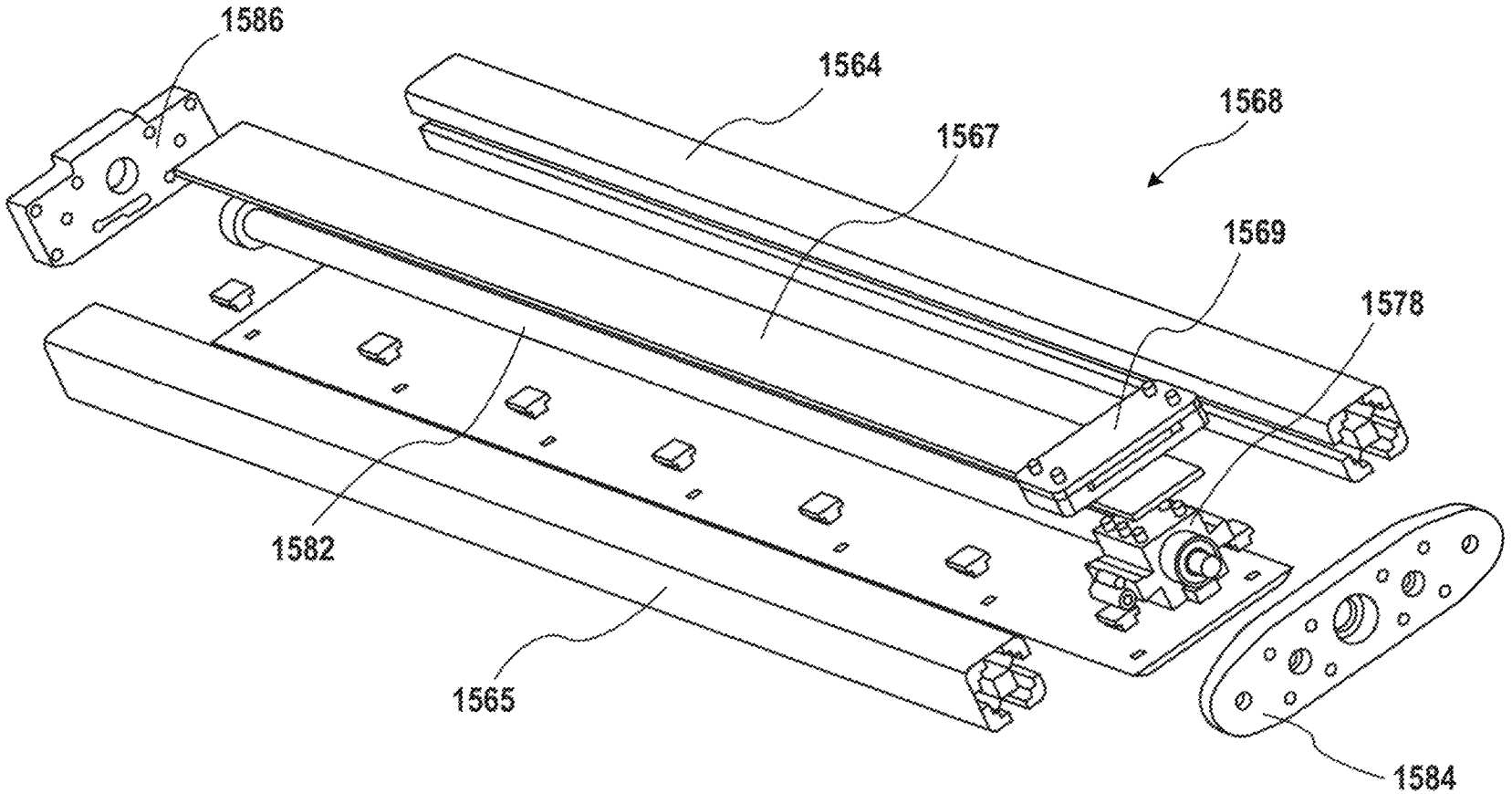
FIG. 28 is an exploded perspective view of the lift mechanism of FIG. 27A.
Figure 29B:
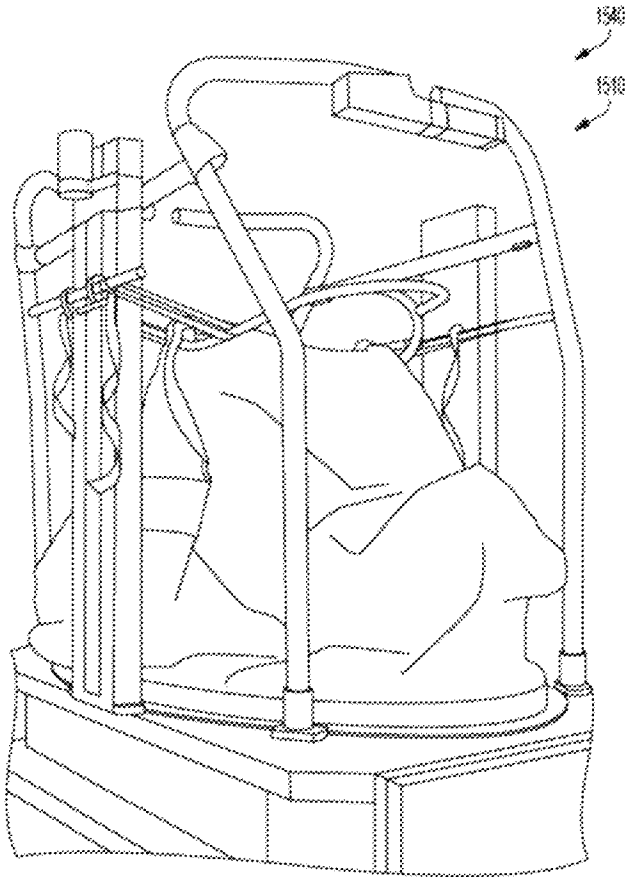
FIGS. 29A and 29B are front perspective views of the DAP System and enclosure of FIG. 27A.
Figure 29A:
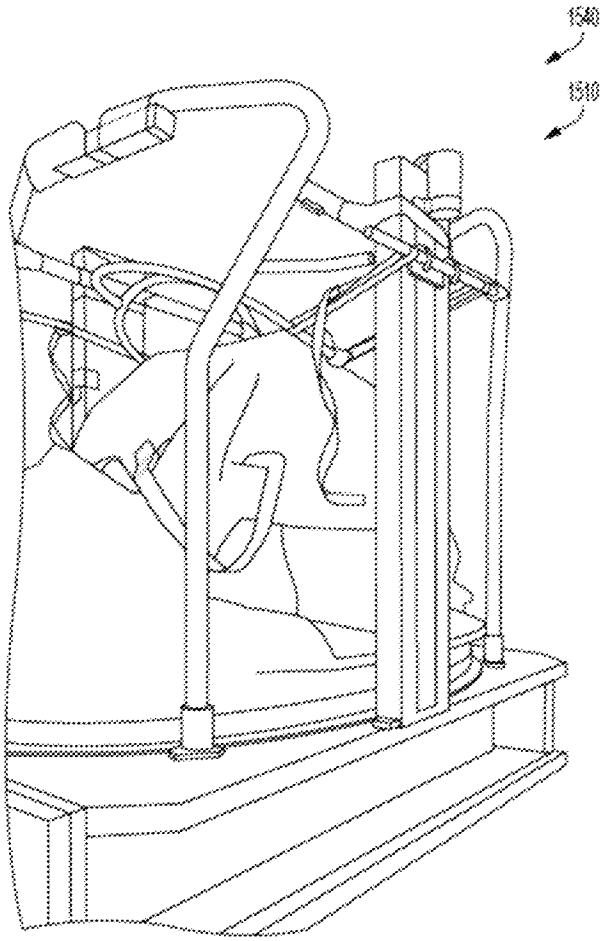

Referring to FIG. 28, an exploded view of an example control device 1568 is generally shown. Control device 1568 includes a pair of spaced apart, opposing vertical side rail supports 1564 and 1565 and a vertical inboard wall 1587 extending therebetween and oriented toward the enclosure during use, which protects against contact with the enclosure wall. A vertical central rail 1567 is disposed opposite the inboard wall 1587 and likewise extending between the side rail supports 1564 and 1565 about which a driven slide 1569 translates vertically during use for controlling tensile forces imparted on the seal frame 1532 via lift restraints 1570A, B,A'&B'. A drive screw 1582 is vertically and rotatably retained within the control device 1568 extending parallel with the vertical central rail 1567 between an opposing top cap 1584 and bottom cap 1586. A drive slide 1578 forms a threaded connection about the drive screw 1582 for movement along the drive screw 1582, which is connected to driven slide 1569. A drive motor (not shown) controls rotations of drive screw 1582 for accurately and quickly controlling vertical movements of drive slide 1578 along the drive screw and, thereby, vertical movements of driven slide 1569 and lift restraints 1570A,B,A'&B' connected thereto. Cooperative groups of the control devices including control device 1568 and 1568' can be vertically controlled substantially in unison for controlling tensile forces imparted about the perimeter of the seal frame 1532 to operate collectively with first attachments 1572A,B,A'&B' disposed at about the same overall heights. However, it is understood that height differentials can be selectively applied for desired results, such as to impart tilt or other preferences on the seal frame 1532 for a user. The drive screw and corresponding nut may have a pitch angle such that the mechanism is not back-drivable. In this manner, the motor does not need to compensate for the high loads imparted by the enclosure on the top frame and thus carried through the drive screw. A safety method of height adjustment may therefore be to check the pressure inside the enclosure to ensure it is below a predetermined safety limit before allowing activation of the lifting columns as a safety precaution not to burn out the motor.

Figure 30A:
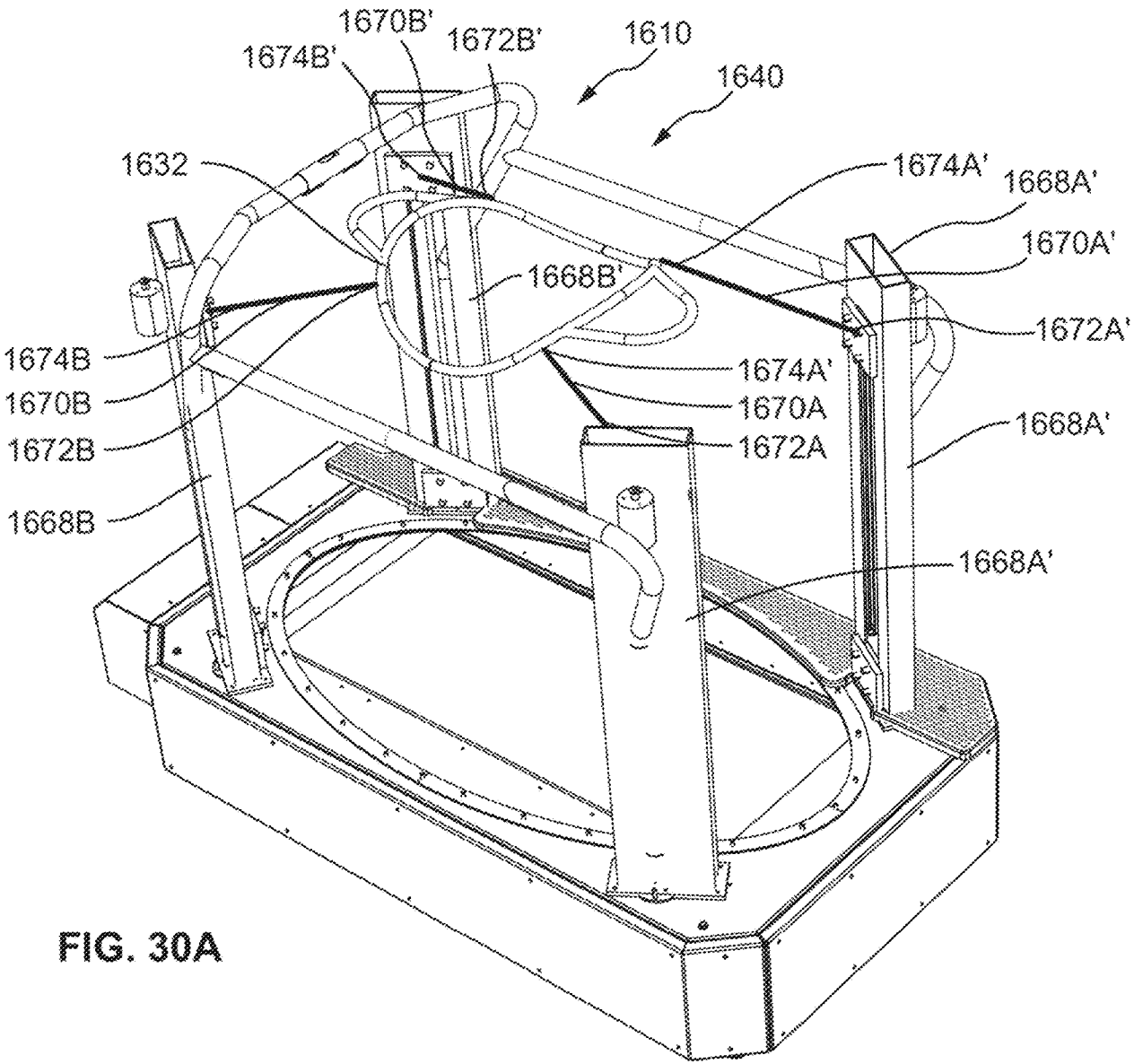
FIG. 30A is a schematic rear perspective view showing of the DAP System and enclosure having four (4) pairs of lift mechanisms along lateral corner regions of the enclosure according to aspects and features of various examples and inventive concepts discussed herein.
Figure 30B:
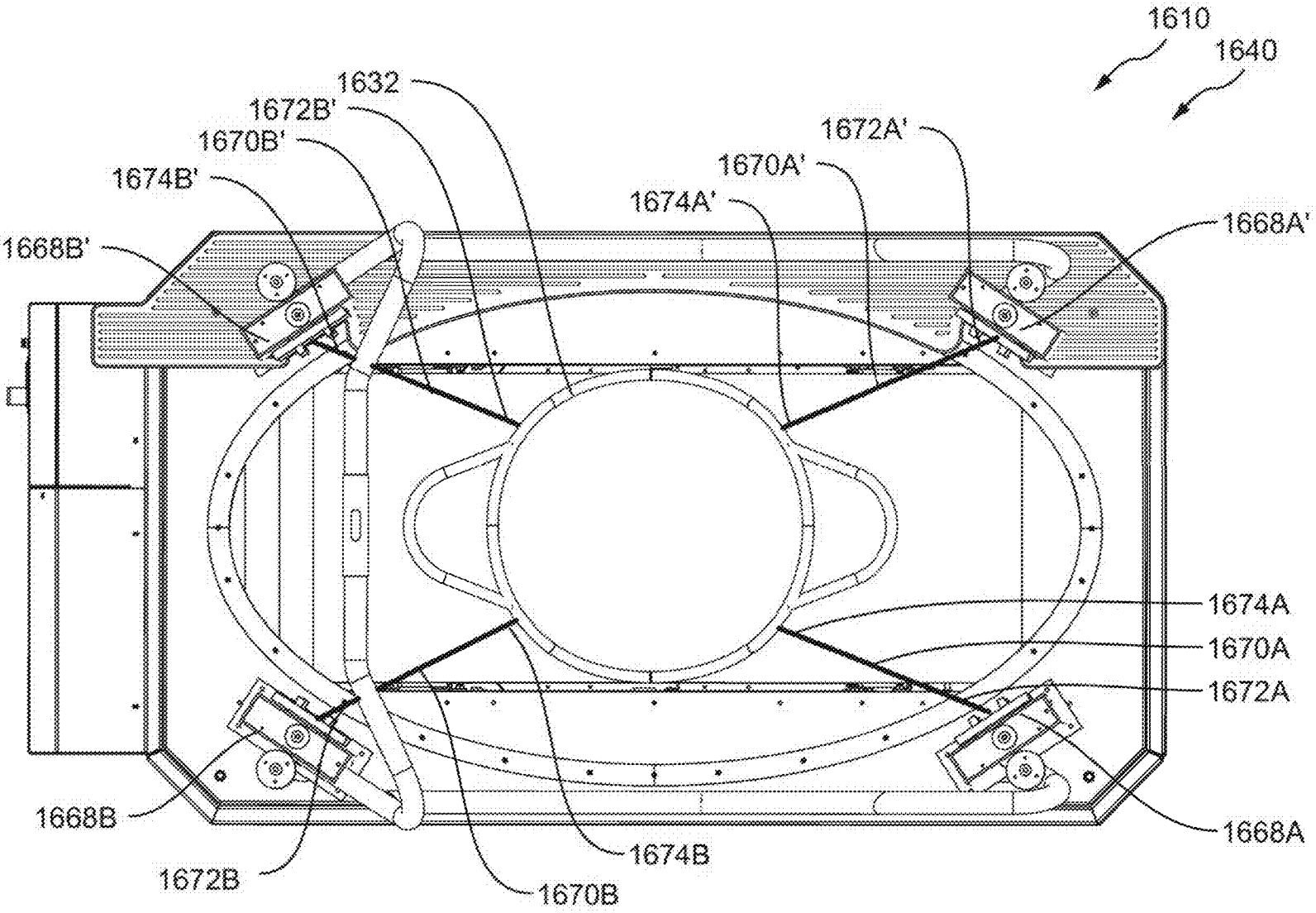
FIG. 30B is a top view of the same.

Referring now to FIGS. 30A & 30B, a further DAP System 1640 is shown that generally includes the aspects and features of DAP System 1540 and inflatable enclosure 1510 discussed above except as shown and described hereafter. Accordingly, like numbers refer to like features. Although DAP System 1640 is shown without an inflatable enclosure for clarity purposes, it is understood that DAP System 1640 includes an inflatable enclosure that is generally the same as inflatable enclosure 1510. As shown, DAP System 1640 includes four (4) control devices 1668A,B, A'&B' arranged about a perimeter region of the enclosure (not shown) and base opening 1654 and, in particular, at corner locations of the support platform 1642 about the perimeter regions. Such an arrangement corresponds with attachment arrangements of four (4) lift restraints 1670A, B,A'&B' with seal frame 1632 that has been found effective for imparting controls to the seal frame and enclosure via tensile forces applied through the restraints.

Seal frame 1632 as shown includes fore and aft extensions, which can reduce upward bulging of the inflatable enclosure proximate the seal frame, which can occur during height adjustment settings that are lower than the native full height of the enclosure. Although control devices 1668A,B, A'&B' are shown having vertically movable connections with the lift restraints 1670A,B,A'&B' disposed on inboard portions of the control devices directed toward the inflatable enclosure (not shown) and base support 1654, it is understood that an opposite arrangement shown along with DAP System 1540 can be implemented and can be desirable for avoiding inadvertent contact with the enclosure (not shown). In particular, vertically movable connections with the lift restraints 1670A,B,A'&B' can be disposed on outboard portions of the control device 1668A,B,A'&B'.

Methods Pertaining to DAP Systems and Enclosures Having Lift/Safety Restraints

Figure 31:
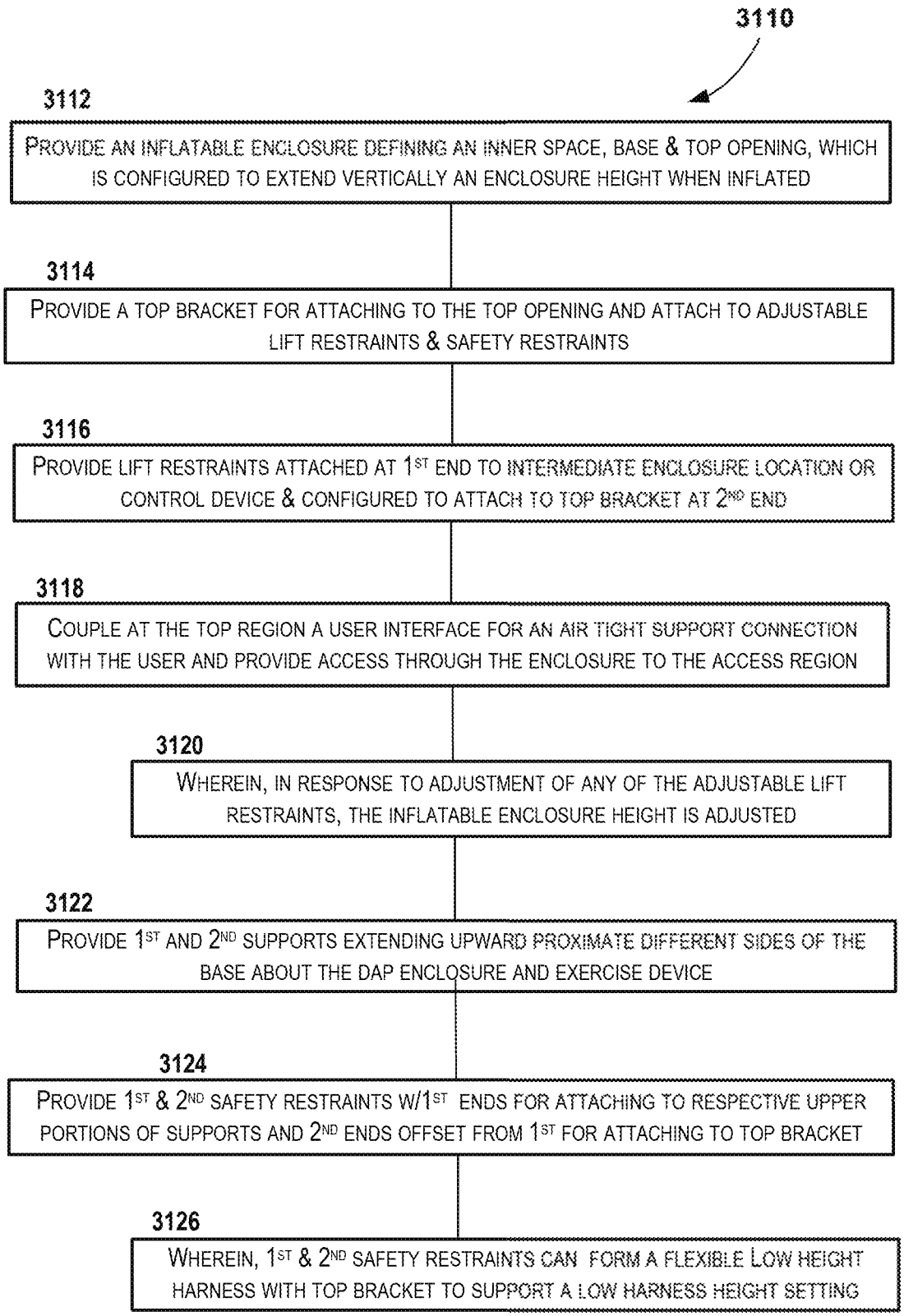
FIG. 31 is a schematic representation of a method for adjusting an enclosure height of a DAP system according to aspects and features of various examples and inventive concepts discussed herein.
Figure 32:
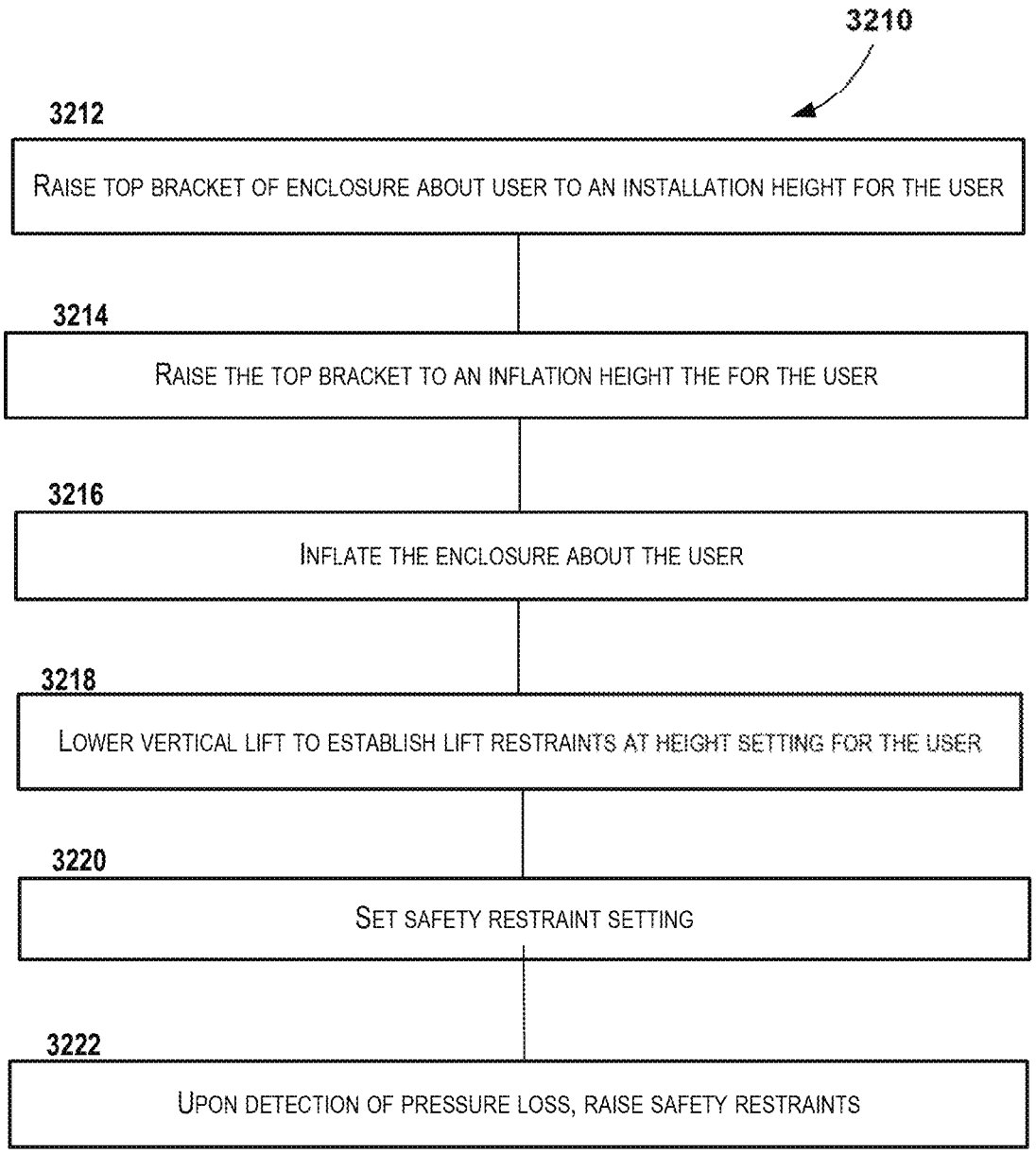
FIG. 32 is a schematic representation of a further method for adjusting an enclosure height of a DAP system according to aspects and features of various examples and inventive concepts discussed herein.

Referring now to FIGS. 31 and 32, methods 3110 and 3210 are generally illustrated pertaining to usage and operations of DAP Systems and enclosures shown and described herein. With particular reference to FIG. 31, a method 3110 includes providing 3112 an inflatable enclosure defining an inner space, base & top opening, which can be configured to extend vertically an enclosure height when inflated, which can be considered a native vertical height for the enclosure without lowering height adjustments being imparted on the enclosure. The method can include providing 3114 a seal frame for attaching to the top opening and attaching to adjustable lift restraints and optional lift restraints. The method can continue to include providing 3116 adjustable lift restraints attached to the enclosure above the base opening and below the top opening at a first connection or configured to attach to vertically movable control devices at the first connection end, and configured to attach to the seal frame or proximate the seal frame at a second connection end. The method can further include coupling at a top region of the enclosure a user interface for establishing an airtight support connection with the user while providing access through the enclosure to an access region to an exercise device within a support platform, wherein, 3120 in response to adjustment of any of the adjustable lift restraints, the inflatable enclosure height can be adjusted, which can include adjustment imparted via movement imparted by the optional control devices.

Optionally, the method 3110 can continue for providing 3122 first and second independent supports extending upward proximate different sides of the base about the inflatable enclosure and exercise device, and for providing 3124 first and second safety restraints with first ends of the safety restraints for attaching to respective upper portions of the independent supports and second ends of the safety restraints for attaching to seal frame. The method can continue to include 3126 wherein first and second safety restraints can form a flexible low height harness with the seal frame to support a harness low height setting.

Referring now to FIG. 32, a further method 3210 is generally depicted. Method 3210 includes raising 3212 a seal frame of an uninflated inflatable enclosure of a DAP System about a user to an installation height for the user. This can allow a user to complete appropriate attachment and connection with the enclosure through the seal frame easily without having to hold the seal frame or fumble with connecting to the seal frame without the seal frame being held at a comfortable connection height. The seal frame can be raised to the installation height via lift restraints discussed along with examples described herein and/or via lift restraints and corresponding vertically movable control devices discussed along with examples described herein. As discussed along with those examples, it is understood that lifts, control devices and related mechanisms can be controlled via a DAP computer device or system, such as the computer device or system discussed hereafter along with FIG. 33. The method can continue with raising or lowering 3214 the seal frame to an inflation height for the user, inflating 3216 the enclosure about the user, 3218 optionally raising or lowering vertical lifts to establish optional lift restraints at height setting for the user, and 3220 optionally setting safety restraints setting based on raising or lowering the vertical lifts. The method can further include 3222 upon detection of pressure loss, raising safety restraints and/or raising vertically controllable control device and lift restraints for providing safety support for the user.

Referring now to FIG. 33, a block diagram is shown illustrating a computer system 3300 configured to provide the functionality described herein for controlling operations of a DAP System including initialization of the corresponding inflatable enclosure for a user, monitoring and controlling operations of the exercise device and inflatable enclosure along with other system components, interacting with the user, and performing shutdown operations in accordance with aspects and features of subject matter discussed herein. In some arrangements, the architecture shown in FIG. 33 can correspond to the devices illustrated and described herein with respect to the DAP System control panel or control device, though this is not necessarily the case. The computer system 3300 includes a processing unit 3302, a memory 3304, one or more user interface devices 3306, one or more input/output ("I/O") devices 3308, and one or more network devices 3310, each of which is operatively connected to a system bus 3312. The bus 3312 enables bi-directional communication between the processing unit 3302, the memory 3304, the user interface devices 3306, the I/O devices 3308, and the network devices 3310.

The processing unit 3302 may be a standard central processor that performs arithmetic and logical operations, a more specific purpose programmable logic controller ("PLC"), a programmable gate array, or other type of processor known to those skilled in the art and suitable for controlling the operation of the server computer. As used herein, the word "processor" and/or the phrase "processing unit" when used with regard to any architecture or system can include multiple processors or processing units distributed across and/or operating in parallel in a single machine or in multiple machines. Furthermore, processors and/or processing units can be used to support virtual processing environments. Processors and processing units also can include state machines, application-specific integrated circuits ("ASICs"), combinations thereof, or the like. Because processors and/or processing units are generally known, the processors and processing units disclosed herein will not be described in further detail herein.

The memory 3304 communicates with the processing unit 3302 via the system bus 3312. In some embodiments, the memory 3304 is operatively connected to a memory controller (not shown) that enables communication with the processing unit 3302 via the system bus 3312. The memory 3204 includes an operating system 3214 and one or more program modules 3216, which can include system controls 3214 for controlling operations of the DAP System, a safety module for detecting safety concerns and taking appropriate actions, and manual controls 3232 for enabling sets of user commands in accordance with safety parameters and system status. The operating system 914 can include, but is not limited to, members of the WINDOWS, WINDOWS CE, and/or WINDOWS MOBILE families of operating systems from MICROSOFT CORPORATION, the LINUX family of operating systems, the SYMBIAN family of operating systems from SYMBIAN LIMITED, the BREW family of operating systems from QUALCOMM CORPORATION, the MAC OS, iOS, and/or LEOPARD families of operating systems from APPLE CORPORATION, the FREEBSD family of operating systems, the SOLARIS family of operating systems from ORACLE CORPORATION, other operating systems, and the like.

The program modules 3316 may include various software and/or program modules for enabling or performing actions described herein, such as initialization actions for initial setup prior to and through inflation of the inflatable enclosure. In some embodiments, for example, the program modules 3316 can a Safety Module 3308 for performing Lift and Safety Restraint controls. These and/or other programs can be embodied in computer-readable media containing instructions that, when executed by the processing unit 3302, perform one or more of the methods related to subject matter describe herein including the method 3310 described above with respect to FIG. 33. The program modules 3316 may be embodied in hardware, software, firmware, or any combination thereof. Although not shown in FIG. 33, it should be understood that the memory 3304 also can be configured to store user settings and preferences data, historical usage data including previous usage settings, user interface data, metadata 3331, exercise programs for usage of the exercise device, entertainment and/or video content 3317, and/or other data, if desired.

By way of example, and not limitation, computer-readable media may include any available computer storage media or communication media that can be accessed by the computer system 3300. Communication media includes computer-readable instructions, data structures, program modules, or other data in a modulated data signal such as a carrier wave or other transport mechanism and includes any delivery media. The term "modulated data signal" means a signal that has one or more of its characteristics changed or set in a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

Computer storage media includes volatile and non-volatile, removable and non-removable media implemented in any method or technology for storage of information such as computer-readable instructions, data structures, program modules, or other data. Computer storage media includes, but is not limited to, RAM, ROM, Erasable Programmable ROM ("EPROM"), Electrically Erasable Programmable ROM ("EEPROM"), flash memory or other solid state memory technology, CD-ROM, digital versatile disks ("DVD"), or other optical storage, magnetic cassettes, magnetic tape, magnetic disk storage or other magnetic storage devices, or any other medium which can be used to store the desired information and which can be accessed by the computer system 900. In the claims, the phrase "computer storage medium" and variations thereof does not include waves or signals per se and/or communication media.

The user interface devices 3306 may include one or more devices with which a user accesses the computer system 3300. The user interface devices 3306 may include, but are not limited to, computers, servers, personal digital assistants, cellular phones, or any suitable computing devices. The I/O devices 3308 enable a user to interface with the program modules 3316. In one arrangement, the I/O devices 3308 are operatively connected to an I/O controller (not shown) that enables communication with the processing unit 3302 via the system bus 3312. The I/O devices 3308 may include one or more input devices, such as, but not limited to, a keyboard, a mouse, or an electronic stylus. Further, the I/O devices 3308 may include one or more output devices, such as, but not limited to, a display screen or a printer.

The network devices 3310 enable the computer system 3300 to communicate with other networks or remote systems via a network, such as wireless network. Examples of the network devices 3310 include, but are not limited to, a modem, a radio frequency ("RF") or infrared ("IR") transceiver, a telephonic interface, a bridge, a router, or a network card. The network 104 may include a wireless network such as, but not limited to, a Wireless Local Area Network ("WLAN") such as a WI-FI network, a Wireless Wide Area Network ("WWAN"), a Wireless Personal Area Network ("WPAN") such as BLUETOOTH, a Wireless Metropolitan Area Network ("WMAN") such a WiMAX network, or a cellular network. Alternatively, the network may be a wired network such as, but not limited to, a Wide Area Network ("WAN") such as the Internet, a Local Area Network ("LAN") such as the Ethernet, a wired Personal Area Network ("PAN"), or a wired Metropolitan Area Network ("MAN").

Figure 34:
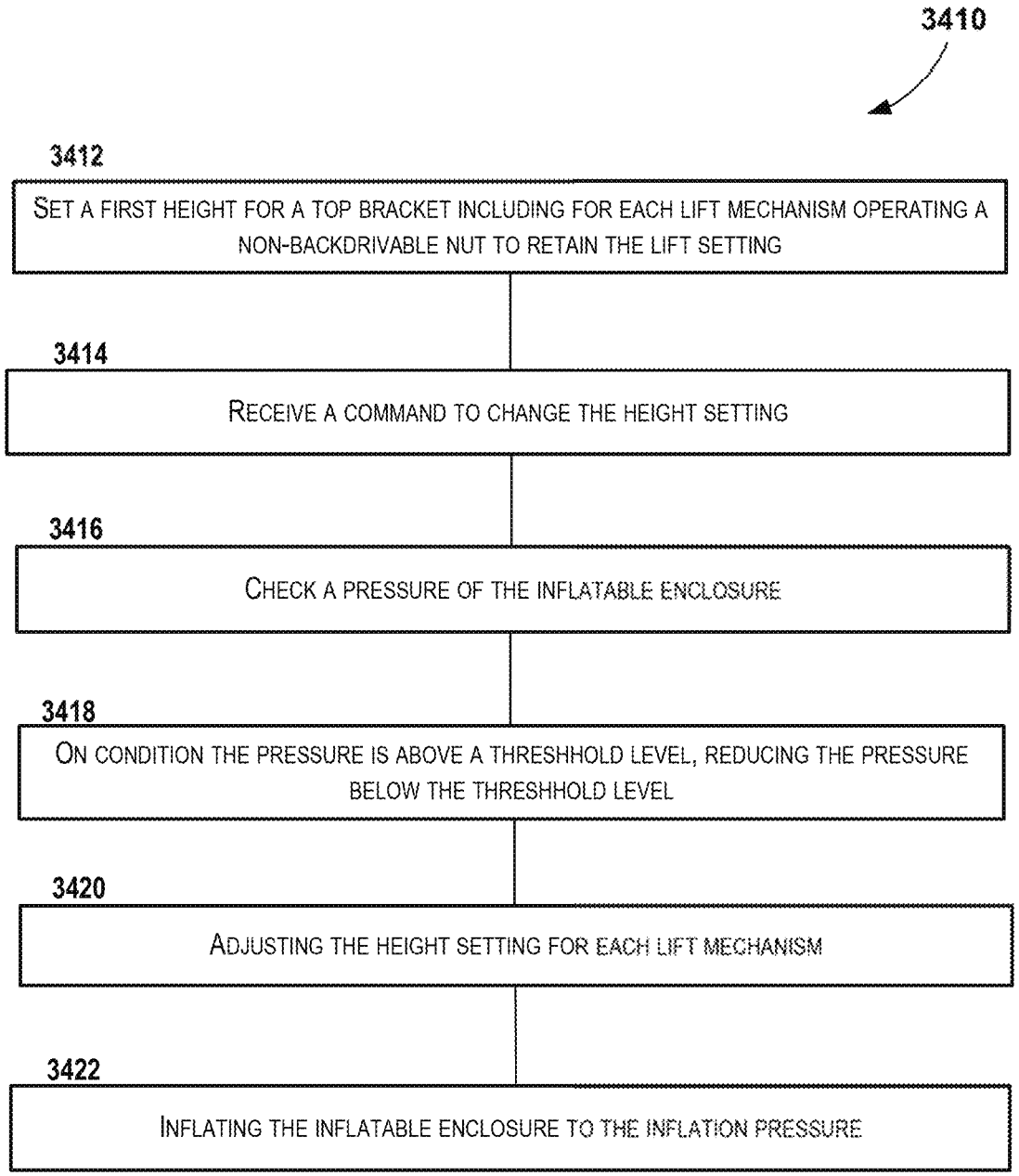
FIG. 34 is schematic representation of another method for adjusting an enclosure height of a DAP system according to aspects and features of various examples and inventive concepts discussed herein.

Referring now to FIG. 34, a method 3410 is generally shown for adjusting a height of a differential air pressure (DAP) system. The method can include a first action 3412 of setting a first height for a seal frame, which can include for each lift mechanism operating a non-backdrivable nut to retain the lift setting. In some arrangements, the first action 3412 of setting a first height for the seal frame can include setting one or more automatic default settings for the DAP system, which can include automatic default settings for a default user of the device. In some arrangements, the first action 3412 can include setting one or more automatic default settings for a previous user of the DAP system. In other arrangements, the first action 3412 can include setting automatic default settings for a primary default user of the DAP system, which can include pre-established preferred default settings for the primary default user of the DAP system. Further, the first action 3412 can include actions 3212 to 3220 of method 3220 for cycling through a series of default settings for a primary default user or previous user of the DAP system to place the DAP system in user-operable inflation condition.

Method 3410 can further include the DAP system receiving 3414 a command to change a height adjustment setting, which can include receiving a user entry for modifying a height of the inflatable enclosure, such as for accommodating a user preference for changing a tilt angle, height or other parameter for the seal frame or for accommodating preferences of a different user than the default user. The method 3410 can continue for checking 3416 a pressure of the inflatable enclosure and, on condition the pressure is above a threshold adjustment level, reducing 3418 the pressure of the inflatable ensure below the threshold adjustment level. The method 3410 can continue for adjusting 3420 the height setting of each lift mechanism. Thereafter, the method 3410 can continue with inflating 3422 the inflatable enclosure to an appropriate inflation pressure. In this manner, each lift mechanism can be protected from having unweighting forces being applied to the lift mechanism during usage outside of safe pressure ranges. Further, usage of a non-backdrivable nut for each lift mechanism can ensure height settings are maintained during usage without upweighting forces imparting corresponding torques to the lift mechanisms.

The subject matter described above is provided by way of illustration only and should not be construed as limiting. Various modifications and changes may be made to the subject matter described herein without following the example embodiments and applications illustrated and described, and without departing from the true spirit and scope of the embodiments of the concepts and technologies disclosed herein.

Although various embodiments have been described as having particular features and/or combinations of components, other embodiments are possible having a combination of any features and/or components from any of embodiments as discussed above. Aspects have been described in the general context of exercise devices, and more specifically supplemental lifting, unweighting or differential air pressures mechanisms, devices, systems, and methods for exercise devices, but inventive aspects are not necessarily limited to use with exercise devices.

What is claimed is:

1. A differential air pressure (DAP) exercise system having a height-adjustable top opening, the DAP exercise system comprising:

a support platform;

an inflatable enclosure comprising a plurality of panels attached to each other, the inflatable enclosure having a base defining a base opening attached to the support platform, an opposite top portion defining the top opening, a front portion, and an opposite rear portion, the top portion and the top opening extending upward from the base opening in an inflated state to a height comprising a full top opening height and at least one lower reduced top opening height; and a seal frame attached to the inflatable enclosure top portion proximate the top opening; and a plurality of adjustable lift restraints vertically limiting the seal frame and thereby the top opening height, each adjustable lift restraint having a first end, a second end, and a restraint length therebetween, each first end attached to one of a side portion of the enclosure or to an upper region of a vertical motorized lift pillar having a pillar base region attached to the platform; and each second end connected to the seal frame;

wherein:

in the inflated state, the plurality of attached panels form a radial-stress oriented inflated pressure vessel from at least a middle height region of the enclosure to the top portion, radial stresses of the inflated pressure vessel forming a plurality of spaced apart lateral fold lines aligned with radial-stress orientations and extending across a radial edge portion of the pressure vessel at at least a low hoop stress region of each of the top portion, the front portion and the rear portion;

the seal frame is attached to the top portion interposed between one or more of the low hoop stress regions;

the plurality of adjustable lift restraints induce folding of the inflated pressure vessel in one or more of the lateral fold lines responsive to restraining the top opening height against upward inflation forces; and the adjustable lift restraints are adapted to adjust at least one of the following: the top opening height between the full top opening height and the lower reduced top opening height, a forward tilt of the top opening, a rearward tilt of the top opening, a left lean of the top opening, and a right lean of the top opening.

2. The height-adjustable top opening DAP exercise system of claim 1, the plurality of adjustable lift restraints comprising a first pair and a second pair of adjustable lift restraints wherein:

the first ends of the first pair are each attached to a first side panel of the plurality of panels proximate the middle height region;

the first ends of the second pair are each attached to an opposite second side panel of the plurality of panels proximate the middle height region;

the second ends of the first pair are each connected to a first side of the seal frame matching the first side panel, a front adjustable lift restraint of the first pair connected to a front portion of the first side of the seal frame, a rear adjustable lift restraint of the first pair connected to a rear portion of the seal frame; and the second ends of the second pair are each connected to a second side of the seal frame matching the second side panel, a front adjustable lift restraint of the second pair connected to a front portion of the second side of the seal frame, a rear adjustable lift restraint of the second pair connected to a rear portion of the second side of the seal frame;

each of the adjustable lift restraints are adapted to adjust between a first restraint length and at least one second restraint length different from the first restraint length; and the two pairs of adjustable lift restraints adjustable between the first restraint length and the at least one second restraint length for adjustably restraining the seal frame and adjusting the top opening for at least one of the following heights and orientations: the full top opening height, the lower reduced top opening height, the forward tilt of the top opening, the rearward tilt of the top opening, the left lean of the top opening, and the right lean of the top opening.

3. The height-adjustable top opening differential air pressure (DAP) exercise system of claim 1, wherein:

the first end of one of the plurality of adjustable lift restraints is attached to the upper region of the vertical motorized lift pillar, the vertical motorized lift pillar adapted for vertically adjusting the attached first end of the one of the plurality of adjustable lift restraints.

4. The height-adjustable top opening DAP exercise system of claim 3, the plurality of adjustable lift restraints comprising a first pair and a second pair of adjustable lift restraints wherein:

the first ends of the first pair are each attached to the upper region of the vertical motorized lift pillar, the pillar being a first vertical motorized lift pillar; the first ends of the second pair are each attached to an upper region of a second vertical motorized lift pillar; the second ends of the first pair are each connected to a first side of the seal frame matching the first vertical motorized lift pillar, the second end of a front adjustable lift restraint of the first pair connected to a front portion of the first side of the seal frame, a second end of a rear adjustable lift restraint of the first pair connected to a rear portion of the first side of the seal frame; and the second ends of the second pair are each connected to a second side of the seal frame matching the second vertical motorized lift, a second end of a front adjustable lift restraint of the second pair connected to a front portion of the second side of the seal frame, a second end of a rear adjustable lift restraint of the second pair connected to a rear portion of the second side of the seal frame;

wherein the first pair and the second pair of adjustable lift restraints are vertically adjustable along with vertical control movements of the first and the second vertical motorized lift pillars, such that a height of the seal frame and the height of the top opening are adjustable responsive to the vertical control movements of the first and second vertical motorized lift pillars.

5. The height-adjustable top opening differential air pressure (DAP) exercise system of claim 1, wherein the plurality of attached panels include a first panel laterally spaced apart from a second panel in the inflated state, the inflatable enclosure further comprising:

a first substantially vertical hub region defined along the first panel at the middle height region; and a second substantially vertical hub region defined along the second panel at the middle height region;

wherein:

the first panel and the second panel are arranged and attached to each other to form the radial-stress oriented inflated pressure vessel such that pressure-induced stresses are transmitted through a substantially inelastic flexible material of the inflatable enclosure and concentrated at each of the substantially vertical hub regions;

the radial stresses extend through the substantially inelastic flexible material away from each of the hub regions and traverse a region of the radial edge portion forming substantially continuous radially oriented stresses between opposite hub regions; and the radial stresses at each of the hub regions form a pair of opposite stable supports at the middle height region of the inflatable enclosure for attaching and supporting the first ends of the plurality of adjustable lift restraints.

6. The height-adjustable top opening differential air pressure (DAP) exercise system of claim 1, wherein:

the plurality of attached panels include a first panel laterally spaced apart from a matching second panel in the inflated state, the first and second panels attached to each other at a respective perimeter region of each, the attached first and second panels defining a user interface shape at at least the top portion of the enclosure such that, when inflated, the inflatable enclosure forms the inflated pressure vessel, which is longitudinally symmetrical, from at least the middle height region of the enclosure to the top portion and defines at least the top portion as a longitudinal low-perimeter-stress radial edge portion of the inflated epressure vessel;

the plurality of spaced apart lateral fold lines extend laterally across the longitudinal low-perimeter-stress radial edge portion in the inflated state; and upward pressure-induced unweighting forces applied within the inflated pressure vessel and restrained by the plurality of adjustable lift restraints induce folding of the inflated pressure vessel in one or more of the lateral fold lines across the longitudinal-low-perimeter stress radial edge portion.

7. The height-adjustable top opening DAP exercise system of claim 6, wherein:

the attached first and second panels define the user interface shape generally as an end dome shape;

the longitudinal-low-perimeter stress radial edge portion is formed within the end dome shape as the low hoop stress zone; and in the inflated state:

differential air pressure within the enclosure exerts substantially equal and opposite lateral outboard forces against an inboard surface of each side panel urging a first and a second side panel of the plurality of panels apart from each other, radial retention stresses opposing the lateral outboard forces are carried through each of the first and the second side panels radially across attached perimeter regions and extending between each of the side panels at the middle height region such that the attached perimeter regions form a low hoop stress curved edge portion in a longitudinal direction along an upper radial edge portion; and radially oriented stresses form the plurality of fold lines as lateral wrinkles extending across the low hoop stress curved edge portion.

8. The height-adjustable top opening DAP exercise system of claim 7, wherein:

the low hoop stress curved edge portion defines a plurality of substantially smooth curved sections extending in a lateral direction across the low hoop stress curved edge portion disposed between an adjacent pair of the wrinkles;

the wrinkles define zero or negative hoop stress sections of the low hoop stress curved edge portion;

the substantially smooth curved sections define low or positive hoop stress sections of the low hoop stress curved edge portion; and the plurality of adjustable lift restraints are attached to each of the first and the second panels, the seal frame, the base or another feature and are arranged to adjust the restraint length to induce increased folding of the enclosure at one or more of the plurality of wrinkles for reducing the top opening height without exerting high restraint forces to system components and without changing the substantially smooth curved sections for adjusting an enclosure height without impacting enclosure integrity or stability.

9. The height-adjustable top opening DAP exercise system of claim 8, wherein:

the low hoop stress curved edge portion along the top portion of the enclosure, the end dome shape at the top portion of the enclosure, and the plurality of wrinkles across the low hoop stress curved edge portion of the top portion define a partially crushable, low adjustment stress zone for top opening height adjustment at the top portion without requiring height adjustment throughout the enclosure;

the plurality of adjustable lift restraints comprises a plurality of adjustable seal frame lift restraints, each seal frame lift restraint attached at the first end to the enclosure proximate the middle height region and at the second end to a portion of the seal frame, the seal frame disposed along the dome shape within the low hoop stress curved edge portion; and the top opening height is adjustable in response to a seal frame height adjustability along a section of the top curved edge portion proximate a user seal.

10. The height-adjustable top opening DAP exercise system of claim 1, wherein the seal frame comprises:

a front enclosure bloom extension, the front enclosure bloom extension forming a substantially horizontal shield in front of the seal frame configured to shield a user from obstruction or contact with the enclosure in response to adjusting the top opening height to a lower height without adjusting an enclosure height; and a rear enclosure bloom extension, the rear enclosure bloom extension forming a substantially horizontal shield at a rear of the seal frame configured to shield the user from obstruction or contact with the enclosure in response to adjusting the top opening height to the lower height without adjusting the enclosure height.

11. The height-adjustable top opening DAP exercise system of claim 1, wherein the DAP exercise system is configured to adjust the top opening height from the full top opening height to the lower reduced top opening height without substantially increasing system stresses including without increasing:

a horizontal cross-sectional area of the enclosure;

an internal pressure of the enclosure;

a lift force exerted on the platform; and an unweighting force configured to be applied to a user;

wherein the plurality of adjustable lift restraints are configured to induce bending along a plurality of wrinkles and flatten an end dome shape responsive to reducing the top opening height along with reducing system stresses exerted by the plurality of adjustable lift restraints.

12. The height-adjustable top opening DAP exercise system of claim 1, wherein:

the seal frame includes a plurality of lateral attachment extensions for reducing an attachment angle between each of the adjustable lift restraints and the seal frame for enhancing restraint forces exerted on the seal frame and reducing attachment stresses of the adjustable lift restraints.

13. The height-adjustable top opening DAP exercise system of claim 1, the plurality of adjustable lift restraints comprise at least one adjustable lift restraint attached to each of a first side panel and a second side panel including:

the first end of the at least one adjustable lift restraint is attached to the first side panel and the second end of the at least one adjustable lift restraint is attached to one of a portion of the seal frame proximate the first side panel and a second position on the first side panel vertically offset from the first end, the at least one adjustable lift restraint attached to the first side panel adjusted to match a distance between the first and second ends of the at least one adjustable lift restraint without imparting restraints;

at least one other adjustable lift restraint of the plurality of adjustable lift restraints, wherein the first end of the at least one other adjustable lift restraint is attached to the second side panel and the second end of the at least one other adjustable lift restraint is attached to one of a portion of the seal frame proximate the second side panel and a second position on the second side panel vertically offset from the first end, the at least one other adjustable lift restraint attached to the second side panel adjusted to match a distance between the first and second ends of the at least one other adjustable lift restraint without imparting restraints; and wherein the at least one and the at least one other of the adjustable lift restraints are configured to stabilize and reinforce stability of the enclosure, each of the at least one and the at least one other of the adjustable lift restraints adjusted for resisting outboard bending of the enclosure away from the side panel to which it is attached without restricting an initial height of the enclosure or limiting inboard bending of the enclosure toward the side panel to which it is attached.

14. The height-adjustable top opening DAP exercise system of claim 1, further comprising:

a first support proximate a first side of the enclosure extending upward from the base;

a second support proximate a second side of the enclosure extending upward from the base;

a first end of a first safety restraint attached to an upper portion of the first support; and a first end of a second safety restraint attached to an upper portion of the second support;

wherein a second end of the first safety restraint and a second end of the second safety restraint are attached to the seal frame and form a flexible low height safety harness with the seal frame for restraining the seal frame at a low height below a lowest enclosure height.

15. The height-adjustable top opening DAP exercise system of of claim 14, further comprising:

a first seal frame lift-assist device attached to the first support and the first end of the first safety restraint; and a second seal frame lift-assist device attached to the second support and the first end of the second safety restraint;

wherein each of the first and second seal frame lift-assist devices comprises a passive assist, spring-loaded, and electrically powered rotary assist device configured to adjust a length of one of the first safety restraint and the second safety restraint between the seal frame and a respective one of the first and second supports.

16. A differential air pressure (DAP) exercise system having a height-adjustable top opening, the DAP exercise system comprising:

a support platform;

an inflatable enclosure formed from a substantially inelastic flexible material having a base defining a base opening attached to the support platform, a front portion, an opposite rear portion aligned with the front portion in a longitudinal direction of the enclosure, and a top portion defining the top opening therethrough that, when inflated, extends upward from the base opening to at least a full top opening height, the inflatable enclosure comprising:

a plurality of panels of the substantially inelastic flexible material attached to each other such that, when inflated, the attached panels form a radial-stress oriented inflated pressure vessel from at least a middle height region of the enclosure to one of the top portion and an opposite bottom portion proximate the base, the inflated pressure vessel forming a plurality of spaced apart lateral fold lines parallel with a radial-stress orientation and across a radial edge portion of the pressure vessel;

a seal frame attached to the inflatable enclosure top portion proximate the top opening; and a plurality of lift restraints vertically limiting the seal frame and thereby the top opening height, each lift restraint having a first end, a second end, and a restraint length therebetween, each first end attached to one of a side portion of the enclosure or to an upper region of at least one of a plurality of vertical motorized lift pillars having a pillar base region attached to the platform; and each second end connected to the seal frame;

wherein the top opening height is adjustable between the full top opening height and at least one lower reduced top opening height in response to one of downward movement of the upper region of at least one of the vertical motorized lift pillars or an adjustment reducing the restraint length of at least one of the plurality of lift restraints.

17. The DAP system of claim 16, wherein:

when inflated, the attached panels of the inflatable enclosure form the radial-stress oriented inflated pressure vessel from at least the middle region of the enclosure to the top portion; and the first ends of each lift restraint are attached to the upper region of the vertical motorized lift pillar and the second ends of each lift restraint are attached to the seal frame; and the top opening height is adjustable between the full top opening height and the at least one lower reduced upper opening height in response to the downward movement of the top region of the at least one vertical motorized lift pillar.

* * * * *